US006930698B2

(12) United States Patent
Goto et al.

(10) Patent No.: US 6,930,698 B2
(45) Date of Patent: Aug. 16, 2005

(54) IMAGE FORMATION ON HEAT-DEVELOPABLE LIGHT-SENSITIVE MATERIAL AND IMAGE FORMING APPARATUS

(75) Inventors: Yasuhiko Goto, Kanagawa (JP); Katsutoshi Yamane, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/913,446

(22) Filed: Aug. 9, 2004

(65) Prior Publication Data

US 2005/0024469 A1 Feb. 3, 2005

Related U.S. Application Data

(62) Division of application No. 10/192,863, filed on Jul. 11, 2002, now Pat. No. 6,791,593.

(30) Foreign Application Priority Data

Jul. 12, 2001 (JP) ..... P. 2001-212256
Nov. 14, 2001 (JP) ..... P. 2001-348862

(51) Int. Cl.[7] ..... B41J 2/435; G03C 1/498; G03C 5/26

(52) U.S. Cl. ..... 347/225; 430/350; 430/353

(58) Field of Search ..... 347/224, 225; 430/350, 353, 617, 618, 541

(56) References Cited

U.S. PATENT DOCUMENTS 3,781,902 A 12/1973 Shem et al.
6,143,488 A * 11/2000 Uytterhoeven et al. ..... 430/619
6,288,370 B1 9/2001 Ogawa et al.
6,309,114 B1 10/2001 Torisawa et al.
6,320,642 B1 11/2001 Ogawa et al.
6,335,153 B1 * 1/2002 Toya ..... 430/350
2002/0039708 A1 4/2002 Katoh et al.

FOREIGN PATENT DOCUMENTS

EP 0 851 284 A1 7/1998
EP 0 922 995 A1 6/1999
JP 11-133572 A 5/1991
JP 5-224347 * 9/1993 ..... 430/363
JP 2000-305213 A 11/2000
JP 2000-321743 A 11/2000
JP 2000-321744 A 11/2000

OTHER PUBLICATIONS

XP–002219658, Fuji Photo Film, Nov. 2, 2000 'Abstract'.

* cited by examiner

*Primary Examiner*—Huan Tran
(74) *Attorney, Agent, or Firm*—Sughrue Mion, PLLC

(57) ABSTRACT

An image forming method comprising exposing a heat-developable light-sensitive material comprising a support having thereon at least a light-sensitive silver halide having a silver iodide content of 5 to 100 mol %, a light-insensitive organic silver salt, a heat developing agent, and a binder by means of a scanning optical system having a light source emitting a laser beam having an emission peak between 350 nm and 450 nm to form a latent image on said heat-developable light-sensitive material, heating said heat-developable light-sensitive material to about 80 to 250° C. in a heat development section, and cooling said heat-developable light-sensitive material having been heat treated in said heat development section to or below a development stopping temperature while said heat-developable light-sensitive material is transported in a cooling section.

2 Claims, 21 Drawing Sheets

IMAGE FORMATION ON HEAT-DEVELOPABLE LIGHT-SENSITIVE MATERIAL AND IMAGE FORMING APPARATUS

This is a divisional application of U.S. application Ser. No. 10/192,863 Jul. 11, 2002, now U.S. Pat. No. 6,791,593 the disclosure of which is incorporated herein by reference.

BACKGROUND OF THE INVENTION

1. Field of the Invention

This invention relates to a technique for high-sensitivity high-precision imaging and size reduction of an imaging apparatus used for a dry image recording system.

2.Description of the Related Art

Imaging apparatus for obtaining diagnostic hard copy images by digital radiography using storage phosphor imaging plates, CT imaging, MR imaging, etc. have adopted a wet system wherein a silver salt photographic material is exposed and wet-processed.

On the other hand, a dry system recording apparatus involving no wet chemical processing has recently engaged attention. Light-sensitive and/or heat-sensitive heat-developable photographic materials or heat-developable photographic films (hereinafter inclusively referred to as heat-developable light-sensitive materials) are used in a dry system recording apparatus. In a dry system recording apparatus, a heat-developable light-sensitive material is irradiated (scanned) with a laser beam to form a latent image in an image exposure section, brought into contact with a heating means to perform heat development in a heat development section, and discharged out of the apparatus.

The dry system is advantageous in that image formation completes in a shorter time than in a wet system and that the issue of waste liquid disposal is not involved, and is fully expected to enjoy an increasing demand.

Heat-developable light-sensitive materials that have been used in a conventional dry system have a silver halide spectrally sensitized to the infrared or red region. However, spectrally sensitized heat-developable light-sensitive materials undergo desensitization during storage due to gradual decomposition of the spectral sensitizers with time.

JP-A-12-305213, filed by the same applicant as the present invention, suggests that the problem is settled by exposing a silver halide which is not spectrally sensitized to an ultraviolet to blue laser beam. Nevertheless, the method disclosed failed to design a sufficiently sensitive system and was insufficient for assuring necessary image quality, i.e., sharpness.

SUMMARY OF THE INVENTION

An object of the present invention is to provide a method and an apparatus for image formation which achieve high-density high-precision imaging or system size reduction compared with conventional apparatus by using a high-iodide silver halide light-sensitive material having high image quality and high sensitivity to an ultraviolet to blue laser beam.

The present invention provides, in an aspect, an image forming method comprising exposing a heat-developable light-sensitive material comprising a support having thereon at least a light-sensitive silver halide having a silver iodide content of 5 to 100 mol %, a light-insensitive organic silver salt, a heat developing agent, and a binder by means of a scanning optical system having a light source emitting a laser beam having an emission peak between 350 nm and 450 nm to form a latent image on the heat-developable light-sensitive material, heating the heat-developable light-sensitive material to about 80 to 250° C. in a heat development section, and cooling the heat-developable light-sensitive material having been heat treated in the heat development section to or below a development stopping temperature while the heat-developable light-sensitive material is transported in a cooling section.

The image forming method of the invention includes an embodiment wherein the silver halide of the heat-developable light-sensitive material exhibits a direct transition absorption ascribed to the silver iodide crystal structure.

The present invention also provides, in another aspect, an image forming apparatus comprising:

an image exposure section having a scanning optical system including a laser light source emitting a laser beam having an emission peak between 350 nm and 450 nm, in which a heat-developable light-sensitive material is image-wise exposed to form a latent image, a heat development section in which the heat-developable light-sensitive material having the latent image is heated to about 80 to 250° C., and a cooling section in which the heat-developable light-sensitive material having been heat treated in the heat development section is cooled to or below a development stopping temperature.

The image forming apparatus according to the invention includes the following embodiments:

1) The scanning optical system is composed of the laser light source, a polarizer for polarizing the laser beam from the laser light source, and a plurality of optical elements for directing the laser beam from the polarizer to the heat-developable light-sensitive material.
2) The laser light source has an emission peak between 390 nm and 430 nm.
3) The laser beam is from a semiconductor laser.
4) The laser light source has a plurality of lasers, and laser beams from the respective lasers are superposed.
5) The laser light source has a plurality of lasers having their oscillation wavelengths set different so that the respective beams reflected from the heat-developable light-sensitive material may offset against each other, and the plurality of beams are superposed to have approximately the same wavelength.
6) The laser beam is directly modulated to form a gray scale latent image on the heat-developable light-sensitive material.
7) The laser beam is modulated by an acoustic optical modulator to form a gray scale latent image on the heat-developable light-sensitive material.
8) At least one of the optical elements is an aspherical optical element.
9) The laser beam has a beam diameter of about 20 to 150 $\mu$m on the surface of the heat-developable light-sensitive material.
10) The heat development section has:
   - at least two heaters which are fixedly arranged along the moving direction of the heat-developable light-sensitive material and impart a heat treatment at a prescribed temperature to the heat-developable light-sensitive material,
   - a delivering means for sliding the heat-developable light-sensitive material downstream on each of the heaters, and
   - a pressing means for pressing at least part of the heat-developable light-sensitive material, while being delivered, onto the surface of the heaters.

11) The temperatures of the heaters are individually controlled.

12) At least one of the heaters which is the most upstream in the heat development section is divided into at least three portions across the width direction of the heat-developable light-sensitive material, and the temperatures of the at least three portions are individually controlled.

13) The heat development section has:

a heat drum which imparts a heat treatment at a prescribed temperature to the heat-developable light-sensitive material being transported on the heat drum and a pressing means for pressing the heat-developable light-sensitive material onto the surface of the heat drum.

14) The heat-developable light-sensitive material is vertically delivered while being scanned with the laser beam in the fast-scan direction.

15) The cooling section has a heat conductive roll by which the heat-developable light-sensitive material is delivered.

16) The cooling section has a heat conductive belt which cools the heat-developable light-sensitive material to or below a development stopping temperature while conveying the heat-developable light-sensitive material.

17) The cooling section has a plurality of rollers between which the heat-developable light-sensitive material is transported and meanwhile cooled to or below a development stopping temperature, and the rollers in the downstream half of the cooling section cool the heat-developable light-sensitive material to or below the glass transition temperature of the base of the heat-developable light-sensitive material.

18) The cooling section comprises a plurality of cooling rollers arranged on both sides of the heat-developable light-sensitive material in an alternate configuration.

19) The image forming apparatus has a density correction system comprising a density measuring section for measuring the density of a heat-developed image on the heat-developable light-sensitive material and a density correction calculating section which detects a density difference between the density data of the developed image measured in the density measuring section and recorded image density signals and calculates image signals to be sent to the image exposure section or heat energy to be applied to the heat development section based on the density difference thereby to make density correction.

The above-described constitution of the method and apparatus allows use of a heat-developable light-sensitive material which is capable of forming a high quality image with high sensitivity by blue laser exposure. Accordingly, high-output small-size semiconductor lasers having short wavelengths of around 400 nm can be utilized for exposure, which brings about the following advantages. Applied to an apparatus of conventional size, the system of the present invention allows a beam to be converged to a smaller diameter, which enables imaging with higher density and higher precision. The beam size being equal, on the other hand, the optical pass length (focal length) can be made shorter, which allows remarkable size reduction of optical equipment.

BRIEF DESCRIPTION OF THE DRAWINGS

Figure 1:
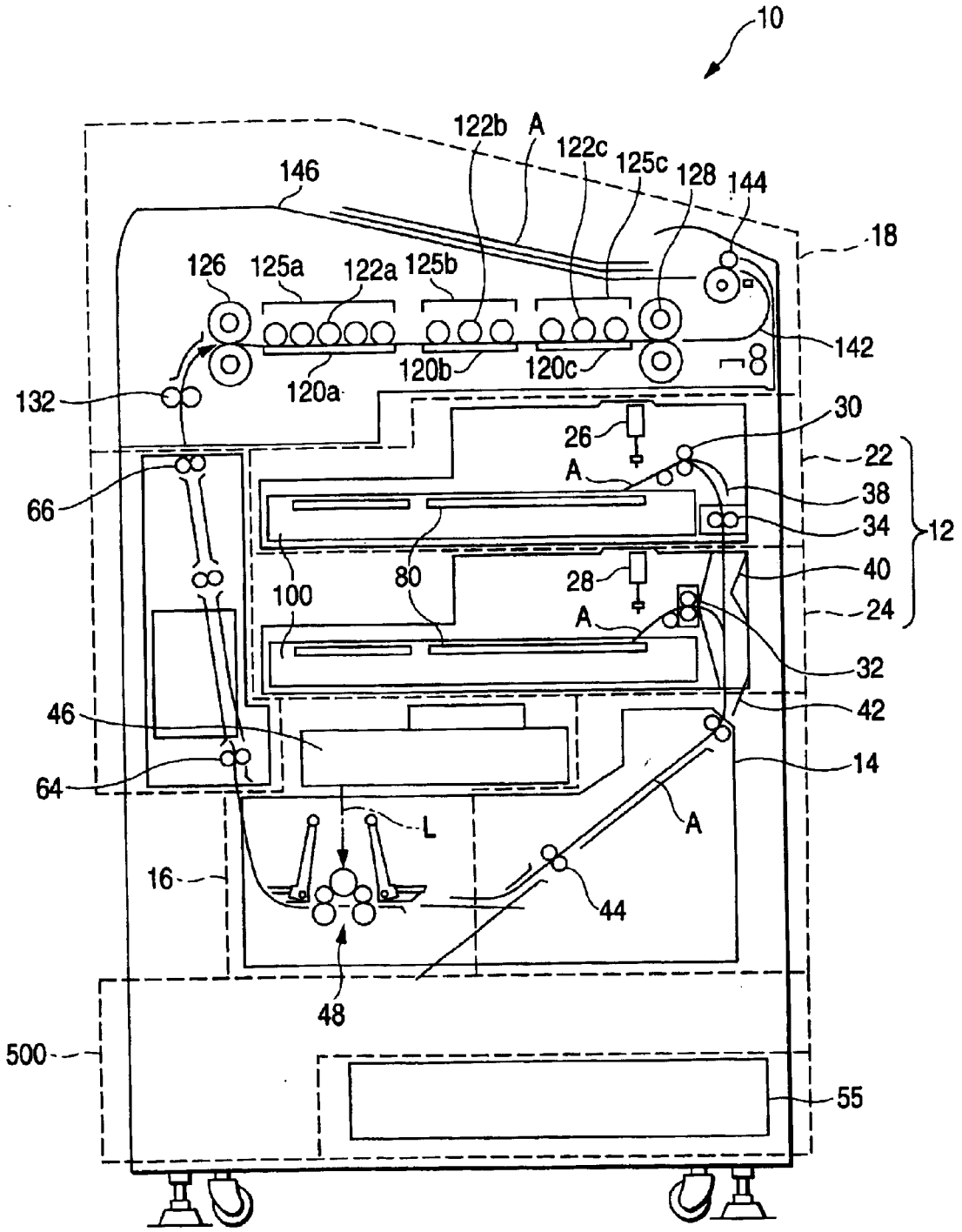

Brief Description of the Drawings:

FIG. 1 is a schematic of an image forming apparatus according to a first embodiment of the invention.

Figure 2:
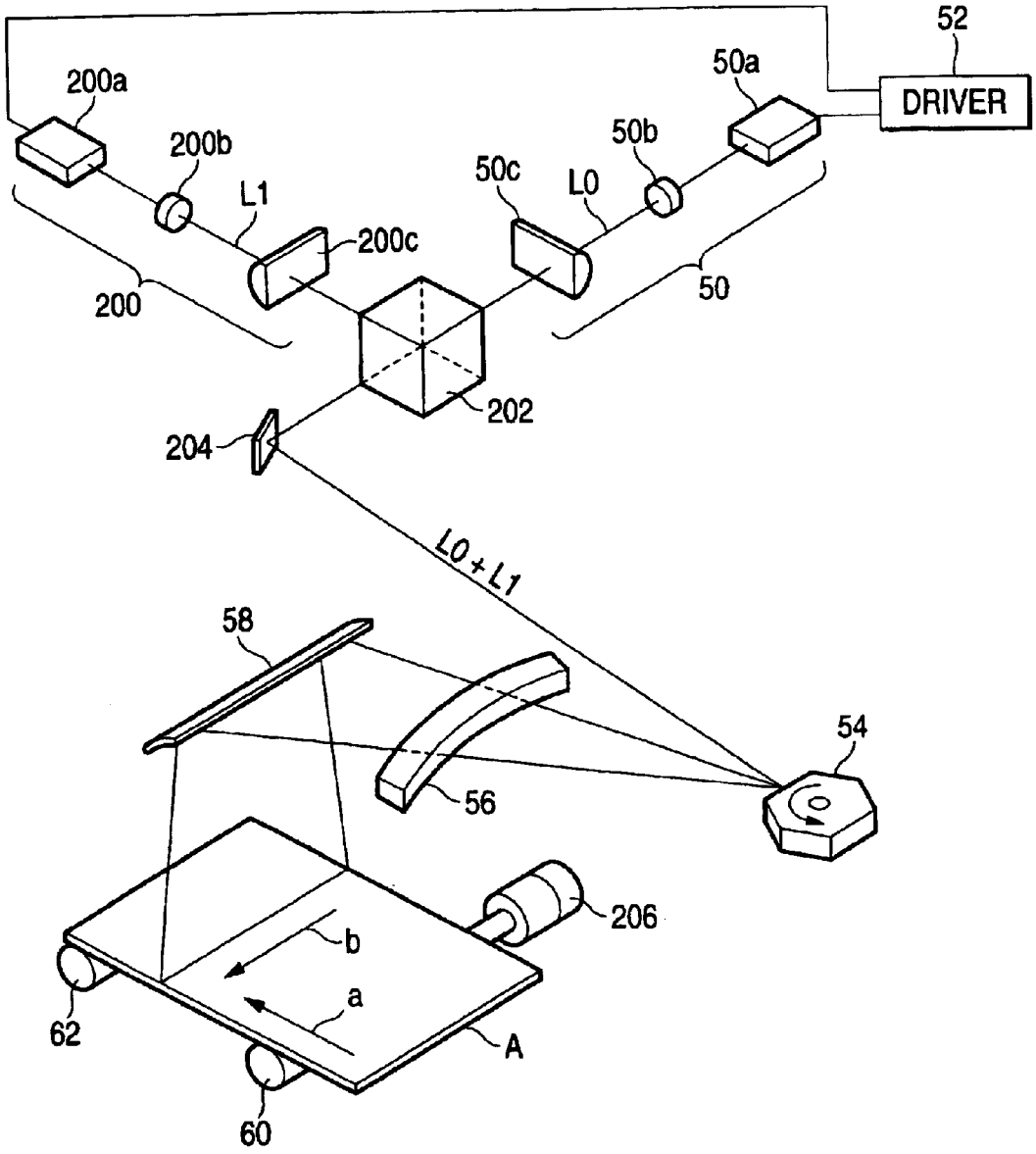

FIG. 2 shows an image exposure section.

Figure 3:
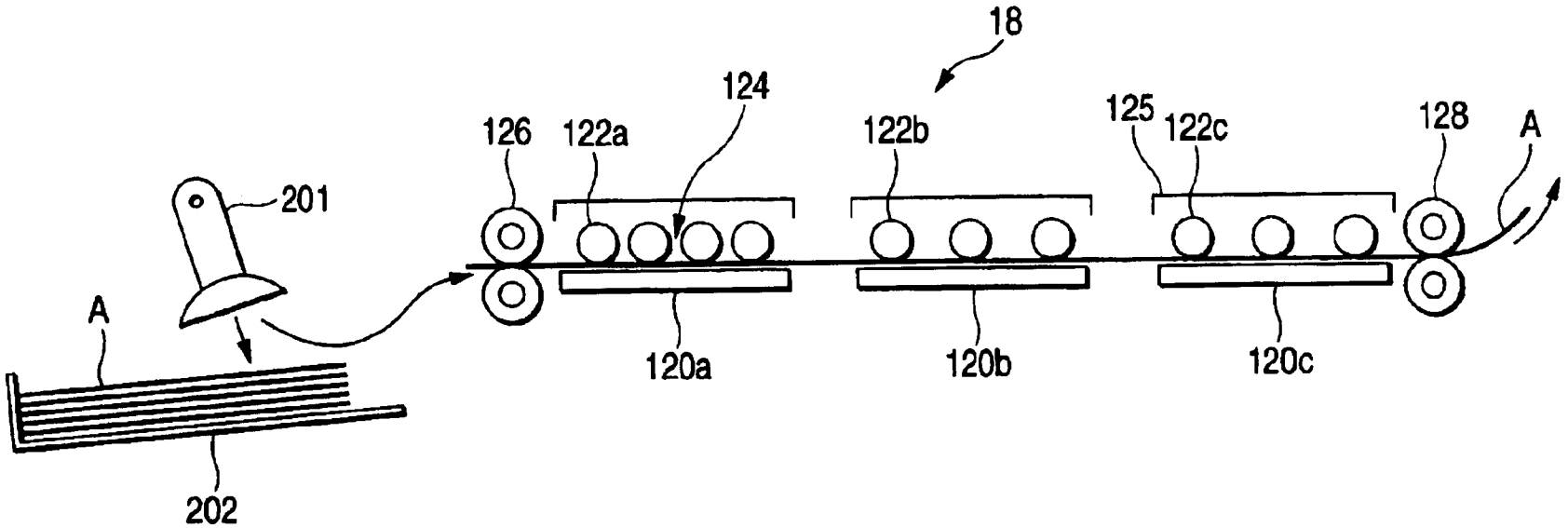

FIG. 3 is a schematic of a heat development section of FIG. 1.

Figure 4:
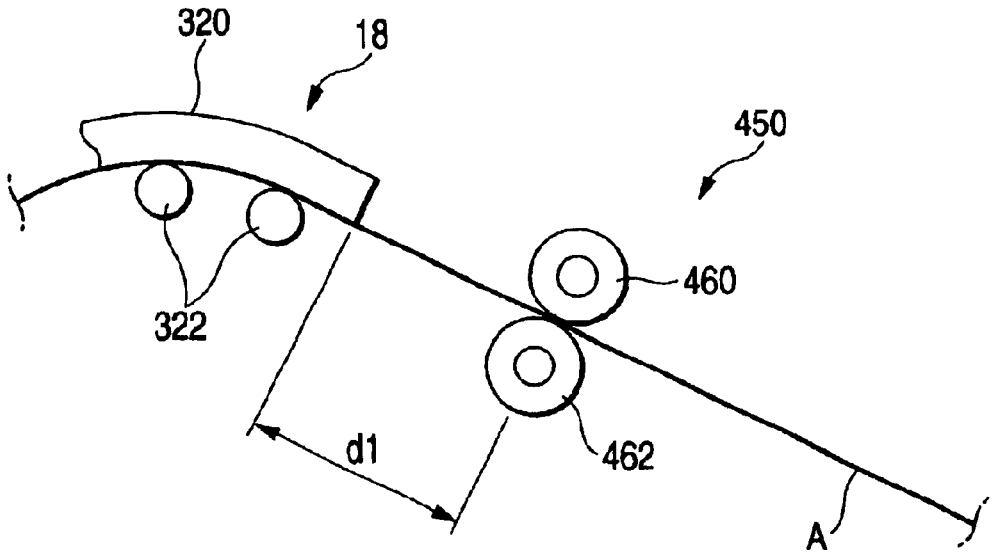

FIG. 4 is a cooling section used in the first embodiment.

FIGS. 5 through 13 show modifications to the cooling section used in the first embodiment.

Figure 14:
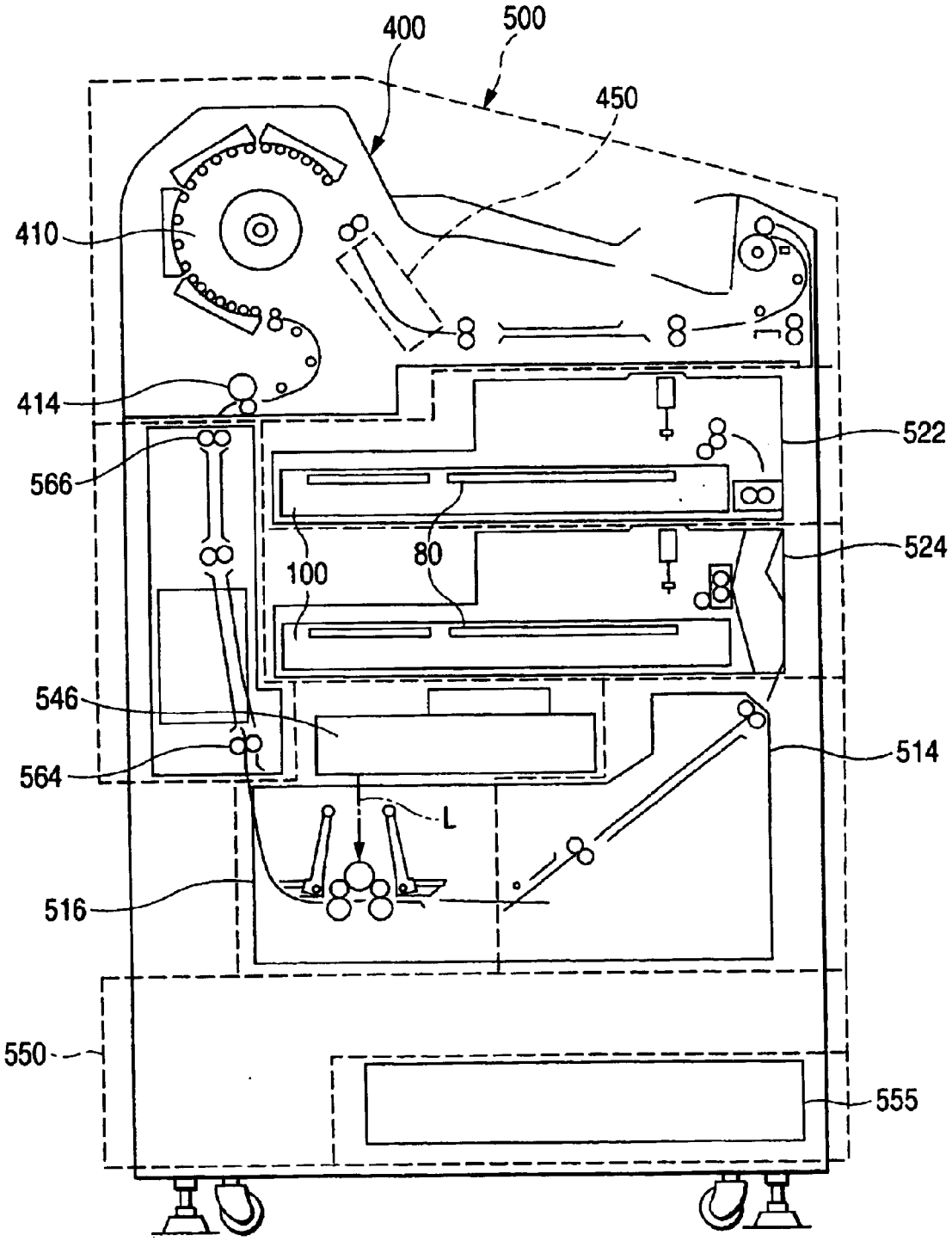

FIG. 14 is a schematic of an image forming apparatus according to a second embodiment of the invention.

Figure 15:
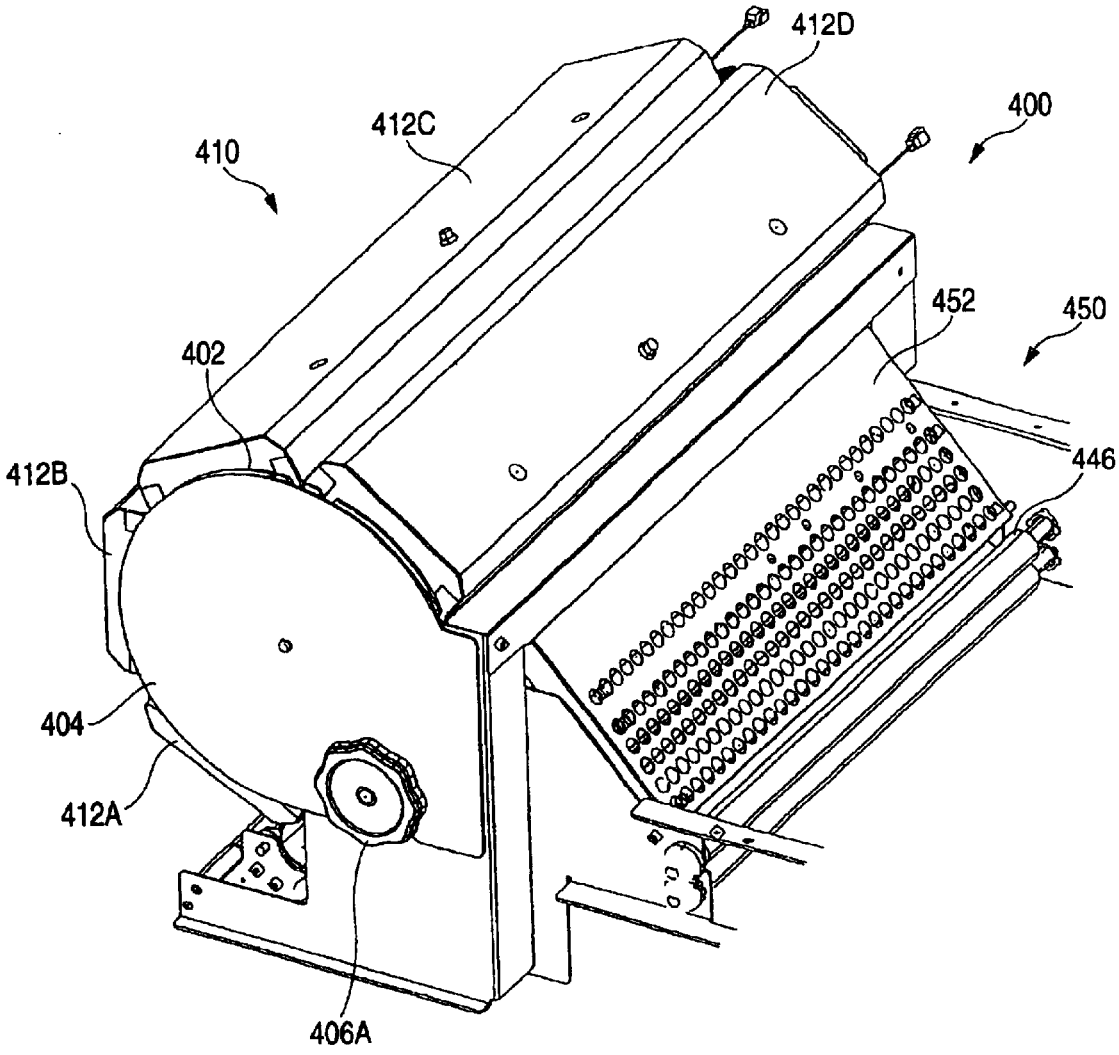

FIG. 15 is a perspective outer view of a heat development section of FIG. 14.

Figure 16:
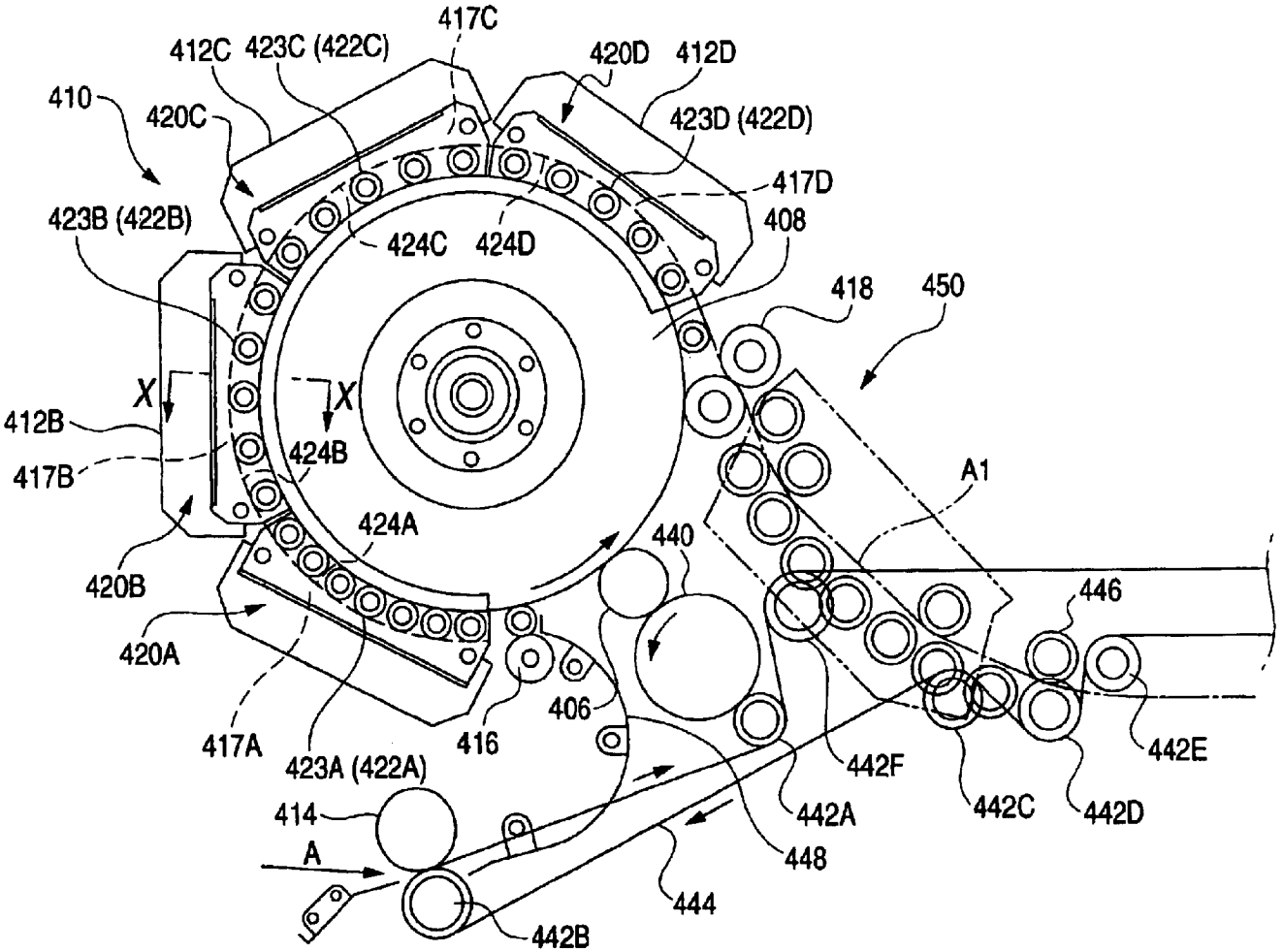

FIG. 16 is the internal structure and the path in the heat development section of FIG. 15.

Figure 17:
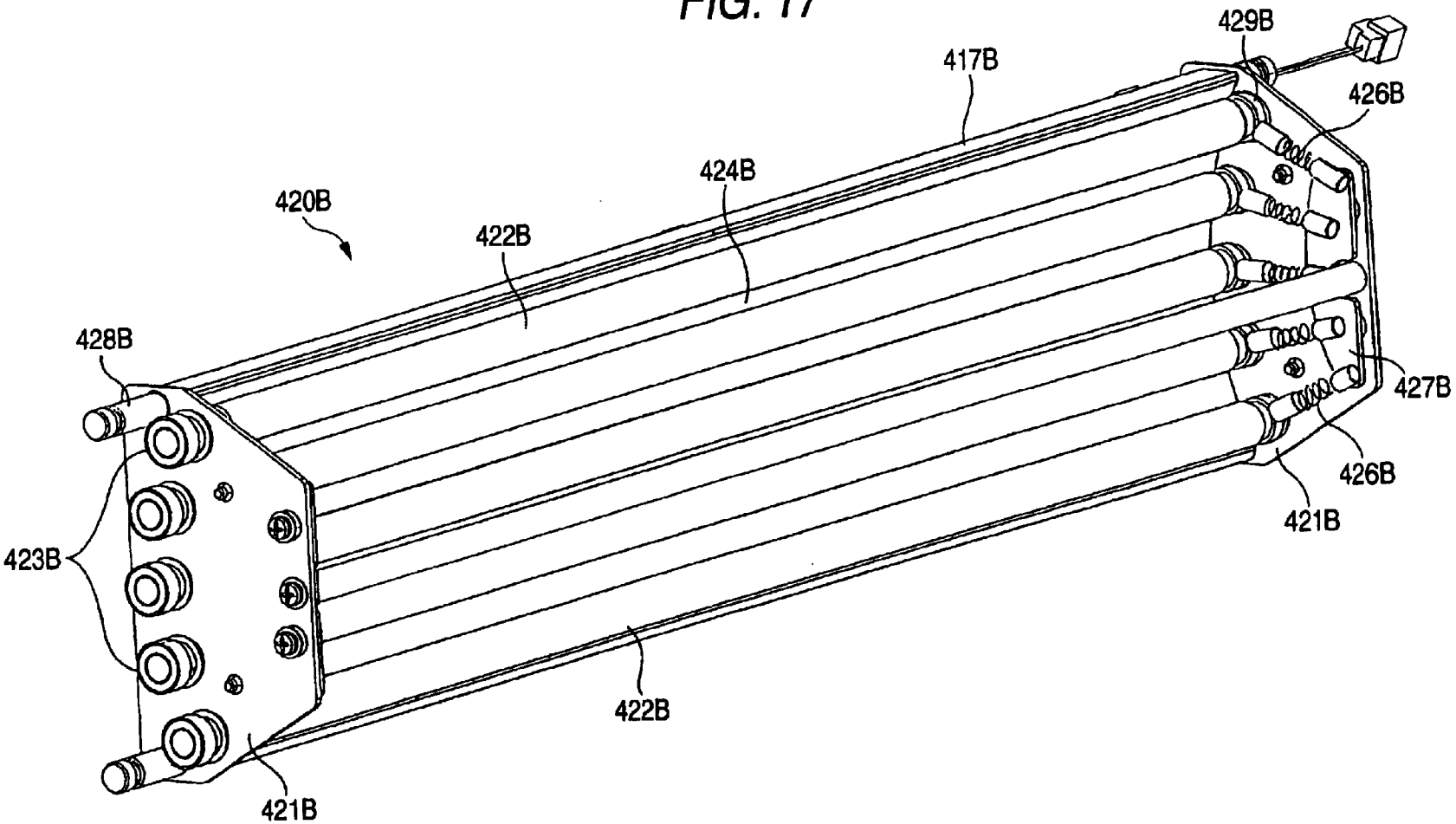

FIG. 17 is a perspective showing the structure of a heating unit of the heat development section of FIG. 15.

Figure 18:
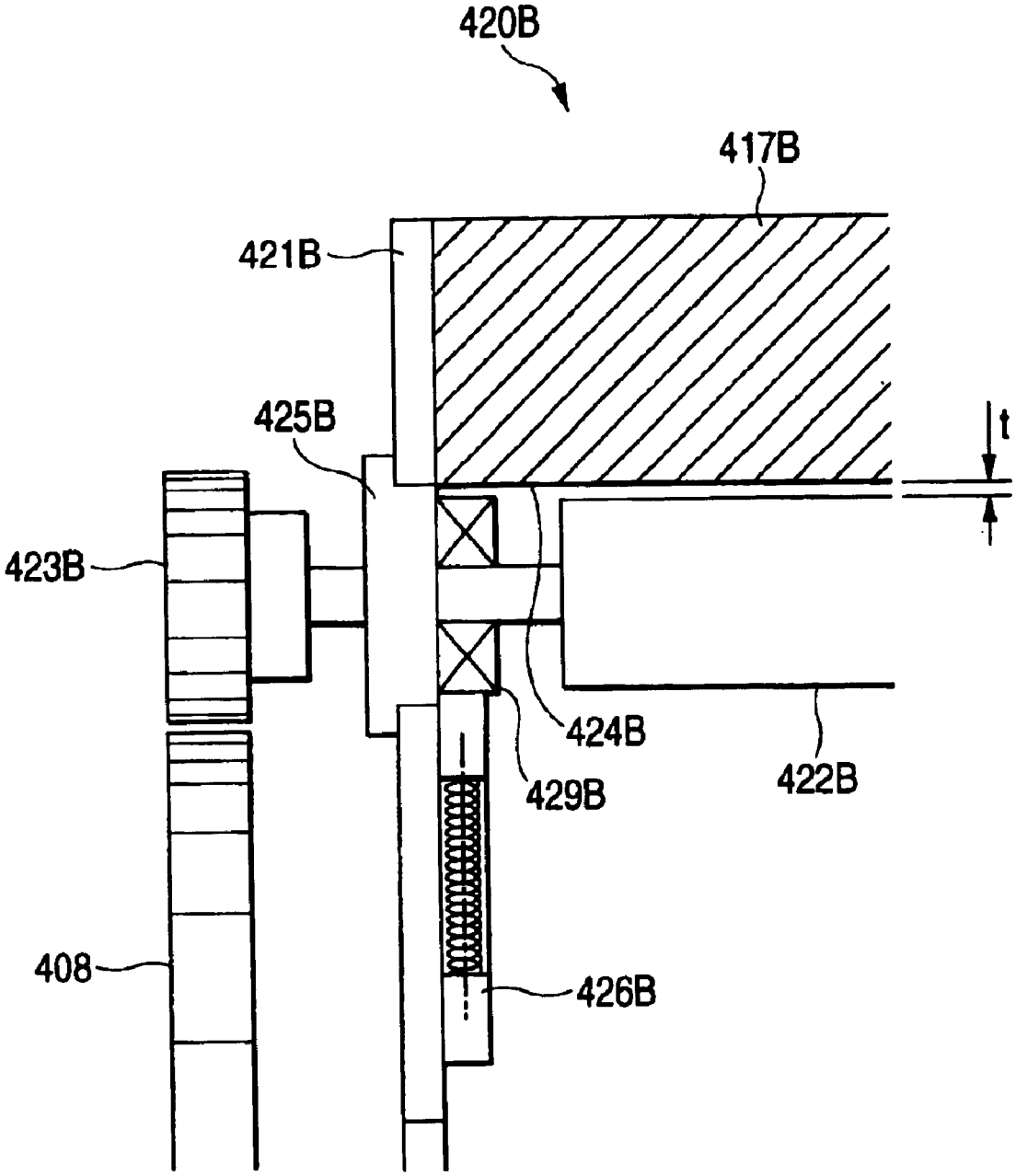

FIG. 18 is a view on arrow X—X of FIG. 16.

Figure 19:
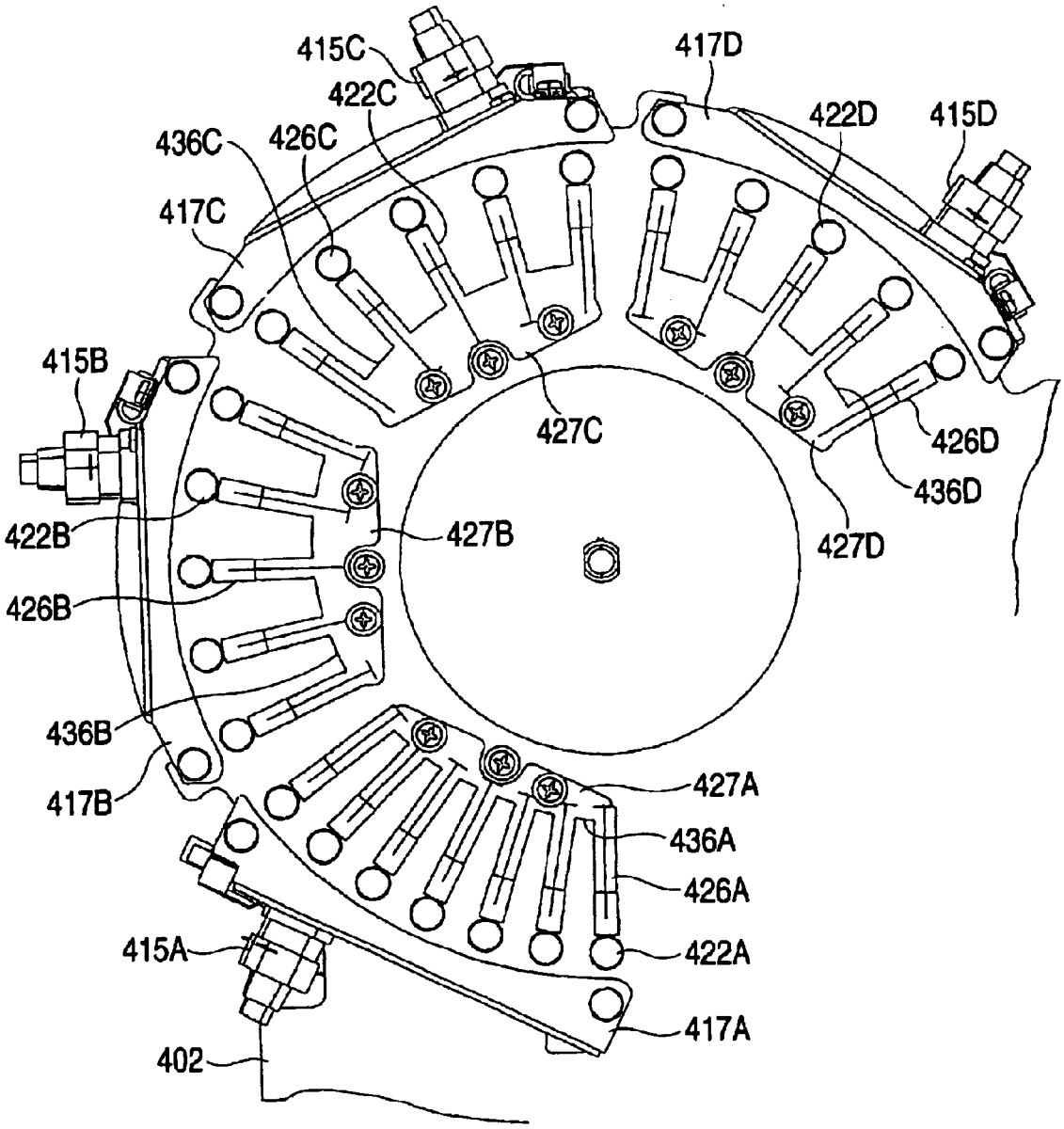

FIG. 19 is a cross-sectional view of the heat treating part of the heating development section shown in FIG. 15.

Figure 20:
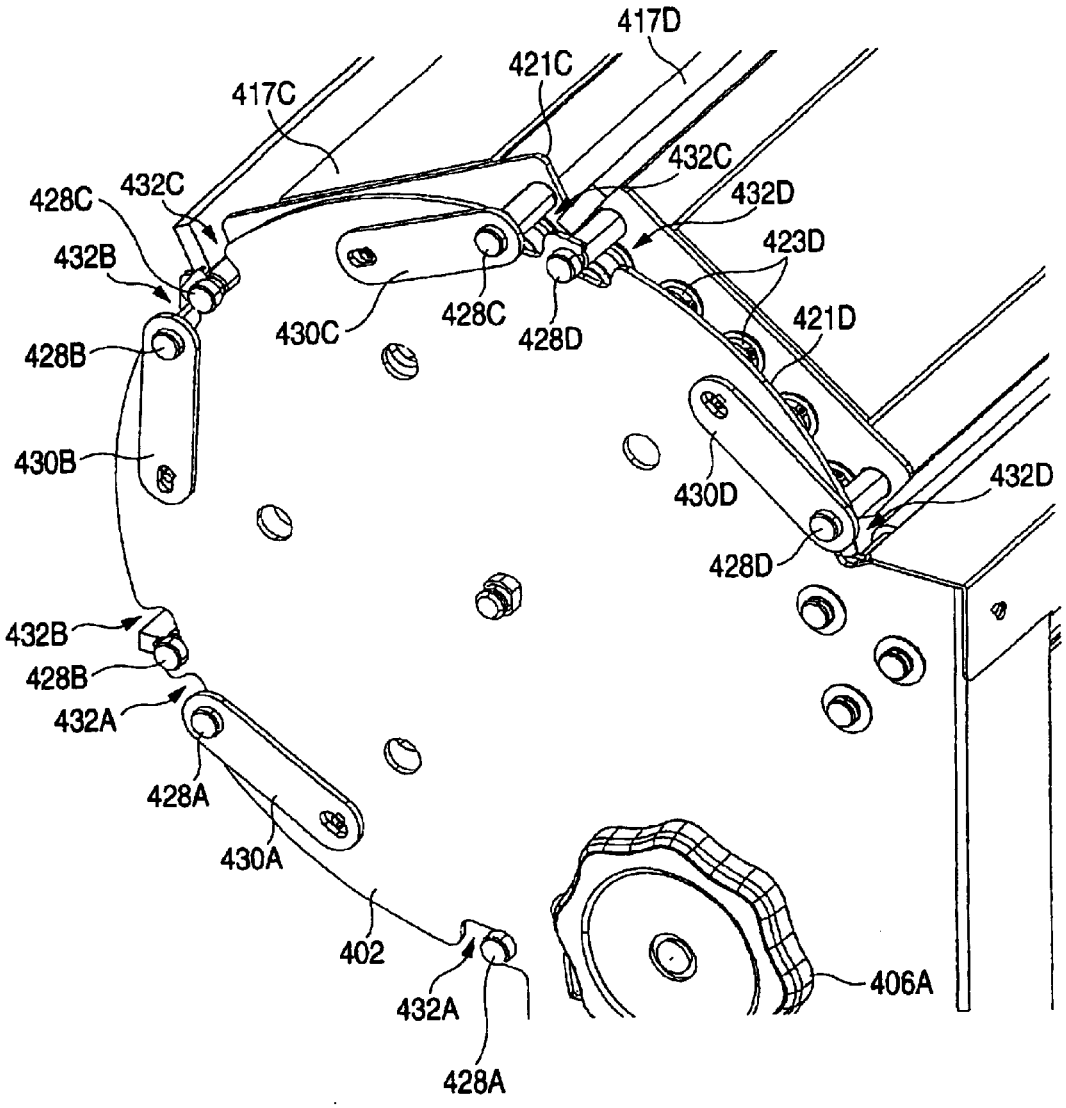

FIG. 20 is a partial perspective of the heat developing part of FIG. 15 with its housing detached.

Figure 21:
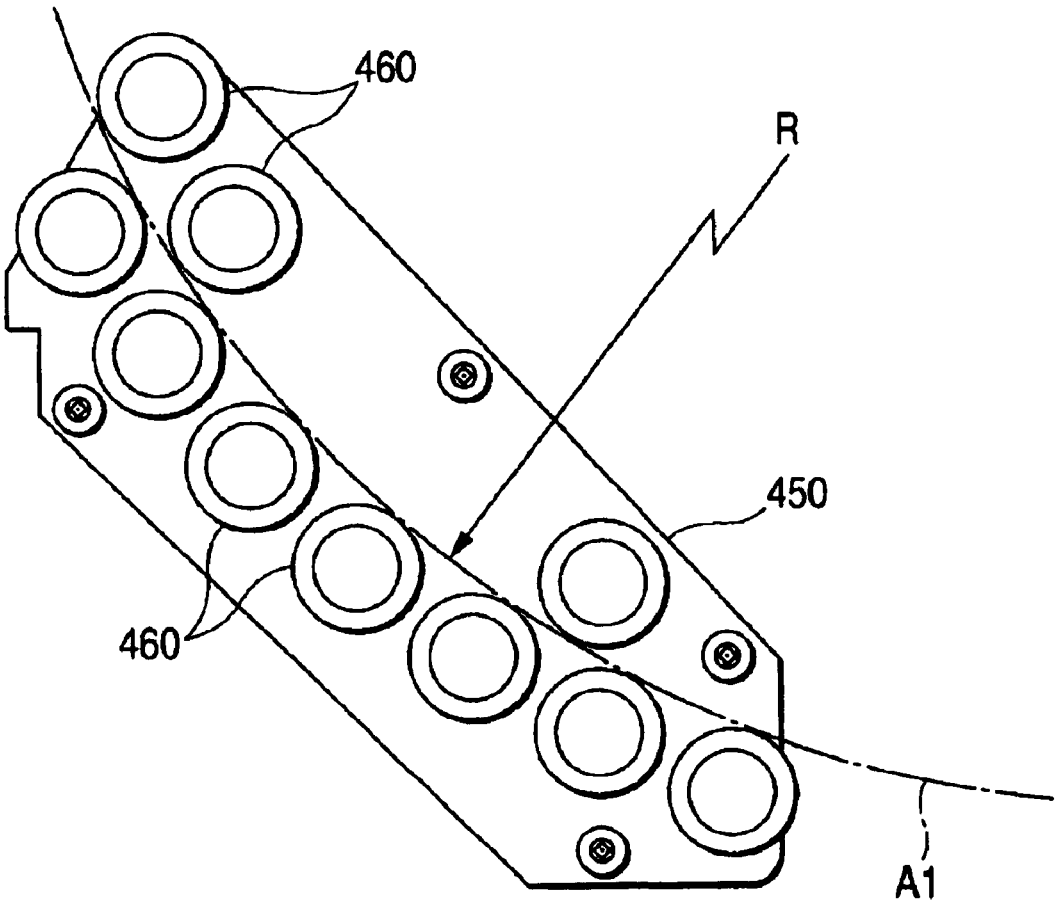

FIG. 21 is an enlarged view of the cooling part of the heat development section shown in FIG. 16.

Figure 22:
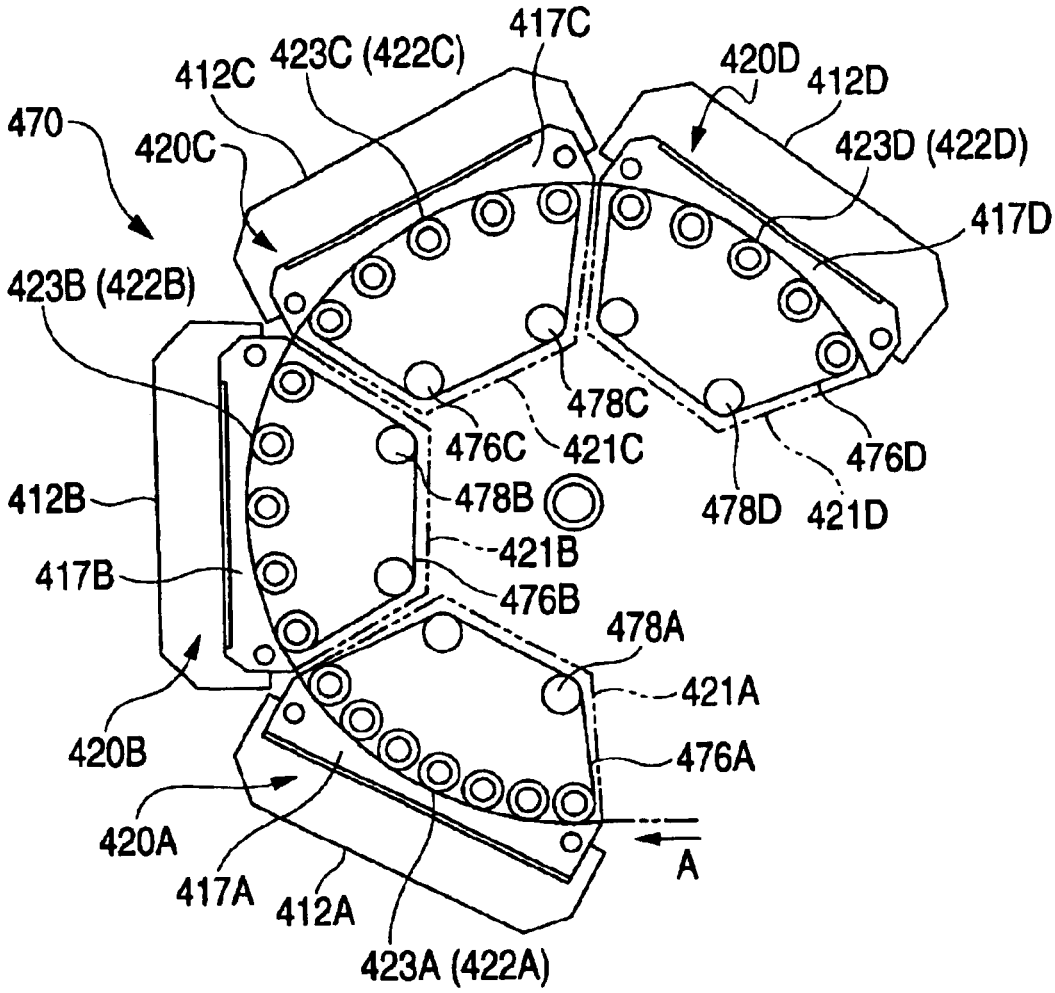

FIG. 22 schematically illustrates the internal structure and the path in another embodiment of the heat treating part shown in FIG. 15.

Figure 23:
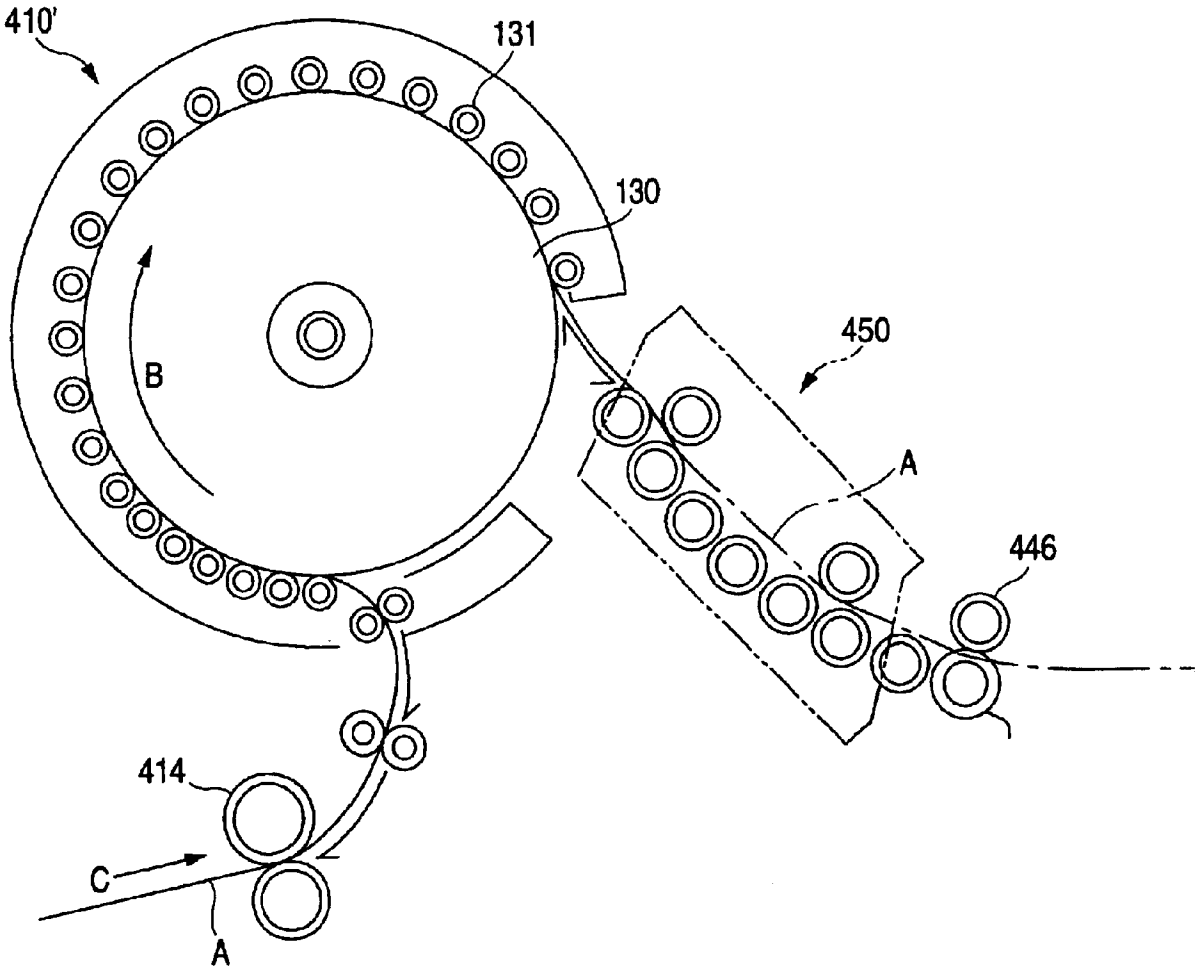

FIG. 23 schematically illustrates a drum type heat development unit.

Figure 24:
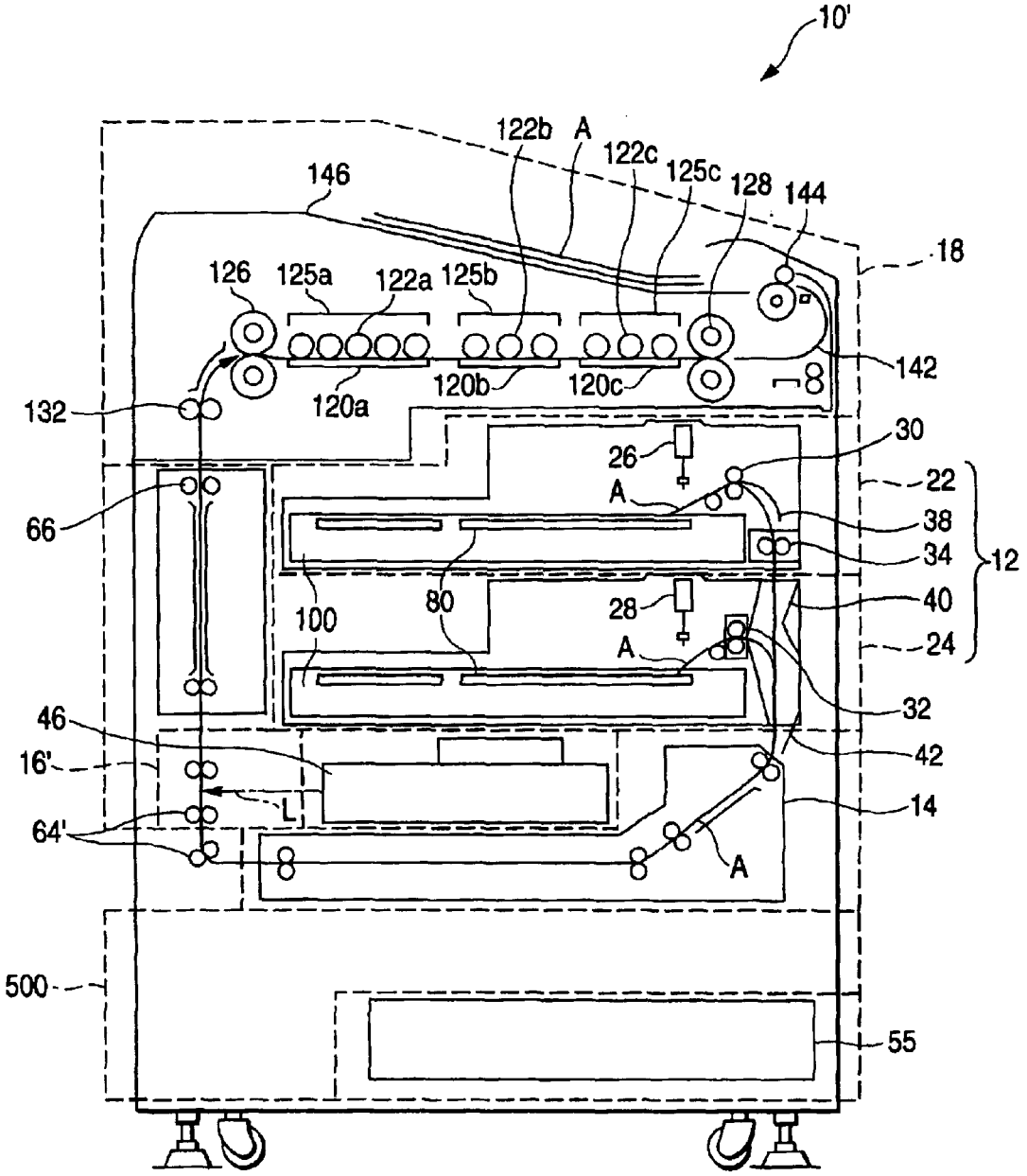

FIG. 24 is a schematic of an image forming apparatus according to a third embodiment of the invention, in which a light-sensitive material is exposed while moving vertically.

Figure 25:
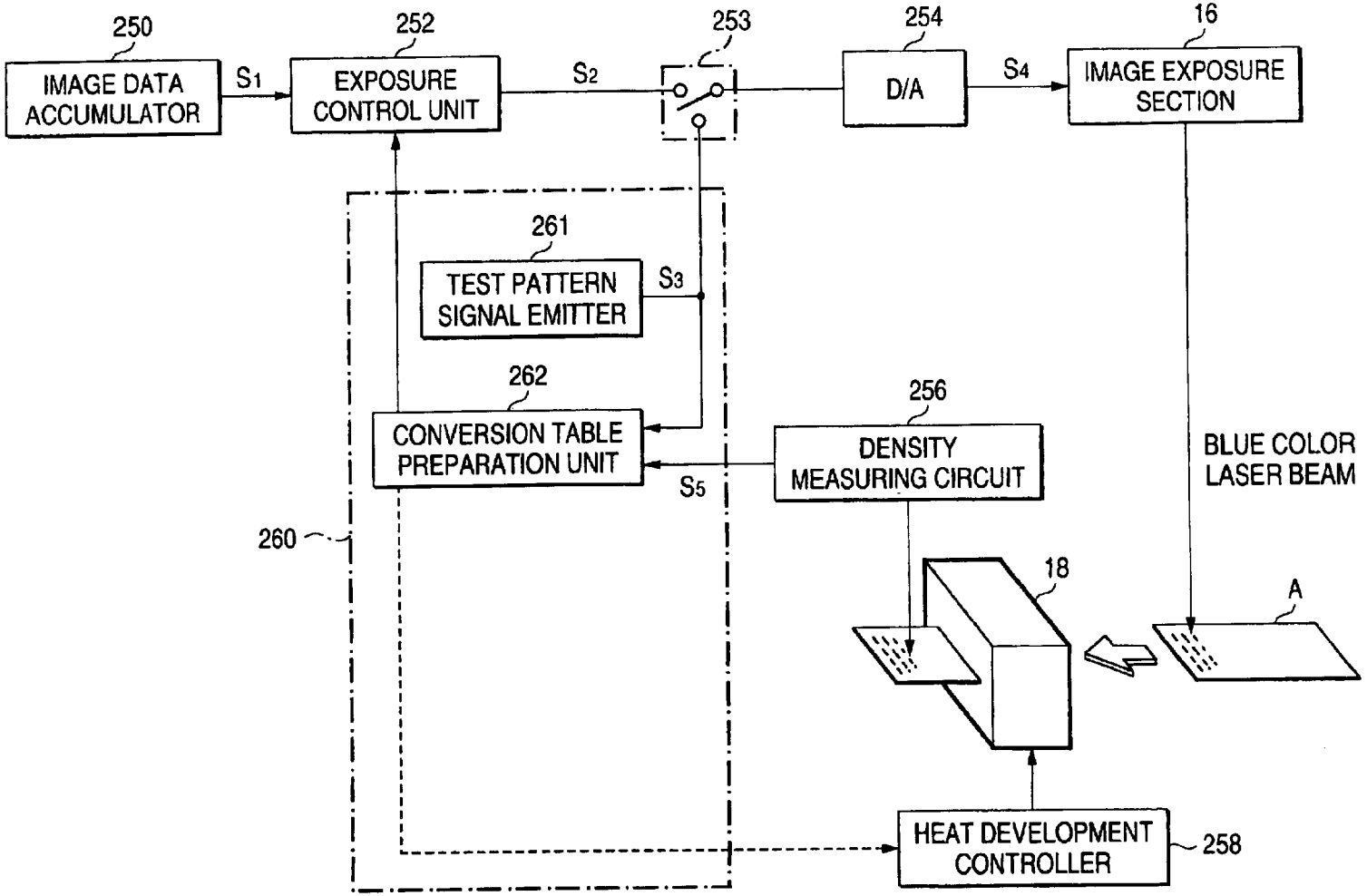

FIG. 25 is a block diagram of an image forming apparatus equipped with a density correction system according to a fourth embodiment of the invention.

Figure 26:
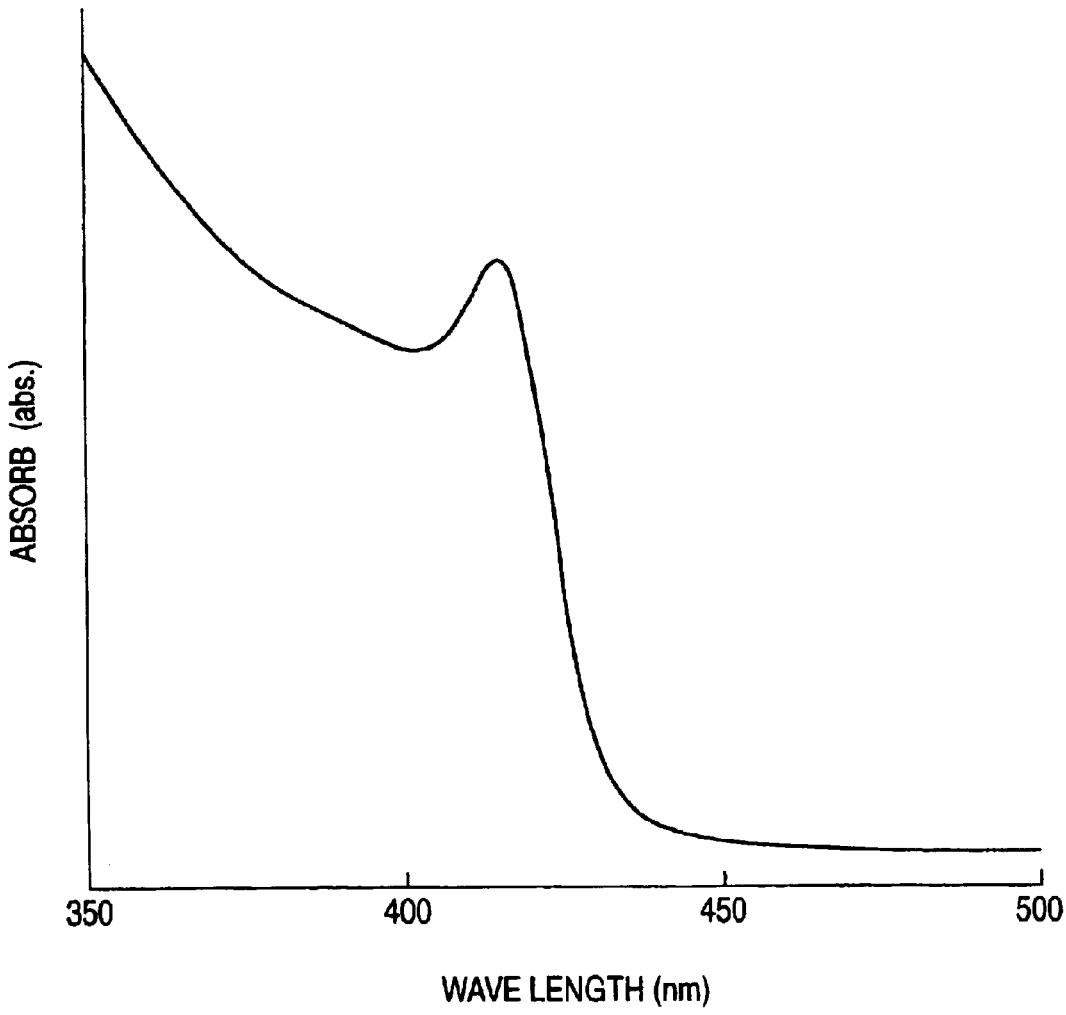

FIG. 26 is an absorption spectrum of a silver iodide emulsion which is preferably used in the present invention.

DESCRIPTION OF THE PREFERRED EMBODIMENTS

The present invention will be described in detail with reference to the accompanying drawings. FIG. 1 is a schematic illustration of an image forming apparatus according to a first embodiment of the present invention. The image forming apparatus 10 shown in FIG. 1 is composed mainly of, in the order of heat-developable light-sensitive material path, a heat-developable light-sensitive material feed section 12, a lateral sheet registration section 14, an image exposure section 16, and a heat development section 18.

The heat-developable light-sensitive material feed section 12 is a section in which a single cut sheet of a heat-developable light-sensitive material (hereinafter referred to as a film A) is picked up from the stack and fed downstream to the lateral sheet registration section 14. The feed section 12 has loading parts 22 and 24, in which are provided film feeders having suckers 26 and 28, feed roller pairs 30 and 32, a delivery roller pair 34, and delivery guides 38, 40, and 42.

A magazine 100 containing a stack of films A is set in a right position in each of the loading parts 22 and 24. The loading parts 22 and 24 are usually loaded with magazines 100 containing films A of different sizes. For example, one of the magazines 100 can contain films A of double-legal size (356 times 432 mm) for CT or MR imaging, and the other of B4 size (275 times 364 mm) for FCR (Fuji Computed Radiography).

The film feeders provided in the loading parts 22 and 24 are designed to suck and hold the film A by the sucker 26 or 28 and to move the sucker 26 or 28 to deliver the film A to the feed roller pair 30 or 32 placed in the loading parts 22 or 24 through a well-known link mechanism.

The film A is imagewise exposed to at least one light beam, e.g., a laser beam, and subjected to heat development to develop a color.

The heat-developable light-sensitive material is usually available in the form of a stack of a prescribed number (e.g., 100) of cut sheets, packaged in a bag or with a band (stack 80 in FIG. 1). The details of the heat-developable light-sensitive material will be described later.

The film A delivered to the feed roller pair 30 or 32 is sent downstream to the lateral sheet registration section 14 through the delivery roller pairs 34 and 36 or the delivery roller pair 36, respectively, while being guided by the delivery guides 38, 40, and 42 or the delivery guides 40 and 42, respectively.

The lateral sheet registration section 14 is designed to position the film A in the direction perpendicular to the running direction (i.e., film width direction) so that the film A may be transported to the downstream image exposure section 16 through the delivery roller pair 44 in good registration with respect to the fast-scan direction in the exposure section 16.

For lateral sheet registration, any known method can be used. For example, a registration plate is used in combination with a means for moving the film A in the width direction while applying pressure so that one lateral edge of the film A may be brought into contact with the registration plate. Or, such a registration plate is combined with a guide plate or a like means which is movable in the width direction of the film A in agreement with the sheet size so that one lateral edge of the film A may be brought into contact with the registration plate.

Thus, the film A is accurately positioned in the width direction in the lateral sheet registration section 14 and then forwarded downstream by the delivery roller pair 44 to the image exposure section 16, where the film A is imagewise exposed by scanning with a light beam.

The image exposure section 16 is composed of an exposure unit 46 and a delivery means 48 for delivering the film A in the slow-scan direction. An example of the image exposure section 16 is depicted in FIG. 2. The image exposure section 16 shown in FIG. 2 has a first laser light source 50 and a second laser light source 200. The first laser light source 50 is made up of a high-output small-sized semiconductor laser 50*a* emitting a first laser beam L0 of a short wavelength of 400 nm, which has been unusable until the emergence of the heat-developable light-sensitive material of the invention, a collimator lens 50*b* which makes light waves travel parallel to each other, and a cylindrical lens 50*c*. The second laser light source 200 comprises a second semiconductor laser 200*a* emitting a second laser beam L1 having a different wavelength from that of the first laser beam L0, a collimator lens 200*b*, and a cylindrical lens 200*c*. The high-output small-sized semiconductor laser 50*a* having a wavelength of 400 nm which can be used includes a blue to purple laser NLHV3000E (available from Nichia Corp.; shortest oscillation wavelength: 395–405 nm; maximum rated output: 35 mW; in continuous-wave operation).

The two beams from the laser light sources 50 and 200 are superposed with the same phase by a polarizing beam splitter cube 202 and directed onto a rotating polygon mirror 54 through a reflection mirror 204. The reflected and polarized beam from the rotating polygon mirror 54 passes through an fθ lens 56 and a cylindrical mirror 58 and scans the film A in the fast-scan direction b.

An fθ lens is a lens specialized for correcting the beam spot diameter and achieving constant velocity scanning in cases where the focus of a polarized beam depicts an arc and therefore the beam varies in spot diameter and scanning speed in planar scanning.

The cylindrical mirror 58 is for correcting instability of slow scanning with the polygon mirror 54. That is, the position of the scanning spot fluctuates in the slow-scan direction a (perpendicular to the fast-scan direction b) due to the fluctuation of the reflecting facet of the polygon mirror 54. Besides, there are inevitable errors of parallelism of each reflecting facet to the rotational axis, which are imputed to limited production precision of the polygon mirror 54. The slow-scan pitch, i.e., the scanning line interval is made instable by these causes.

A driver 52 is driven by a control (not shown) on receipt of image signals, and the polygon mirror 54 and a motor 206 connected to a delivery roller pair 62 are rotated under control. Thus, the laser beam accurately scans the film A in the fast-scan direction b while the film A is moved in the slow-scan direction a by the delivery roller pair 62 driven by the motor 206. As a result, the film A successively forms a latent image with a prescribed outline.

By using the second laser beam perpendicular to the optical axis of the first laser beam and different in wavelength from the first laser beam, an interference fringe which can occur due to reflection of a laser beam in so thin an emulsion layer (hereinafter described) of the film A can be prevented to form a latent image with clear edges on the surface of the film A. Further, by superposing the first laser beam with a second laser beam perpendicular to the optical axis of the first laser beam and having the same wavelength with the first laser beam, the quantity of light can be increased to realize high-output exposure.

The laser output is preferably at least 1 mW (0.1 W/mm$^2$), still preferably 10 mW or higher., particularly preferably 35 mW or higher. While not limiting, the upper limit of the output is about 1 W. Such a high output can be achieved by beam superposition.

While NLHV3000E semiconductor from Nichia Corp. has been recited above as an example of light-emitting sources in the blue to ultraviolet region, other semiconductor laser diodes and other light-emitting sources which emit blue light are usable as well. Other useful light-emitting sources include dye lasers, second harmonic generation (SHG) lasers, YAG lasers, and gas (Ar, Kr) lasers.

The beam size could be converged to the wavelength of the laser light source theoretically. However, the optical pass length increases with a decreasing diameter, making the equipment bigger. From this viewpoint, a suitable beam size is about 20 to 150 $\mu$m in terms of Gaussian beam 1/e$^2$ spot size. With a beam size of 20 $\mu$m, for example, a precise line image with high density and high picture quality can be obtained with a conventional scale of equipment. With a beam size of 150 $\mu$m, the size of equipment can be made smaller while maintaining the image quality level of conventional equipment.

It is desirable that the slow-scan speed be so controlled that one pixel be formed by overlapping a laser beam spot so as to make scanning lines invisible to the naked eye. For example, in forming a 100 $\mu$m size pixel by a laser beam having a Gaussian beam 1/e$^2$ spot size of 100 $\mu$m, it is preferred to form the pixel by exposing four times while moving the spot by 25 $\mu$m in the slow-scan direction to give an integral light energy. As a result, there will be no unexposed area between adjacent pixels in the slow-scan direction to provide a high quality image.

The exposure unit 46 is a known optical beam scanning unit in which a light beam L modulated according to image signals is polarized in the fast-scan direction (i.e., the width direction of the film A) and directed to a prescribed position of the film A. In addition to the above-described members, the exposure unit 46 is fitted with other members commonly used in known light beam scanning units, such as a collimator lens for regulating the beam L emitted from the light source, a beam expander, a polygon mirror scanning error (inclination of reflective facet) correction system, and an optical pass control mirror.

Since the light beam L having a modulated pulse width according to image signals has been polarized in the fast-scan direction as stated above, the film A is two-dimensionally scan-exposed to the beam to record a latent image.

Considering the demands for not only high precision and high density imaging but cost and size reduction, it has come to be difficult to realize cost and size reduction where an optical scanning system is constituted solely of a spherical element and cylindrical element. It is therefore advisable that a polygon mirror scanning error correction system be constructed of a combination of (a) a single lens for making polarized light form an image on a prescribed scanning plane and scan the plane at a constant velocity and (b) a cylindrical mirror having a refracting property only in the direction perpendicular to the fast-scan direction for correcting scanning errors due to inclination of reflective facets, wherein the single lens has a toric surface on at least one side thereof so as to correct the polygon mirror scanning errors in cooperation with the cylindrical mirror and has an aspherical cross-sectional shape across the fast-scan direction. This configuration of laser beam optical scanning system has a minimized number of constituent elements, resulting in minimized equipment cost.

It is also possible to constitute a laser beam optical scanning system of a single free-shaped mirror with a curved surface.

While the embodiment described adopts direct modulation comprising sending image signals directly to the semiconductor laser to form a gray scale latent image, the present invention is also applicable to indirect modulation comprising modulating laser beams by an external modulator such as an acoustic optical modulator (AOM) to form a gray scale image on the heat-developable light-sensitive material.

Back to FIG. 1, the film A having formed thereon a latent image in the image exposure section 16 is transported to the heat development section 18 by delivery rollers 64, 66, etc. Before entering the heat development section 18 the film A passes through dust removing rollers 132 to be cleared of foreign matter on both sides thereof. The dust removing rollers may be disposed in front of the exposure section 16.

FIG. 3 schematically illustrates the structure of the heat development section 18 used in the image forming apparatus according to the first embodiment. The heat development section 18, designed to heat a light-sensitive material of the type that is to be heat treated, comprises three plate heaters 120*a*, 120*b*, and 120*c* which are arranged in series in the moving direction of the film A and are capable of elevating their temperature to processing temperatures for the film A, a delivering means 126 for sliding the film A downstream on each of the plate heaters 120*a*, 120*b*, and 120*c*, and press rollers 122*a*, 122*b*, and 122*c* which press down the other side of the film A onto the plate heaters 120*a*, 120*b*, and 120*c*, respectively, for assuring heat conduction from the respective plate heaters to the film A.

In this embodiment each plate heater 120*a*, 120*b* or 120*c* is a flat heating member having inside at least one heating means (e.g., nichrome wire) laid flat to keep the heating member at a film A developing temperature. The plate heaters may be each composed of a mere heat conductor on the surface coming into contact with the film A and a rubber heater attached to the reverse side of the heat conductor. Otherwise the heat conductor may by heated with hot air or a lamp. The temperatures of the heating means are preferably controlled individually.

The lengths of the plate heaters 120*a*, 120*b*, and 120*c* do not always need to be equal and can be varied according to the heat treatment conditions. The plate heaters are preferably spaced at an interval of 50 mm or less. Too long a distance between plate heaters results in poor heat supply efficiency to the film A.

It is advisable to take a measure for protecting the film A against scratches while sliding on the plate heaters by, for example, making the surface of the plate heaters of a fluorocarbon resin or coating the surface of the plate heaters with a fluorocarbon resin. It is also effective to make the surface portion of the plate heaters of heat-conducting rubber and to coat that surface portion with a fluorocarbon resin layer. In this case, even if foreign matter enters between the film A and the plate heaters, the rubber elasticity prevents the foreign matter from causing image missing or scratching the surface of the film A, and the fluorocarbon resin layer assures slip of the film A.

Since more heat is needed in the upstream half of the heat development section 18 for heating the film A, it is desirable to supply more heat to the plate heater 120*a*, which is the nearest to the inlet of the heat development section 18. It is preferred for the plate heater 120*a* to have a larger heat capacity than the downstream plate heaters 120*b* and 120*c* so as to minimize temperature variation from place to place.

The plate heaters 120*a*, 120*b*, and 120*c* should be equipped with the respective temperature sensors for controlling the temperature of the film A at a set temperature. Each temperature sensor is preferably provided at the downstream end of each plate heater because the heater's temperature is higher and more stable in its downstream portion than in the upstream portion.

The scan-exposed films A stacked in a tray 202 is picked up one by one by a sucker 201, guided into the heat development section 18 by a roller pair 126 driven by a driving motor (not shown), and heat-processed while sliding between the press rollers 122*a*, 122*b*, and 122*c* and the facing plate heaters 120*a*, 120*b*, and 120*c*. The heat-processed film A is discharged through a guide roller pair 128.

In order to minimize damages, such as scratches, to the image, it is advisable to avoid contact of the image-forming layer side with the plate heaters. Where the film A is of the type that observation is important, it is preferable to avoid contact of the side to be observed with the plate heaters.

A plurality of press rolls 122*a*, 122*b* or 122*c* are provided per facing plate heater 120*a*, 120*b* or 120*c*, respectively. They are arranged either in contact with or above the plate heaters with a gap not more than the thickness of the film A at a pitch predetermined for the respective plate heaters over the whole length of the respective plate heaters.

The film A is preferably pressed down at more positions at a smaller pitch when it is in contact with the plate heater nearest to the inlet of the heat development section 18 than with the other plate heaters. This makes sure of holding down the film A in the temperature rising zone thereby to prevent buckling and temperature unevenness of the film A. In this particular embodiment shown in FIG. 3, in which there are press rollers 122*a*, 122*b*, and 122*c*, the plate heater 120*a* has more press rollers at a smaller pitch than the plate heaters 120*b* and 120*c*.

The press rollers 122*a*, 122*b*, and 122*c* may be driven by the respective driving systems but are preferably driven by a common driving system for cost and space saving. All the press rollers 122 are preferably driven at the same peripheral speed for stably conveying the film A. The peripheral speed is dependent on the heat treating capacity.

The press rollers 122*a*, 122*b*, and 122*c* and the plate heaters 120*a*, 120*b*, and 120*c* provide a path 124 for the film A. With the gap between the press rollers and the plate heaters in the path 124 being not more than the thickness of the film A, the film A can be caught and slid smoothly therebetween without being buckled or bundled. At the upstream and downstream ends of the film A path 124 are provided the roller pair 126 as a means for delivering the film A and the discharge roller pair 128, respectively.

The press rollers which can be used include metal rollers, resin rollers, and rubber rollers. Those having a heat conductivity of 0.1 to 200 W/m/° C. are suited. It is preferred to provide hoods 125*a*, 125*b*, and 125*c* over the press rollers 122*a*, 122*b*, and 122*c*, respectively, for keeping the temperature.

When the leading end of the moving film A meets the press roller 122*a*, 122*b* or 122*c*, it stops a moment. Where all the press rollers 122*a*, 122*b*, and 122*c* are spaced out equally, the same part of the film A would stop each time it comes into contact with one of the press rollers and be kept under pressure for a longer time than the other parts. As a result, the film A could undergo non-uniform heat treatment and suffer from streaky marks over its width. To avoid this, it is preferred that the press rollers 122*a*, 122*b*, and 122*c* be arranged at different pitches.

The means for delivering the film A in the heat development section 18 is the pair of rollers 126 provided right in front of the plate heaters 120*a*, 120*b*, and 120*c* and near the most upstream press roller 122*a*. The discharge roller pair 128 can also have a driving force to serve as a delivering means. The film A delivering means is not limited to the rollers 126 and 128. In other words, the press rollers 122 can function as a delivering means, or a separate delivering unit (not shown) may be provided at the inlet or the outlet of the heating zone.

It is preferred for the film A to be preheated to a temperature at or below the developing temperature before it reaches the heat development section 18 thereby reducing non-uniformity of development.

The film A discharged from the developing section 18 is guided by a guide plate 142 and delivered to a receiving tray 146 through discharge rollers 144. The image forming apparatus 10 has a power section 55 for driving the above-mentioned sections and a control section 500 in the lower part thereof The heat development section 18 having a high heating temperature, it is demanded to minimize the consumption power in ordinary operation. It is an effective strategy for realizing energy saving that the heater temperature is monitored and electricity is applied to at least one heating means of the heaters within an allowable power in the order from a heater having a largest difference between a set temperature and the monitored temperature. It is also demanded to shorten the rise time of the heat development section 18 for improving the processing speed. To achieve this, the plate heaters 120*a*, 120*b*, and 120*c* desirably have the same ratio of electrical capacity of the respective heating means to heat capacity of their own.

The film A coming out of the heat development section 18 may be passed through a cooling section shown in FIGS. 4 to 13 before it is guided by the guide plate 142 and delivered to the receiving tray 146 by the discharge rollers 144. In FIG. 4, the film A heat-developed in the heat development section 18 is passed through a cooling section 450 where it is cooled through heat exchange. The cooling section 450 of FIG. 4 has a pair of metal rollers 460 and 462 through which the film A is cooled to or below a development stopping temperature. Upon cooling the film A, which usually has a temperature of about 100 to 150° C. immediately after heat development, to, e.g., about 70 to 110° C., the developing reaction that has been taking place inside the film A is stopped to provide an image stably without undergoing the influences of external temperature.

It is desirable that the distance d1 between the downstream end of the heat development section 18 and the line passing through the centers of the metal rollers 460 and 462 be short enough to reduce the influence of the temperature in the image forming apparatus 10. An advisable distance d1 is in a range of about 20 to 100 mm. The running speed of the film A is selected appropriately depending on the processing throughput per unit time, the length of the heat development section 18, and the like factors. As an example, it is suitably selected from a range 10 to 50 mm per second. Taking the running speed range into consideration, the rollers 460 and 462 suitably have a diameter of 15 to 30 mm.

In the cooling section 450 of FIG. 4, the heat-treated film A is cooled down while conveyed between a pair of rollers 460 and 462 both made of metal. Having good heat conduction characteristics and coming into contact with the whole width of the running film A, the metallic rollers absorb the heat of the film A efficiently and cool the running film A to or below the development stopping temperature effectively. However, where the rollers 460 and 462 are both made of metal, cases are sometimes met with in which foreign matter such as dust is trapped therebetween, which can cause streaky marks on the resulting image due to density unevenness.

Figure 5:
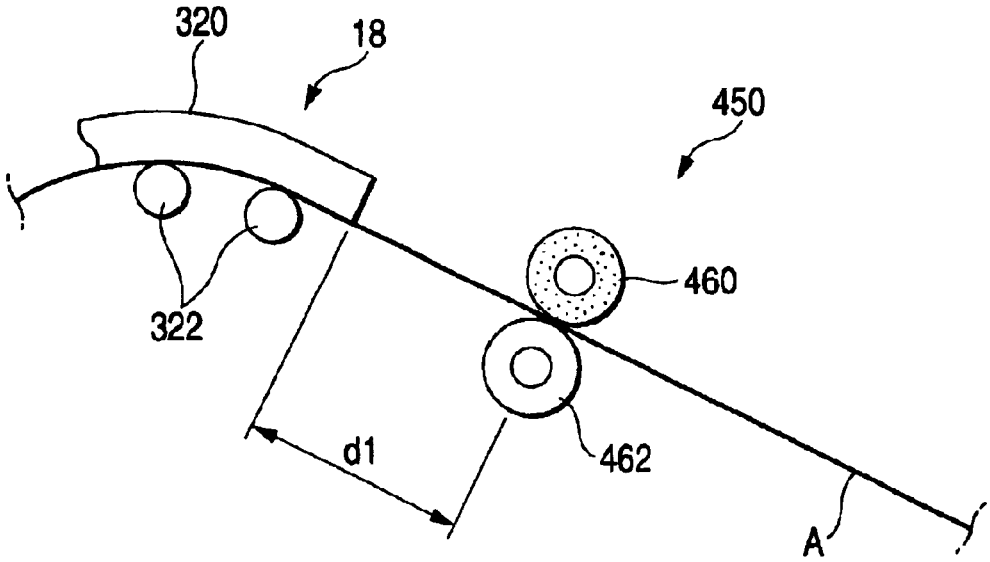

To eliminate such a disadvantage, one of the rollers, e.g., the roller 460 can be replaced with an elastic roller, such as a rubber roller or a sponge roller, as shown in FIG. 5. According to this modification, foreign matter, if any, would pass between the rollers 460 and 462 and would not cause streaky density unevenness.

A pair of metallic rollers has another problem that vapor of fat and oil components which generates from the film A in heat development can adhere to the metallic rollers and cause streaky marks on the image. With one of the rollers being made of an elastic material as in FIG. 5, the elastic roller 460 acts as a cleaning roller for the mating metallic roller 462. The fat and oil components clinging to the metallic roller 462 can be removed by the elastic roller 460 while there is no film A running therebetween. As a result, the metallic roller 462 will not leave streaky marks any more. The elastic roller 460 may have an elastic surface layer that can be detached when necessary. The pair of rollers 460 and 462 may be either drive rollers or nondrive rollers.

Figure 6:
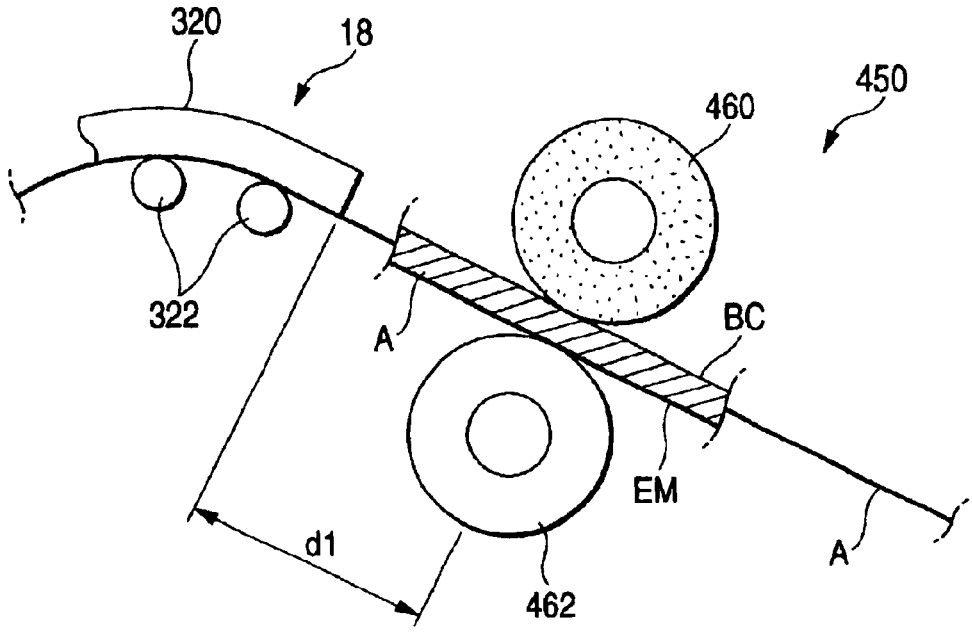

FIG. 6 shows the same modification as in FIG. 5 with part of the film A enlarged. It is desirable that the light-sensitive layer (hereinafter sometimes referred to as an Em layer) side be in contact with the metallic roller 462 with the other side, i.e., the backcoat side (hereinafter referred to as BC side) in contact with the elastic roller 460. In this configuration, the film A can be cooled to or below the development stopping temperature in a shorter time. Similarly to the embodiment shown in FIG. 4, it is desirable that the distance d1 between the downstream end of the heat development section 18 and the line passing through the centers of the rollers 460 and 462 be short enough to reduce the influence of the temperature in the image forming apparatus 10. An advisable distance d1 is in a range of about 20 to 100 mm. The running speed of the film A is selected appropriately depending on the processing throughput per unit time, the length of the heat development section 18, and the like factors. As an example, it is suitably selected from a range 10 to 50 mm/sec. Taking the running speed range into consideration, the rollers 460 and 462 suitably have a diameter of 15 to 30 mm.

Figure 7:
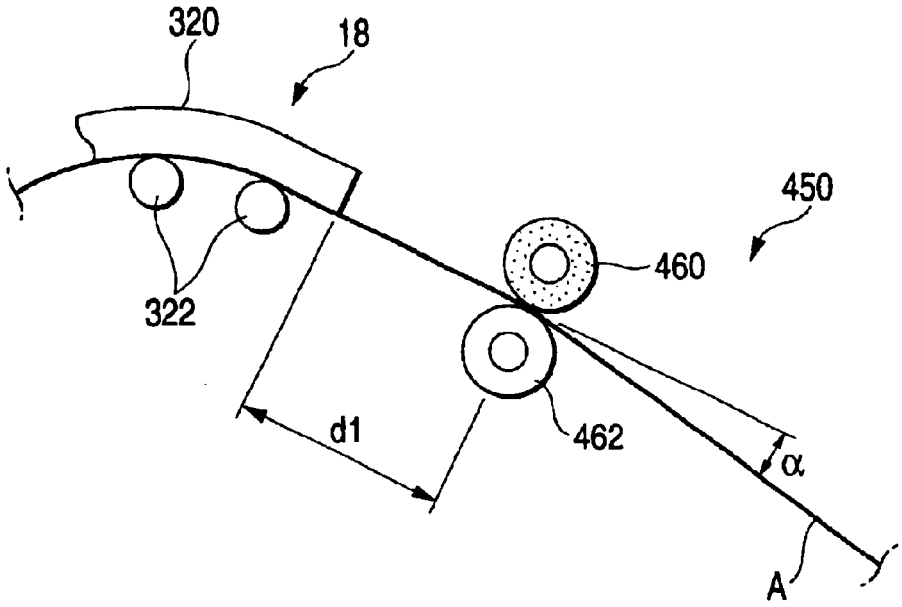

Other modifications of the cooling section 450 are shown in FIGS. 7 through 13. The cooling section 450 shown in FIG. 7 is designed to shorten the cooling time by making a lap angle $\alpha$ for delivering the film A downstream from the roller pair 460 and 462. By this lap angle $\alpha$, the contact length of the film A with the metallic roller 462 increases to produce a greater cooling effect. It should be noted that too great a lap angle $\alpha$ results in excessive quenching, which can cause curling or wrinkling to impair the flatness of the film A. A preferred range of the lap angle $\alpha$ is from 0 up to 5°.

Figure 8:
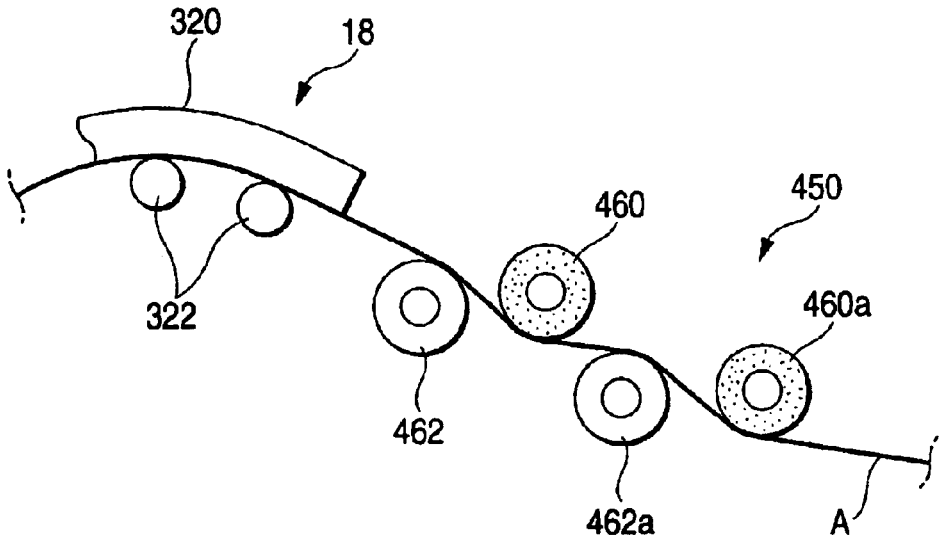

The cooling section 450 shown in FIG. 8 has a plurality of alternate rollers 462, 460, 462*a*, and 460*a* spaced singly at intervals along each side of the running film A. The additional rollers 460*a* and 462*a* can be made of metal, rubber or resins. In this alternate roller arrangement, since the film A is in contact with each of the rollers 462, 460, 462*a*, and 460*a* for an increased contact time by the lap angle to receive enhanced cooling effect, and because the film A zigzags at the opposite lap angles, it hardly suffers from curling or wrinkling which impairs the flatness.

Figure 9:
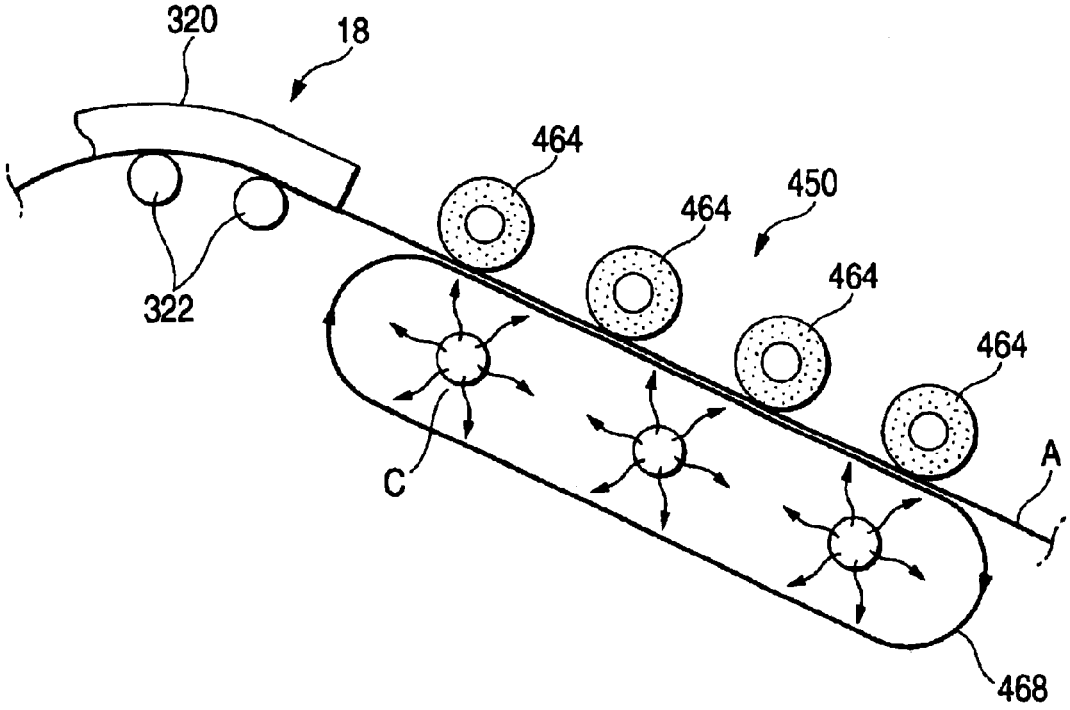

The cooling section 450 shown in FIG. 9 comprises an endless belt 468 (in place of the rollers 462) and press rollers 464 for pressing the film A onto the endless belt 468. The endless belt 468 is made, e.g., of heat conductive metal, elastic rubber or resins, etc. The turning speed of the belt 468 may be the same or different from the speed of the film A being delivered to the cooling section. The press rollers 464 combined with a metallic endless belt 468 are preferably made of elastic rubber or resins and those combined with a rubber or resin endless belt 468 are preferably made of heat conductive metal. Where the endless belt 468 is made of metal, it is cooled by air cooling units C, such as cooling fans. The film A is thus conveyed while being pressed to the endless belt 468 by the press rollers 464 and cooled.

According to the structure of FIG. 9, the film A is kept in contact with the endless belt 468 to receive a sufficient cooling effect. By cooling the turning belt 468, the part of the belt with which the film A meets first is kept at a constant temperature, and the film A can be cooled stably under a constant condition. Further, the endless belt 468 is cleaned by the rollers 464 in the absence of the film A thereby to reduce the adverse influences of the above-mentioned fat and oil components.

Figure 10:
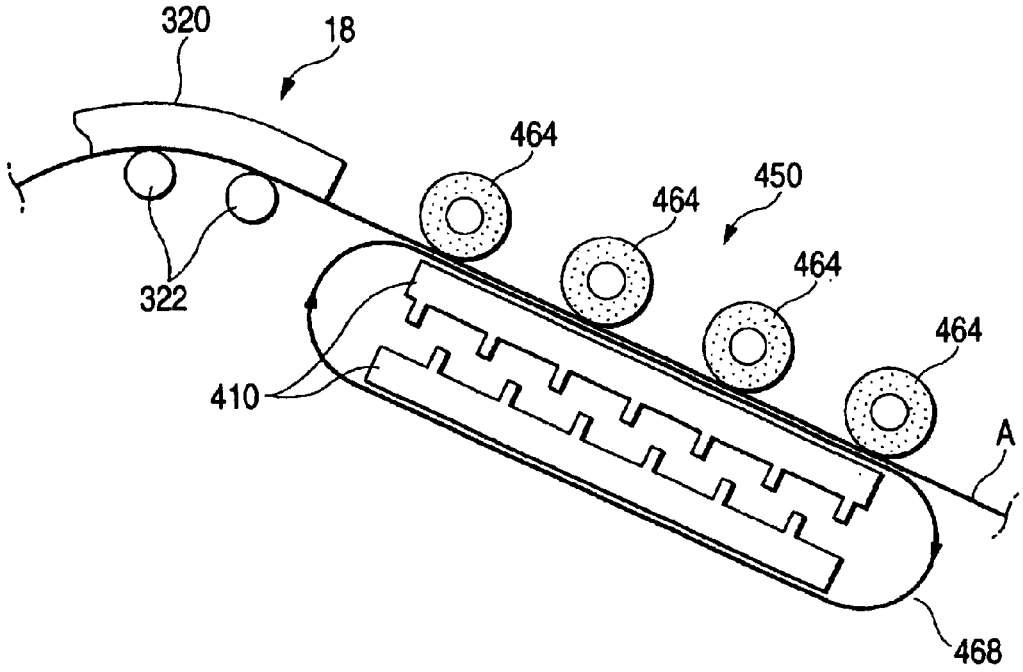

The cooling structure shown in FIG. 10 has metal blocks 410 with cooling fins inside the endless belt 468. The film A is conveyed while pressed onto the endless belt 468 by the press rollers 464. The heat conducted from the film A to the endless belt 468 is dissipated from the metal blocks 410 with heat-dissipating fins to effectively drop the temperature of the film A.

Figure 11:
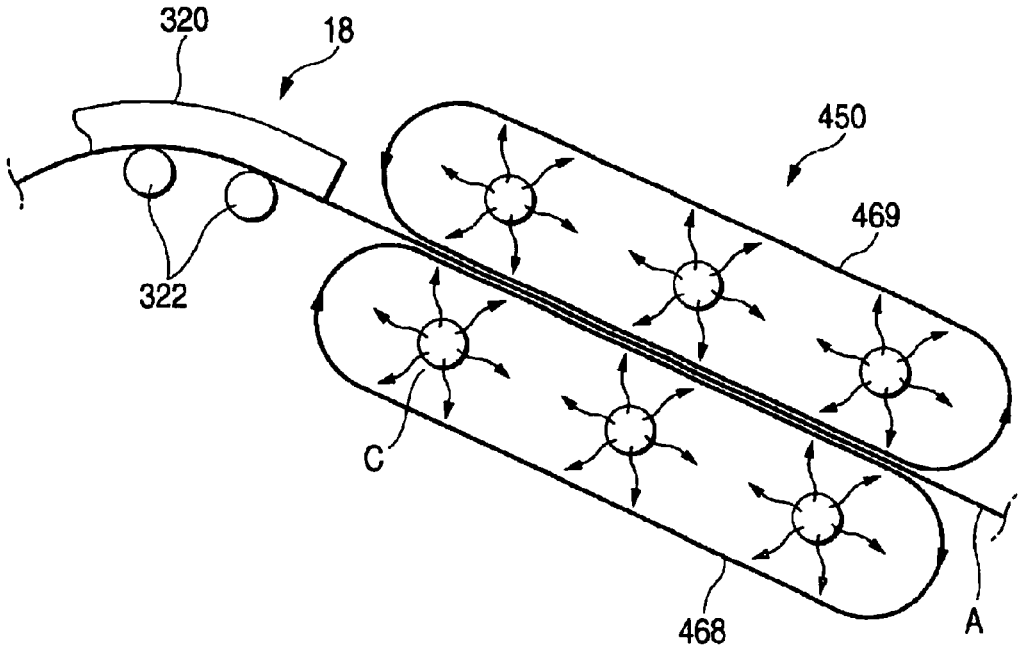

The structure shown in FIG. 11 comprises a clockwise turning endless belt 468 and a counterclockwise turning endless belt 469, through between which the film A is conveyed while being pressed from its both sides. The endless belts 468 and 469 are each cooled with air cooling units C, such as air cooling fans, similarly to the structure shown in FIG. 9 or with heat-dissipating metal blocks similarly to the structure shown in FIG. 10. According to this modification, the heat of the film A is dissipated more effectively, and the film A is cooled under a constant condition.

Figure 12:
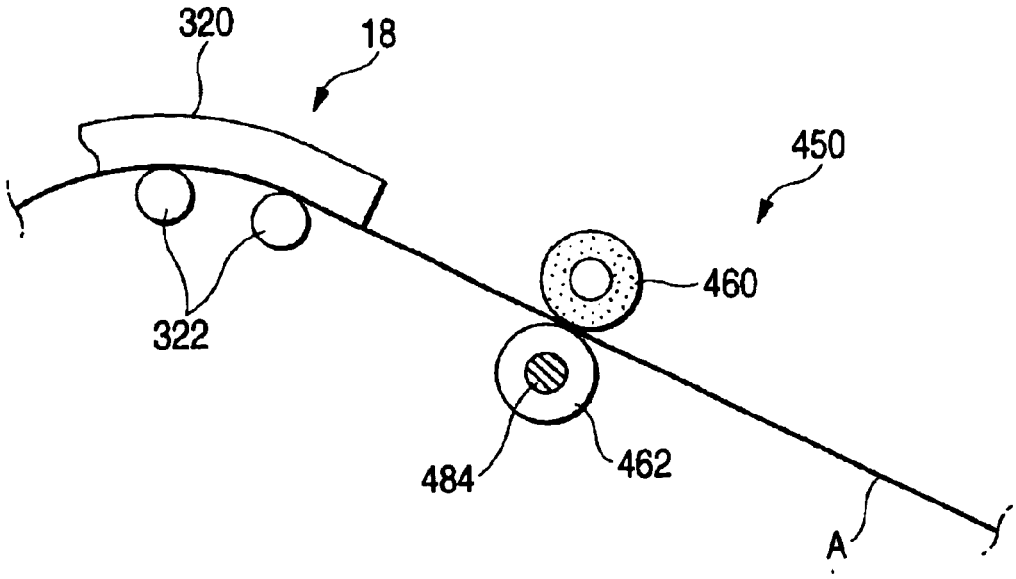

In the cooling section 450 shown in FIG. 12, a heat pipe 484 is provided in the roller 462 to cool the roller 462. A heat pipe is a container made of aluminum, stainless steel, copper, etc. lined with a wick made of glass fiber, fine copper wire, etc., evacuated, and filled with a heat medium, such as Freon, ammonia or water. In the heat pipe the heat medium evaporates at one end on receipt of heat and moves to the other end to discharge the latent heat of evaporation thereby achieving heat transfer. By the use of the heat pipe, the heat of the roller 462 can be removed efficiently.

Figure 13:
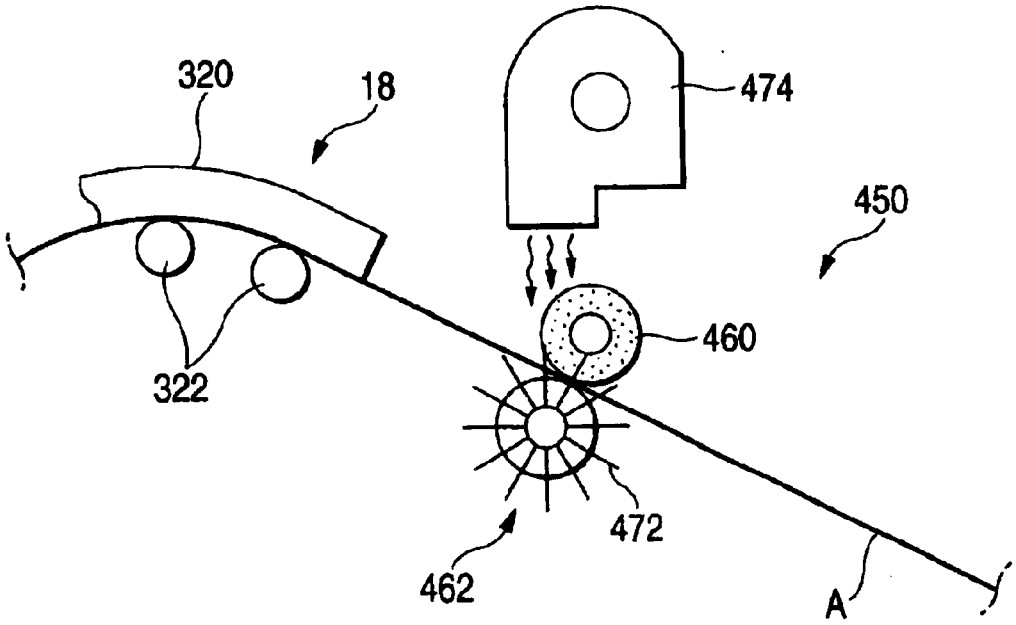

The cooling section 450 shown in FIG. 13 has a cooling fin 472 attached to an end of the axis of the roller 462 and a fan 474 which blows air to cool the roller 462. According to this modification, the roller 462 is cooled efficiently, and a temperature rise is suppressed. As a result, the film A can be cooled stably and efficiently.

FIG. 14 is a schematic illustration of an image forming apparatus according to a second embodiment of the present invention. The image forming apparatus 500 of the second embodiment is composed mainly of, in the order of heat-developable light-sensitive material (film A) path, a heat-developable light-sensitive material feed section having loading parts 522 and 524, a lateral sheet registration section 514, an image exposure section 516, and a heat development section 400. These constituent elements correspond to the loading parts 22 and 24, the lateral sheet registration section 14, the image exposure section 16, and the heat development section 18, respectively, of the image forming apparatus 10 according to the first embodiment shown in FIG. 1.

The image exposure section 516 performs the same function as the exposure unit 46 shown in FIG. 2. The film A imagewise exposed in the image exposure section 516 is sent to a delivery roller 414 of the heat development section 400 by delivery rollers 564 and 566. The image forming apparatus 500 has a power section 555 for driving the above-mentioned sections and a control section 550 in the lower part thereof. Embodiments of the heat development section 400 according to the second embodiment are shown in FIGS. 15 through 22. The second embodiment will be described in greater detail with respect to the heat development section 400. The other sections being the same as in the first embodiment, the description therefor is omitted.

FIG. 15 is a perspective showing the appearance of the heat development section 400. The heat development section 400 is divided into a heat treating part 410 and a cooling part 450. The heat treating part 410 is protected and thermally insulated by its housing composed of a pair of side covers 404 disposed on both lateral sides of the moving film A and heater covers 412A, 412B, 412C, and 412D disposed between the side covers 404. The outer surface of the heater covers 412A, 412B, 412C, and 412D can be flock finished so that an operator may not receive a burn on touching. The flock to be used is a fibrous material having a resistance to a temperature of about 150° C., such as nylon 6 and nylon 66. The cooling part 450 is connected to the downstream end of the heat treating part 410 and covered with a cover 452 to assure heat insulation and safety.

FIG. 16 schematically illustrates the internal structure and the path of the film A in the heat development section of FIG. 15. The heat treating part 410 has heating units 420A, 420B, 420C, and 420D arranged in this order along the path of the film A and protected by the respective heater covers 412A, 412B, 412D, and 412D. The heating units 420A, 420B, 420C, and 420D contain plate heaters 417A, 417B, 417C, and 417D, respectively, each having a curved surface 424A, 424B, 424C, and 424D, respectively. A plurality of press rollers 422A, 422B, 422C, and 422D are arranged along the curved surfaces 424A, 424B, 424C, and 424D to depict a series of arcs as a whole.

Each of the press rollers 422A, 422B, 422C, and 422D has a follower gear 423A, 423B, 423C, and 423D, respectively, at the end of the axial direction, and a press roller driving gear 408 which turns around the center of the arcs formed by the press rollers 422A, 422B, 422C, and 422D is supported by a frame 402 at a position mating with all of the follower gears. The driving gear 408 is turned by a main driving gear 440, which is supported by the frame 402 in the lower part of the heat treating part 410, via a follower gear 406. A pair of delivery rollers 416 are provided in front of the heating unit 420A to make it sure to deliver the film A into the inside of the heat treating part 410. The driving gear 408 drives not only the press rollers but the delivery roller pair 416.

Since the delivery roller pair 416 and the press rollers 422A, 422B, 422C, and 422D are rotated by the driving gear 408, the film A can be transported smoothly while being heated. If the driving gear 408 has a high heat conductivity, heat treating part 410 would dissipate much heat. It is advisable therefore to fabricate the driving gear 408 of a high heat-capacity material such as resins, e.g., a glass/epoxy laminate. The gear teeth can be of metal or glass fiber to secure durability.

The main driving gear 440 transmits driving power to a power transmitting gear 442A and then to a driving belt 444 put on power transmitting gears 442B, 442C, 442D, 442E, and 442F, whereby the delivery roller 414, a plurality of delivery rollers in the cooling part 450, and a discharge roller 446. In place of such a power transmission mechanism, separate driving sources may be possibly used in different parts.

A pair of discharge rollers 418 are provided at the downstream end of the heating unit 420D. The film A discharged through the discharge rollers 418 is led to the cooling part 450, cooled to or below the heat development stopping temperature while passing along the path indicated by symbol A1, and discharged out of the cooling part 450 by the discharge roller 446.

In a stand-by mode of the heat treating part 410, the rotatable members are made to rotate slowly to suppress heat localization in each member. It is also effective to monitor the power voltage applied to the heating units, from which the amount of heat generated in the plate heaters are calculated to control the power voltage or "on" and "off" of the electric current thereby to control the total heat quantity.

FIG. 17 is a perspective showing the structure of the heating unit 420B, one of the heating units used in the heat development section shown in FIG. 15, which also applies to the other heating units 420A, 420C, and 420D.

As shown in FIG. 17, the plate heater 417B and the press rollers 422B are supported by a pair of heater side plates 421B. The follower gears 423B attached to the end of the press rollers 422B are on the outer side of the heater side plate 421B. On the outer side of heater side plate 421B are provided two supporting pins 428B with which to fix the heating unit 420B to the frame 402. Each press roller 422B, arranged along the curved surface 424B of the plate heater 417B, is rotatably supported by the heater side plates 421B via bearings 429B. The bearings 429B are biased to the curved surface 424B of the plate heater 417B by the respective biasing members 426B supported by each heater side plate 421B via a holding member 427B. While in the embodiment shown in FIG. 17 the holding member 427B is screwed onto the heater side plate 421B, it may be fixed by welding or with an adhesive.

The press rollers 422A, 422B, 422C, and 422D are made of silicone to achieve both transporting and heat insulating capabilities. The grease to be applied to the bearings 429B should have heat resistance of about 150° C.

FIG. 18 is a view on arrow X—X of FIG. 16. As shown, the press roller 422B is rotatably supported by the bearing 429B of a supporting member 425B which is fixed to the heater side plate 421B. The supporting member 425B and the bearing 429B are designed to allow the axis of the press roller 422B to be biased to the plate heater 417B by a prescribed displacement. When the film A enters between the plate heater 417B and the press roller 422B, the gap t therebetween is widened. On the other hand, since the bearing 429B is always biased to the plate heater 417B by the biasing member 426B, a moderate pressure is always applied to the film A to assure contact of the film A with the plate heater 417B with no gap.

In a stand-by mode, i.e., in the absence of the film A, the driving gear 408 and the follower gear 423B are very close to each other but not engaging with each other. On receipt of the film A, the gap t between the pressing roller 422B and the plate heater 417B is widened as mentioned above. In concert with this movement, the follower 423B comes into engagement with the driving gear 408. In other words, the pressing roller 422B is not rotated in the absence of the film A, which reduces the driving load of the driving gear 408.

The gap between the press roller 422B and the plate heater 417B with no film A inserted is set slightly smaller than the thickness of the film A. For example, where the film A is 0.2 mm thick, a suitable gap is about 0.15 mm. In this example, the distance the axis of the press roller 422B can move is preferably about 0.05 to 0.65 mm. The difference between the diameter of the press roller 422B and that of the bearing 429B is unchanged, which can be taken advantage of to improve the gap precision between the press roller 422B and the plate heater 417B.

The plate heater 417B is composed of a metal plate facing the press rollers 422B and a silicone rubber heater adhered to the back side of the metal plate. A silicone rubber heater is a thin silicone rubber sheet having an electric wire pattern embedded therein. The plate heater having such a structure is obtained by integrally molding an unvulcanized silicone rubber heater with a metal plate to perform vulcanization of the silicone rubber and adhesion to the metal plate simultaneously. The plate heater fabricated by this technique shows uniform and intimate adhesion between the silicone rubber heater and the metal plate and will not suffer abnormalities due to overheat, such as rubber melting or burning, which might occur if there is any gap left between the rubber heater and the metal plate.

FIG. 19 is a cross-sectional view of the heating part 410 shown in FIG. 15, showing the arrangement of the press rollers 422A, 422B, 422C, and 422D in the heating units 420A, 420B, 420C, and 420D. As stated above, each press roller is biased to a prescribed position in the direction toward the plate heater 427A, 417B, 417C or 417D by the biasing member 426A, 426B, 426C or 426D fixed to the holding member 427A, 427B, 427C or 427D. The biasing members 426A, 426B, 426C, and 426D contain the respective springs. Each biasing member is hooked on a stopper (not shown) provided on the holding member 427A, 427B, 427C or 427D and biases the respective press roller. A power supplying terminal 415A, 415B, 415C or 415D is connected to the plate heater 417A, 417B, 417C or 418D, respectively.

Since the heating units 420A, 420B, 420C, and 420D are disposed at different angles With the horizon, the press rollers 422A, 422B, 422C, and 422C exert different influences of gravity on the biasing force of the biasing members 426A, 426B, 426C, and 426D. Accordingly, the biasing force of the biasing members 426 must be varied according to their position so as to apply equal pressure to the film A. This can be realized by using springs with the same rate and varying the position of the stopper among the holding members 427A, 427B, 427C, and 427D to equalize the biasing force of all the springs. In FIG. 19, the positions of the stoppers correspond to the edges of the respective holding members 427A, 427B, 427C, and 427D on the side facing to the respective plate heaters 417A, 417B, 417C, and 417D, which positions being indicated by reference numerals 436A, 436B, 436C, and 436D. By using these holding members taking difference distances from the facing plate heaters, the biasing force of the biasing members held thereby can be adjusted.

FIG. 20 presents a partial perspective of the heat developing part 410 of FIG. 15 with its housing (side covers 404 and heater covers 412) detached. The frame 402 has pairs of cutouts 432A, 432B, 432C, and 432D at the positions where the heating units are fitted. The paired supporting pins 428A, 428B, 428C, and 428D of the respective heating units are fitted into these paired cutouts. Fixing plates 430A, 430B, 430C, and 430D are fitted to one of the respective paired supporting pins, and the fitting plates are fixed to the frame 402 thereby fixing the heating units at the respective positions. In the embodiment shown in FIG. 20, the fixing plate is fixed to the frame 402 by a single screw. It is advisable that the part of the supporting pins 428A, 428B, 428C, and 428D which comes into contact with the frame 402 be made of a material with low heat conductivity, such as resins, so as to suppress heat dissipation from the heating units. The above-described structure facilitates attaching and detaching the heating units to and from the frame.

A knob 406A connects directly to the follower gear 406. The press rollers can be turned manually by turning the knob 406A in case of, for example, jamming of the film A.

FIG. 21 is an enlarged view of the cooling part 450 of the image forming apparatus 500 according to the second embodiment. The cooling part 450 comprises cooling rollers 460 arranged on both sides of the path A1 in not an opposite but alternate configuration (zigzag configuration), whereby the film A is brought into contact with the cooling rollers 460 for an extended time to enjoy improved cooling efficiency.

Further, the cooling rollers 460 are arranged not in a straight configuration but to provide a curved path Al having a certain curvature R. That is, the cooling part 450 is designed to perform the following two functions: (1) to rapidly cool the film A to about 100° C., around which development stops, and to keep the film A not to exceed the development stopping temperature and, after the development has stopped, (2) to enhance cooling so as to rapidly bring the film temperature close to about 70° C., around which curl of the film A is set because the base of the heat-developable light-sensitive material has a glass transition temperature of about 70° C. According to this configuration, even if the cooling temperature distribution of the cooling part varies to have the zone where the film A reaches about 70° C. shifted upstream or downstream depending on whether the cooling part is in the early stage or the steady state of operation or due to some other factors, the film A moves always describing a curve (path A1) at a constant curvature radius R while being cooled to about 70° C. As a result, the film A will have gotten a constant curl when it is discharged from the cooling part.

The reason why the film A is to be curled intentionally is as follows. Although it is ideal that a film with a visible image be discharged flat, it is difficult to control the cooling temperature to result in perfect flatness. With slight temperature variations, a film is liable to curl inward in some cases or outward in some other cases. When this happens, the discharged films cannot be stacked up neatly, which is unfavorable for handling.

Hence, the idea of temperature control for achieving flatness abandoned, the plurality of cooling rollers are disposed to form a gentle curve with a given curvature radius so that the films may be discharged with a gentle curve. According to the above-described design, the film is kept cooled while depicting a curve and gains fixed curvature even when the cooling temperature varies slightly to shift the zone at which the film is cooled to around 70° C. upstream or downstream. The fixed curling direction may be inward (toward the receiving tray) or outward (toward an operator). Where the Em layer side of the film A has been brought into contact with the press rollers in the heat treating part 410, the configuration shown in FIGS. 14, 16, and 21 is designed to slightly curl the film A toward an operator with the image side facing up because the curled films will lie on their two opposing sides when laid on a horizontal place with the image side up, which is more convenient for a user to handle.

The curvature radius R in the embodiment shown is 350 mm, which is subject to slight variation according to the thickness and material of the film A.

The cooling roller arrangement in FIG. 21, making a downward curved path A1, produces an additional advantage that delivery rollers on the inner side of the path A1 can be omitted from the middle part of the path A1. That is, the number of necessary members can be decreased.

In order to minimize image density variation by fixing the time when the film is cooled to or below the development stopping temperature, it is a preferred manipulation to control the temperature of the cooling rollers 460 and the temperature of the inner atmosphere of the cooling part 450. Such temperature control will minimize the difference in processing finish between the operation immediately after the start and that after sufficient running thereby to reduce the density variation. In this case, cooling can be carried out while describing a desired temperature drop curve to some extent without providing an independent temperature control mechanism by making holes in the cover 452 of the cooling part, the number of the holes increasing in the downstream direction as shown in FIG. 15.

It is also a preferred manipulation that each cooling roller 460 is a pipe of which the both ends are made of a material having a low heat conductivity to have a reduced heat capacity. By this manipulation, the difference between the temperature of the cooling rollers immediately after the start of the operation and that after sufficient running operation can be made smaller.

The cooling rollers 460 preferably have nonwoven fabric helical wound therearound so that a joint of nonwoven fabric may not continue its contact with the same position of the film A to cause a seam on the image.

FIG. 22 schematically illustrates the internal structure and the film A path in another embodiment of the heat treating part shown in FIG. 15. In the heat treating part 470 shown in FIG. 22, the same members as in FIG. 16 are given the same numerical references.

The heat treating part 470 has heating units 420A, 420B, 420C, and 420D arranged in this order in the downstream direction in the heater covers 412A, 412B, 412D, and 412D, respectively. The heating units 420A, 420B, 420C, and 420D contain plate heaters 417A, 417B, 417C, and 417D, respectively, each having a curved surface 424A, 424B, 424C or 424D, respectively. A plurality of press rollers 422A, 422B, 422C, and 422D are arranged along the respective curved surfaces to depict a series of arcs as a whole.

Endless conveyer belts 476A, 476B, 476C, and 476D are put on the groups of the press rollers 422A, 422B, 422C, and 422D, respectively, so as to pass between the respective groups of the press rollers and the respective plate heaters. Tension rollers 467A, 467B, 467C, and 467D which are supported by the heater side plates 421A, 421B, 421C, and 421D, respectively, give tension to the conveyer belts 476A, 476B, 476C, and 476D. The film A is conveyed between the plate heaters 417A, 417B, 417C, and 417D and the turning belts 476A, 476B, 476C, and 476D.

The driving system for the belts 476A, 476B, 476C, and 476D may be the same as in FIG. 16. That is, the press roller driving gear 408 supported by the frame 402 is engaged with the follower gears 423A, 423B, 423C, and 423D fitted to the axial end of the press rollers 422A, 422B, 422C, and 422D. It is also conceivable that the tension rollers 467A, 467B, 467C, and 467D are driven by a driving gear like the press roller driving gear 408.

The conveyer belts 476A, 476B, 476C, and 476D have a higher coefficient of friction against the film A than the curved surfaces 424A, 424B, 424C, 424D of the plate heaters 417A, 417B, 417C, and 417D so that the film A may be transported surely by the conveyer belts while keeping contact with the plate heaters. Since each conveyer belt comes into contact with the film A over the whole length of the facing plate heater, pressure is applied to the film A uniformly to suppress unevenness of heat application.

The surface of the belts 476A, 476B, 476C, and 476D which comes into contact with the film A may be raised or fluffed to have improved conveying properties. Further, the belts preferably have air permeability so that gas generated from the heat-treated layer of the film A by some chemical change may escape to allow the film A to come into close contact with the plate heaters.

In each of the aforementioned embodiments, the space between adjacent plate heaters arranged along the transport direction may have the form of a comb joint.

While the above-described heat developing units are of the plate heater type, the present invention is not limited thereto, and a heat developing unit of heat drum type can be used. FIG. 23 shows a heat developing unit 410' which is of heat drum type. A heat drum 130 is a heating member rotating in direction B and containing a halogen lamp or a rubber heater (not shown) in the inside thereof to have a controlled heating temperature. The rubber heater is divided into a plurality of sections which are arranged parallel with each other across the axial direction of the heat drum so as to have a changeable heating region according to the width of a film A to be processed. A plurality of small-diameter free rollers 131 as film holding members are disposed at a regular interval on the periphery of the heat drum 130 in parallel to the rotation axis of the heat drum 130.

The delivery rollers 414 rotate at a controlled speed to deliver the film A in direction C. The film A then enters between the heat drum 130 and the first free roller 131 and begins to turn in direction B together with the heat drum 130 with which it is in close contact. Meantime the film A is heat developed by the heat drum 130 to visualize the latent image. When it reaches the last free roller 131 on the right hand side, it separates from the heat drum 130 and enters the cooling part 450.

While in the first and second embodiments shown in FIGS. 1 and 14 the film A is exposed in its horizontal configuration in the image exposure section 16 or 516, the present invention is not limited thereto. It is possible to fast-scan a laser beam on a vertically moving film A as in a third embodiment shown in FIG. 24. The image forming apparatus 10' according to the third embodiment has the same construction as the apparatus 10 shown in FIG. 1 except for the image exposure section 16'. The film A that has been moving horizontally in the zone below the image exposure section 16' changes its moving direction to a vertical direction through delivery rollers 64' and enters the image exposure section 16', where the film A is scanned with a laser beam L having a wavelength of 400 nm and having its intensity modulated based on image data signals in the fast-scan direction (the film A width direction) and also in the slow-scan direction (the film A moving direction) to form a latent image. This configuration providing a vertical path for the film A achieves improved film transport efficiency and space saving and is convenient to design a system for sending the films to the heat developing section while carrying out recording.

In a fourth embodiment of the present invention, a density correction system is provided, with which to easily and promptly correct image density variations which can occur as a result of lot-to-lot variation in the manufacture of heat-developable light-sensitive materials or change with time of the characteristics of a blue laser light source used in the present invention. FIG. 25 is a diagram showing the density correction system according to the fourth embodiment of the invention. Numeral 250 indicates an image data accumulator 250; 252, an exposure control unit; 253, a signal switchover unit; 254, a D/A converter; 256, a density measuring circuit; 258, a heat development controller; and 260, a density correction calculator which is composed of a test pattern signal emitter 261 and a conversion table preparation unit 262.

Image formation under the control by the density correction system shown in FIG. 25 is carried out as follows. Digital image signals S1 accumulated in the image data accumulator 250 are converted into digital image signals S2 based on a conversion table described later in the exposure controller 252. The signals S2 are inputted in the D/A converter 254 through the signal switchover unit 253, where the signals S2 are analogized. The analogue image signals S4 are sent to the image exposure section 16, where the film A is exposed to blue laser light based on the analogue image signals S4 to record a latent image. The film A with the latent image is delivered to the heat development section 18, where it is developed to form a visible image.

The image forming apparatus equipped with this system has the density measuring circuit 256 inside the heat development section 18 or very near the outlet of the heat development section 18. The density measuring circuit 256 detects the image density of a predetermined part of the film A, and density correction is made in the density correction calculator 260 as follows.

Prior to image recording, the movable contact point of the signal switchover unit 253 is connected to the test pattern signal emitter 261 side, and test pattern signals S3 from the test pattern signal emitter 261 are sent to the image exposure section 16. A film A is exposed according to the test pattern signals S3 and developed in the heat development section 18. The density of the image thus developed is measured in the density measuring circuit 256 to furnish image density signals S5 to the conversion table preparation unit 262. The conversion table preparation unit 262 compares the test pattern signals S3 from the test pattern signal emitter 261 with the image density signals S5 of the corresponding part of the film A sent from the density measuring circuit 256 and prepares a conversion table for converting the digital image signals S1 into digital image signals S2 while making corrections so that the image density of the corresponding part may agree with the density of the test pattern. The conversion table thus prepared is inputted into the exposure controller 252.

On setting the conversion table in the exposure controller 252, the movable contact point of the signal switchover unit 253 is connected to the exposure controller 252 side. Then the digital image signals S1 stored in the image data accumulator 250 are converted to digital image signals S2 based on the conversion table in the exposure controller 252. The film A is exposed in the image exposure section 16 according to the resulting digital image signals S2 to provide an image with corrected density.

The conversion table may be prepared each time the lot of the film A is changed or at a prescribed time interval taking into consideration the change with time of the characteristics of a laser light source.

In the above-described density correction system, a conversion table is prepared from the image density data measured on the image obtained in the heat development section 18 and is used for correcting the subsequent image exposure in the image exposure section 16. When the image exposure section 16 and the heat development section 18 are disposed close by, real-time correction is possible by preparing a conversion table from image density data measured on the upstream part of a film A and feeding back the corrected data to the image exposure section 16 for image-wise exposure for the following part of that film A.

Further, while in the above-described correction system the correction data prepared in the conversion table preparation unit 262 is utilized in the exposure controller 252, the image density correction system of the present invention is not limited to this mode. For example, the correction data prepared in the conversion table preparation unit 262 may be inputted into the heat development controller 258 as indicated by the broken line, where the heating temperature of the heat development section 18 is corrected to make image density correction.

The specific heat-developable light-sensitive material, the use of which is a prerequisite to carry out the image forming method of the invention or to carry out image formation by the use of the image forming apparatus according to the invention, will then be described. The heat-developable light-sensitive material which can be used in the invention is a high-iodide silver halide light-sensitive material which exhibits sensitivity to short wavelength (about 400 nm) light.

The high-iodide silver halide light-sensitive material which has a high silver iodide content and yet exhibits high sensitivity to provide high image quality includes:

(1) A heat-developable light-sensitive material comprising a support having thereon at least a light-sensitive silver halide having a silver iodide content of 5 to 100 mol %, a light-insensitive organic silver salt, a heat developing agent, and a binder, which is to be exposed to light having a peak intensity between 350 nm and 450 nm at an illuminance of 1 $mW/mm^2$ or more.

(2) A heat-developable light-sensitive material comprising a support having thereon at least a light-sensitive silver halide having a direct transition absorption attributed to a high-iodide silver halide crystal structure thereof, a light-insensitive organic silver salt, a heat developing agent, and a binder, which is to be exposed to light having a peak intensity between 350 nm and 450 nm at an illuminance of 1 $mW/mm^2$ or more.

In the above-described heat-developable light-sensitive materials (1) and (2), the light-sensitive silver halide preferably has a grain size of 5 to 80 nm; the light-sensitive silver halide is preferably one formed in the absence of an organic silver salt; and the light-sensitive silver halide preferably has an average silver iodide content of 10 to 100 mol %, particularly 40 to 100 mol %.

It is important that the light-sensitive silver halide to be used in the invention should be a high-iodide silver halide emulsion having a silver iodide content of at least 5 mol %. It has been generally accepted that a silver halide emulsion having a high silver iodide content has low sensitivity and is of low utility.

It is preferred that part of the silver halide has a phase capable of light absorption through direct transition. It is well known that a direct transition absorption in the range from 350 nm to 450 nm can be realized by a high-iodide silver halide structure having a hexagonal wurtzite structure or a cubic zincblende structure. However, silver halide emulsions having such an absorption structure generally have low sensitivity and low utility in the photographic field.

The present inventors have found that high sensitivity and high image sharpness can be achieved with such a high-iodide silver halide emulsion by formulating into a heat-developable light-sensitive material together with a light-insensitive organic silver salt and a heat developing agent and exposing the light-sensitive material at a high illuminance (1 $mW/mm^2$ or higher) for a short time (1 second or shorter, preferably $10^{-2}$ second or shorter, still preferably $10^{-4}$ second or shorter). According to the inventors' study, it is preferred for the silver halide emulsion grains in the above formulation to have a size not greater than 80 nm. The effects of the present invention are manifested particularly pronouncedly with such small silver halide grains.

The silver halide which can be used in the present invention preferably has a silver iodide content of 5 to 100 mol %, particularly 10 to 100 mol %, desirably 40 to 100 mol %, more desirably 70 to 100 mol %, most desirably 90 to 100 mol %. The effects produced in the invention become more and more remarkable with an increasing silver iodide content.

It is preferred for the silver halide to have a direct transition absorption attributed to a silver iodide crystal structure in the wavelength range of from 350 nm to 450 nm. Whether silver halides have a direct transition absorption can easily be distinguished by an exciton absorption ascribed to direct transition in the vicinity of 400 to 430 nm. FIG. 26 shows an absorption spectrum of a silver iodide emulsion which is preferably used in the present invention, which reveals an absorption by the excitons of silver high-iodide in the vicinity of 420 nm.

Such a direct transition absorption type high-iodide silver halide phase may exist alone or preferably exists as joined to silver halide grains showing an indirect transition absorption in a wavelength region between 350 nm and 450 nm, such as silver bromide grains, silver chloride grains, silver iodobromide grains, silver iodochloride grains or mixed crystals thereof.

Such joined grains preferably have a total silver iodide content of 5 to 100 mol %. A preferred average silver iodide content is 10 to 100 mol %, desirably 40 to 100 mol %, more desirably 70 to 100 mol %, most desirably 90 to 100 mol %.

Although the silver halide phase which absorbs light through direct transition generally exhibits intensive light absorption, it has been of no industrial use because of its low sensitivity as compared with a silver halide phase having a weak absorption through indirect transition. The present inventors have found that a silver halide light-sensitive material comprising such a direct transition absorption type high-iodide silver halide phase exhibits satisfactory sensitivity when exposed to light of 350 to 450 nm at an illuminance of 1 $mW/mm^2$ or higher. A preferred wavelength of exposure light is 370 to 430 nm, particularly 390 to 430 nm, especially 390 to 420 nm.

The silver halide of the invention exhibits still preferred characteristics with the grain size ranging from 5 to 80 nm. In particular, it has been ascertained that silver halide grains containing a phase having a direct transition absorption exhibit sensitivity with the grain size being as small as 80 nm or less. A more desirable grain size of the light-sensitive silver halide is 5 to 60 nm, particularly 10 to 50 nm. The term "grain size" as used herein denotes an equivalent diameter which is defined as a diameter of a sphere of equal volume.

Methods of forming light-sensitive silver halide grains are well-known in the art. The techniques taught in *Research Disclosure*, No. 17029 (June, 1978) and U.S. Pat. No. 3,700,458 are useful, for example. In some detail, a silver supplying compound and a halogen supplying compound are added to a solution of gelatin or other polymer to form light-sensitive silver halide grains, which are then mixed with an organic silver salt. The methods disclosed in JP-A-11-119374 (para. Nos. 0217–0224), JP-A-11-98708, and JP-A-12-347335 are also preferred.

The shape of silver halide grains includes a cube, an octahedron, a tabular shape, a sphere, a rod, and an amorphous (potato-like) shape. Cubic grains are particularly preferred in the invention. Polyhedral grains with rounded corners are also preferred.

While the indices of plane (Miller indices) of the light-sensitive silver halide grains are not particularly limited, it is preferred that the grains have a higher proportion of {100} planes which have high spectral sensitization efficiency when a spectral sensitizing dye is adsorbed thereon. A preferred proportion of {100} planes is 50% or higher, particularly 65% or higher, especially 80% or more. The proportion of {100} planes can be determined by the method utilizing crystal plane dependence of adsorption of a sensitizing dye on {111} and {100} planes (T. Tani, *J. Imaging Sci.*, vol. 29, p. 165 (1985)).

Silver halide grains having a hexacyanometal complex on the surface thereof are preferably used in the invention. Useful hexacyanometal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$, with hexacyanoiron complexes being preferred.

Although counter cations are not so important for the hexacyanometal complex present in an aqueous solution in ionic form, it is advisable to use such cations that are water-miscible and fit for flocculation of silver halide emulsion grains, including alkali metal ions (e.g., sodium, potassium, rubidium, cesium or lithium ions), ammonium ions, and alkylammonium ions (e.g., tetramethylammonium, tetraethylammonium, tetrapropylammonium or tetra(n-butyl)ammonium ions).

The hexacyanometal complex can be added as mixed with water, a mixed solvent of water and an appropriate water-miscible organic solvent (e.g., alcohols, ethers, glycols, ketones, esters or amides), or gelatin. The hexacyanometal complex is preferably added in an amount of $1\times10^{-5}$ to $1\times10^{-2}$ mol, particularly $1\times10^{-4}$ to $1\times10^{-3}$ mol, per mole of silver.

In order for the hexacyanometal complex be present on the surface of silver halide grains, it is added directly to the system after completion of addition of a silver nitrate aqueous solution for grain formation and before completion of charging step before chemical sensitization (for example, chalcogen (e.g., sulfur, selenium or tellurium) sensitization or gold sensitization), during washing with water, during dispersing, or before chemical sensitization. In order not to allow the silver halide fine grains to grow, it is preferred to rapidly add the hexacyanometal complex immediately after grain formation. From this viewpoint, the hexacyanometal complex is preferably added before completion of the charging step. Addition of the hexacyanometal complex may be started when 96% by weight, preferably 98% by weight, still preferably 99% by weight, of silver nitrate based on the total amount of silver nitrate to be added for grain formation has been added.

Where the hexacyanometal complex is added after completion of silver nitrate addition, i.e., immediately before completion of grain formation, the complex can be adsorbed on the outermost surface of the silver halide grains, and most of it forms a sparingly soluble salt with silver ions on the grain surface. Since the silver salt of hexacyanoiron (II) complex is more sparingly soluble than silver iodide, re-dissolution by fine grains can be prevented, making it possible to prepare small size silver halide grains.

The light-sensitive silver halide grains can contain a metal of the groups 8 to 10 of the Periodic Table (from groups 1 to 18) or a complex of the metal. The metal (or the center metal of the metal complex) preferably includes rhodium, ruthenium, and iridium. Two or more metal complexes having the same center metal or different center metals may be used in combination. The metal or the metal complex is suitably added in an amount of $1\times10^{-9}$ to $1\times10^{-3}$ mol per mole of silver. As for useful metals or metal complexes and the manner of addition, reference can be made in JP-A-7-225449, JP-A-11-65021 (para. Nos. 0018–0024), and JP-A-11-119374 (para. Nos. 0227–0240).

As for metal atoms that can be incorporated into the silver halide grains (e.g., $[Fe(CN)_6]^{4-}$) and useful methods of desalting and chemical sensitization of silver halide emulsions, refer to JP-A-11-84574 (para. Nos. 0046–0050), JP-A-11-65021 (para. Nos. 0025–0031), and JP-A-11-119374 (para. Nos. 0242–0250).

Various kinds of gelatin can be used in the light-sensitive silver halide emulsion. Low-molecular gelatin having a molecular weight of 500 to 60,000 is preferred for maintaining a good dispersed condition of the emulsion in an organic silver salt-containing coating composition. The low-molecular gelatin may be used at the time of grain formation or preferably at the time of dispersion after desalting.

Various compounds known as supersensitizers can be used for increasing the intrinsic sensitivity of the silver halide grains. Useful supersensitizers include the compounds disclosed in European Patent Publication No. 587, 338, U.S. Pat. Nos. 3,877,943 and 4,873,184, JP-A-5-341432, JP-A-11-109547, and JP-A-10-111543.

The light-sensitive silver halide grains are preferably chemically sensitized by sulfur sensitization, selenium sensitization or tellurium sensitization with compounds known therefor, such as the compounds described in JP-A-7-128768. Tellurium sensitization is particularly preferred for the light-sensitive silver halide grains used in the invention. Preferred compounds for performing tellurium sensitization include the compounds described in JP-A-11-65021 (para. No. 0030) and the compounds represented by formulae (II), (III) or (IV) described in JP-A-5-313284.

Chemical sensitization can be effected in any stage after grain formation and before application to a support. Conceivable stages include (1) after desalting and before spectral sensitization, (2) simultaneous with spectral sensitization, (3) after spectral sensitization, and (4) immediately before application. The stage (3) is preferred.

The amount of the chemical sensitizer for sulfur, selenium or tellurium sensitization is usually about $1\times10^{-8}$ to $1\times10^{-2}$ mol, preferably about $1\times10^{-7}$ to $1\times10^{-3}$ mol, per mole of silver halide, while somewhat varying according to the silver halide grains, chemical ripening conditions, and the like. While not limiting, the chemical sensitization is carried out at a pH of 5 to 8, a pAg of 6 to 11, and a temperature of about 40 to 95° C.

The silver halide emulsion may contain a thiosulfonic acid compound according to the method taught in European Patent Publication No. 293,917.

If desired, two or more kinds of light-sensitive silver halide emulsions different, e.g., in average grain size, halogen composition, crystal habit or conditions adopted in chemical sensitization can be used in combination. Use of a plurality of light-sensitive silver halide emulsions having different sensitivities facilitates gradation control. With reference to usage of different kinds of emulsions, the disclosure in JP-A-57-119341, JP-A-53-106025, JP-A-47-3939, JP-A-48-55730, JP-A-46-5187, JP-A-50-73627, and JP-A-57-150841 can be referred to. In using two or more emulsions of different sensitivities, a recommended difference of sensitivity is 0.2 logE or greater.

The light-sensitive silver halide emulsion is preferably used in an amount to give a silver coating weight of 0.03 to 0.6 g, particularly 0.07 to 0.4 g, especially 0.05 to 0.3 g, per $m^2$ of a light-sensitive material. This amount would correspond to 0.01 to 0.3 mol, particularly 0.02 to 0.2 mol, especially 0.03 to 0.15 mol, of silver halide per mole of an organic silver salt in the coating composition.

Light-sensitive silver halide grains are mixed with a separately prepared organic silver salt by use of a high-speed stirrer, a ball mill, a sand mill, a colloid mill, a vibration mill, a homogenizer or the like. Otherwise, separately prepared light-sensitive silver halide grains can be mixed into a system of preparing an organic silver salt in any stage of organic silver salt preparation. In other words, it is advisable that silver halide grain formation be finished in the absence of an organic silver salt. Mixing two or more organic silver salt aqueous dispersions and two or more light-sensitive silver halide aqueous dispersions is an effective manipulation for adjusting photographic characteristics.

The light-sensitive silver halide is mixed into a coating composition for forming an image-forming layer preferably in a stage from 3 hours before to immediately before application, particularly from 2 hours before to 10 seconds before application. The method and conditions of mixing are not particularly limited as far as the effects of the present invention are manifested sufficiently. For example, mixing is conducted in a tank designed to provide a desired average retention time, the average retention time being calculated from the rate of adding the light-sensitive silver halide emulsion and the rate of feeding the coating composition to a coater. The methods using a static mixer, etc. described in N. Harnby, M. F. Edwards, and A. W. Nienow (eds.), *Mixing in the Process Industries*, ch. 8, Butterworth-Heinemann (1992) are also useful.

The light-sensitive material can have arbitrary gradient. For effective manifestation of the effects of the invention, a preferred average contrast between 1.5 density and 3.0 density is 1.5 to 10. The terminology "average contrast" as used herein means the slope of the straight line connecting optical density 1.5 and optical density 3.0 in a characteristic curve with a logarithm of a laser exposure plotted as abscissa and an optical density as ordinate. The above-recited average contrast of 1.5 to 10 is preferred for preventing cuts of letters. A still preferred average contrast is 2.0 to 7, particularly 2.5 to 6.

The light-insensitive organic silver salt which can be used in the invention is a silver salt which is relatively stable to light but capable of forming a silver image when heated to 80° C. or higher in the presence of an irradiated photocatalyst (e.g., a latent image of a light-sensitive silver halide) and a reducing agent. Any organic substance containing a source capable of reducing silver ions can be used as a reducing agent.

Such light-insensitive organic silver salts are described, e.g., in JP-A-10-62899 (para. Nos. 0048–0049), EP 0803764A1 (page 18, line 24 to page 19, line 37), EP 0962812A1, JP-A-11-349591, JP-A-12-7683, and JP-A-12-72711. Silver salts of organic acids, particularly long-chain fatty acids having 10 to 30, preferably 15 to 28, carbon atoms, are preferred. Suitable fatty acid silver salts include silver behenate, silver arachidate, silver stearate, silver oleate, silver laurate, silver caproate, silver myristate, silver palmitate, and mixtures thereof. Preferred of them are silver behenate and a mixed fatty acid silver salt having a silver behenate content of 50 mol % or more, particularly 80 mol % or more, especially 96 mol % or more.

The shape of the organic silver salt includes, but is not limited to, a needle shape (acicular), a rod shape, a tabular shape, and a flaky shape. A flaky organic silver salt is preferred in the invention. Rod-like (aspect ratio: 5 or smaller), parallelopipedal, cubic or potato-like amorphous grains are also preferred. Organic silver salts having these preferred shapes are favorably characterized by undergoing less fogging in heat development than needle-like grains having an aspect ratio greater than 5.

In this invention "flaky organic silver salt" is defined as follows. An organic silver salt is observed under an electron microscope. The shapes of the individual organic silver salt grains are approximated to parallelepipeds with the shortest side a, the middle side b, and the longest side c (the sides b and c can be equal). A ratio x of the next shortest side length to the shortest side length is obtained (x=b/a). Values x are calculated for about 200 grains to obtain an average x. Grains having an average x equal to or greater than 1.5 are defined to be "flaky". A preferred average x is 1.5 to 30, particularly 2.0 to 20. Incidentally, an average x of needle-like acicular particles is smaller than 1.5 and not smaller than 1.

In a flaky particle, a side length a is regarded as the thickness of a tabular particle of which the main plane is formed of sides b and c. a is preferably 0.01 to 0.23 $\mu$m, particularly 0.1 to 0.20 $\mu$m, in average. An average c/b is preferably 1 to 6, still preferably 1.05 to 4, particularly preferably 1.1 to 3, especially preferably 1.1 to 2.

It is preferred for the organic silver salt to have a mono-disperse grain size distribution. The term "mono-disperse" as used herein is used to describe such a grain size distribution that a percentage of a quotient obtained by dividing a standard deviation of a minor and a major axis length by an average of a minor and a major axis length, respectively, is preferably 100% or less, still preferably 80% or less, particularly preferably 50% or less. The shape of an organic silver salt is determined from a transmission electron micrograph of a dispersion of the organic silver salt.

The mono-disperse property of the organic silver salt grains can also be determined from a standard deviation of volume average diameter. The percentage of a quotient obtained by dividing the standard deviation by a volume average diameter (coefficient of variation) is preferably 100% or less, still preferably 80% or less, particularly preferably 50% or less. The volume average particle diameter is measured by, for example, irradiating organic silver salt particles dispersed in a liquid with laser light and obtaining an autocorrelation function of scattered light intensity fluctuation with time.

The organic silver salt can be prepared and dispersed by known technology. For example, the teachings of JP-A-10-62899, EP 0803763A1, EP 0962812A1, JP-A-11-349591, JP-A-12-7683, JP-A-12-72711, and Japanese Patent Application Nos. H11-348228 to 348230, H11-203413, 2000-90093, 2000-195621, 2000-191226, 2000-213813, 2000-214155, and 2000-19226 can be referred to.

When the organic silver salt is dispersed in an aqueous medium, it is desirable that the dispersing system be substantially free from the light-sensitive silver halide because presence of a light-sensitive silver halide results in an increased fog and a markedly reduced sensitivity. More specifically, the amount of the light-sensitive silver halide which is allowed to be present in the aqueous system for dispersing the organic silver salt is preferably not more than 1 mol %, still preferably not more than 0.1 mol %, based on the organic silver salt in the system. It is the most desirable that no light-sensitive silver halide be added positively.

An aqueous dispersion of the organic silver salt and an aqueous dispersion of the light-sensitive silver halide are mixed to prepare a coating composition for forming an image-forming layer. While the mixing ratio is decided according to use of the light-sensitive material, the light-sensitive silver halide is preferably used in an amount of 1 to 30 mol %, particularly 2 to 20 mol %, especially 3 to 15 mol %, based on the organic silver salt. Mixing two or more organic silver salt aqueous dispersions and two or more light-sensitive silver halide aqueous dispersions is an effective manipulation for adjusting photographic characteristics.

While arbitrary, the organic silver salt is preferably used in an amount of 0.1 to 5 g, particularly 0.3 to 3 g, especially 0.5 to 2 g, in terms of silver (g) per $m^2$ of the light-sensitive material.

The heat-developable light-sensitive material used in the present invention contains a heat developing agent, a reducing agent for the organic silver salt. The reducing agent for the organic silver salt is an arbitrary substance (preferably an organic substance) capable of reducing silver ions to metallic silver. Examples of suitable reducing agents are given in JP-A-11-65021 (para. Nos. 0043–0045) and EP 0803764A1 (page 7, line 34 to page 18, line 12).

Of useful reducing agents preferred are hindered phenol or bisphenol reducing agents having a substituent at the ortho-position of the phenolic hydroxyl group. Compounds represented by formula (R) are still preferred.

(R)

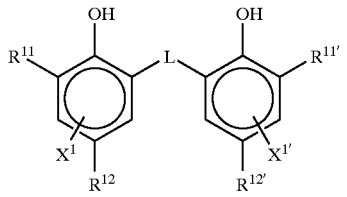

wherein $R^{11}$ and $R^{11'}$ each represent an alkyl group having 1 to 20 carbon atoms; $R^{12}$ and $R^{12'}$ each represent a hydrogen atom or any substituent capable of bonding to the benzene ring; L represents —S— or —$CHR^{13}$—; $R^{13}$ represents a hydrogen atom or an alkyl group having 1 to 20 carbon atoms; and $X^1$ and $X^{1'}$ each represent a hydrogen atom or a substituent capable of bonding to the benzene ring.

The alkyl group as represented by $R^{11}$ and $R^{11'}$ may be substituted or unsubstituted. Suitable substituents of the substituted alkyl group include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, and a halogen atom.

The substituent as represented by $R^{12}$, $R^{22'}$, $X^1$ and $X^{1'}$ which is capable of bonding to the benzene ring preferably includes an alkyl group, an aryl group, a halogen atom, an alkoxy group, and an acylamino group.

The alkyl group as represented by $R^{13}$ (of —$CHR^{13}$— representing L) may be substituted or unsubstituted. Examples of unsubstituted alkyl group as $R^{13}$ are methyl, ethyl, propyl, butyl, heptyl, undecyl, isopropyl, 1-ethylpentyl, and 2,4,4-trimethylpentyl groups. The above-recited substituents for the alkyl group $R^{11}$ apply to the alkyl group $R^{13}$.

$R^{11}$ and $R^{11'}$ each preferably represent a secondary or tertiary alkyl group having 3 to 15 carbon atoms, which includes isopropyl, isobutyl, t-butyl, t-amyl, t-octyl, cyclohexyl, cyclopentyl, 1-methylcyclohexyl, and 1-methylcyclopropyl groups. Still preferably, $R^{11}$ and $R^{11'}$ each represent a tertiary alkyl group having 4 to 12 carbon atoms. Particularly preferred are t-butyl, t-amyl, and 1-methylcyclohexyl groups, with t-butyl being especially preferred.

$R^{12}$ and $R^{12'}$ each preferably represent an alkyl group having 1 to 20 carbon atoms, such as methyl, ethyl, propyl, butyl, isopropyl, t-butyl, t-amyl, cyclohexyl, 1-methylcyclohexyl, benzyl, methoxymethyl, and methoxyethyl groups. Preferred of them are methyl, ethyl, propyl, isopropyl, and t-butyl groups.

$X^1$ and $X^{1'}$ each preferably represent a hydrogen atom, a halogen atom or an alkyl group. A hydrogen atom is still preferred.

L is preferably —$CHR^{13}$—. $R^{13}$ preferably represents a hydrogen atom or an alkyl group having 1 to 15 carbon atoms. The alkyl group preferably includes methyl, ethyl, propyl, isopropyl, and 2,4,4-trimethylpentyl groups. It is particularly preferred for $R^{13}$ to represent a hydrogen atom, a methyl group, an ethyl group, a propyl group or an isopropyl group.

When $R^{13}$ is a hydrogen atom, it is preferred for $R^{12}$ and $R^{12'}$ to represent an alkyl group having 2 to 5 carbon atoms, particularly an ethyl group or a propyl group, especially an ethyl group. When $R^{13}$ is a primary or secondary alkyl group having 1 to 8 carbon atoms, $R^{12}$ and $R^{12'}$ each preferably represent a methyl group. Suitable examples of the primary or secondary alkyl group having 1 to 8 carbon atoms as $R^{13}$ are methyl, ethyl, propyl, and isopropyl groups, with methyl, ethyl, and propyl groups being preferred.

Where $R^{11}$, $R^{11'}$, $R^{12}$, and $R^{12'}$ all represent a methyl group, it is preferred that $R^{13}$ be a secondary alkyl group. The secondary alkyl group for this $R^{13}$ is preferably an isopropyl group, an isobutyl group or a 1-ethylpentyl group. An isopropyl group is the most desirable.

The reducing agents represented by formula (R) show differences in heat developing properties, tone of resultant developed silver, and the like depending on the combination of $R^{11}$, $R^{11'}$, $R^{12}$, $R^{12'}$, and $R^{13}$. Taking advantage of these differences, two or more compounds of formula (R) can be used in combination to obtain desired performance.

Specific examples of reducing agents which can be used in the invention including the compounds of formula (R) are shown below for illustrative purposes only but not for limitation.

(I-1)

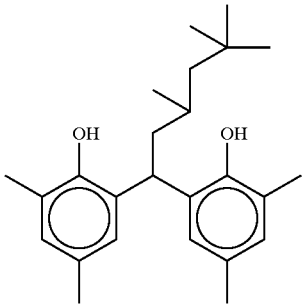

(I-2)

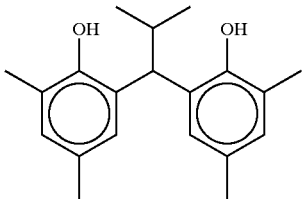

(I-3)

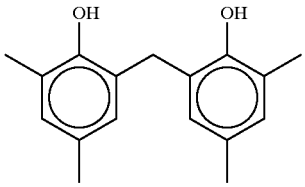

(I-4)

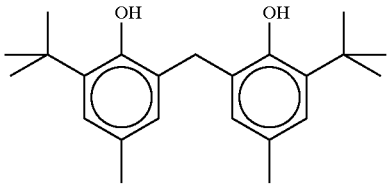

-continued (I-5)

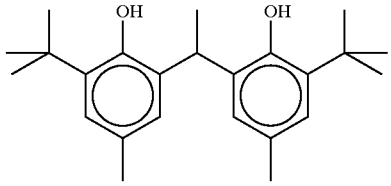

(I-6)

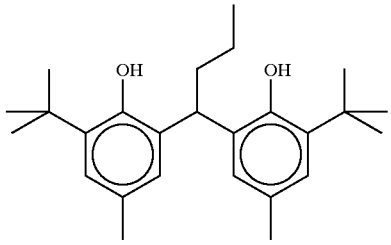

(I-7)

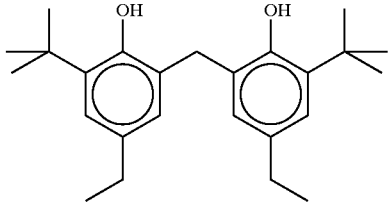

(I-8)

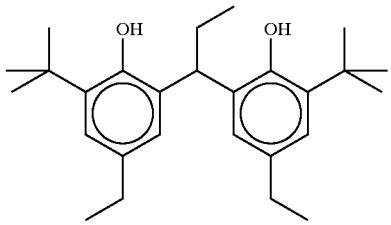

(I-9)

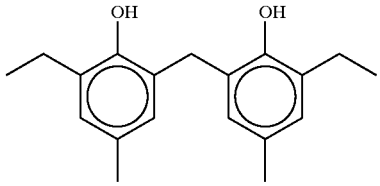

(I-10)

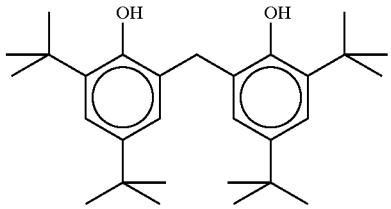

(I-11)

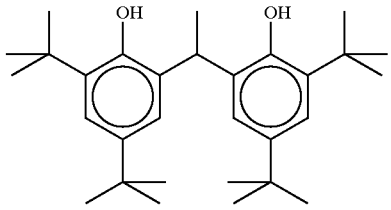

-continued
(I-12)
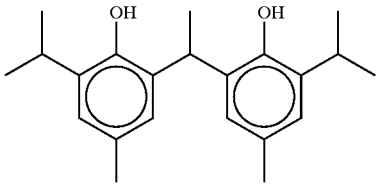
(I-13)
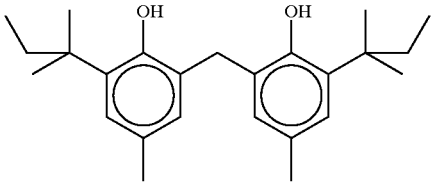
(I-14)
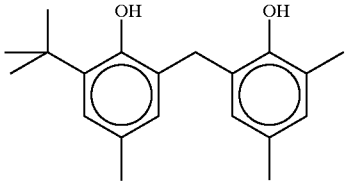
(I-15)
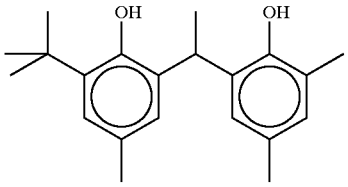
(I-16)
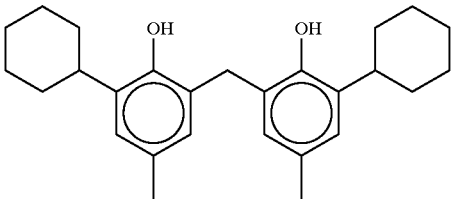
(I-17)
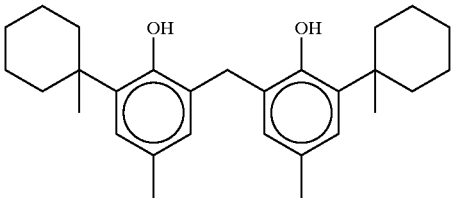
(I-18)
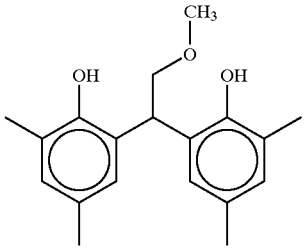
-continued
(I-19)
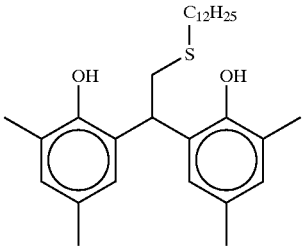
(I-20)
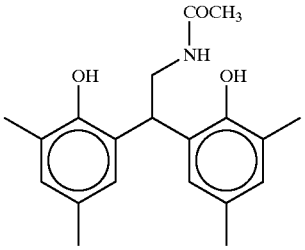
(I-21)
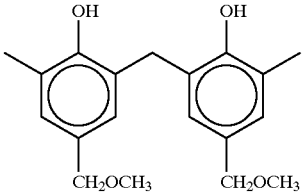
(I-22)
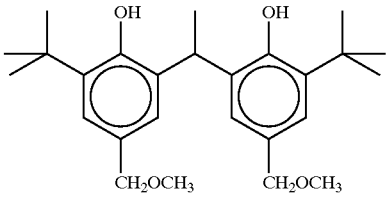
(I-23)
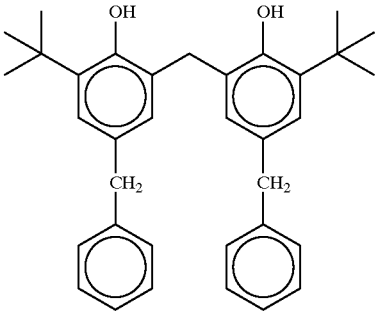
(I-24)
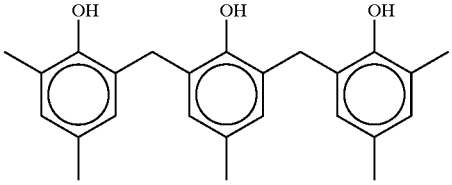
(I-25)
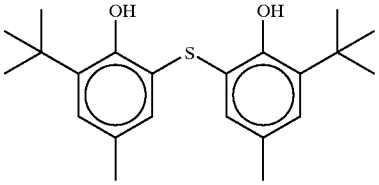

-continued (I-26)

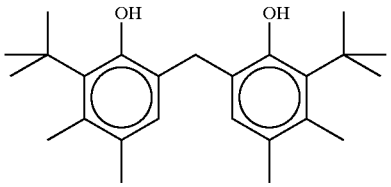

(I-27)

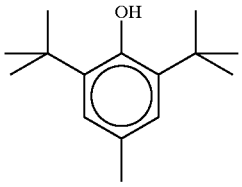

(I-28)

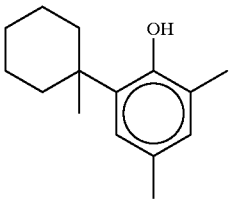

(I-29)

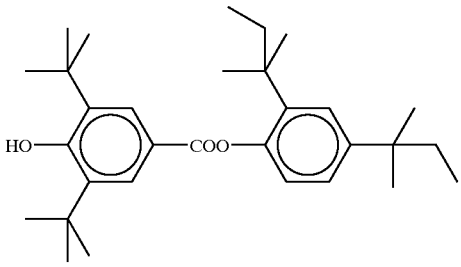

(I-30)

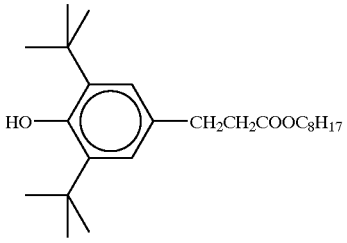

(I-31)

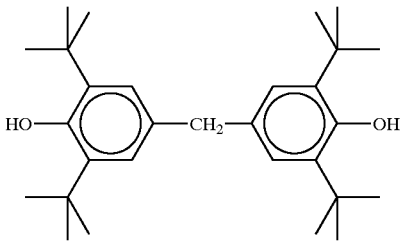

(I-32)

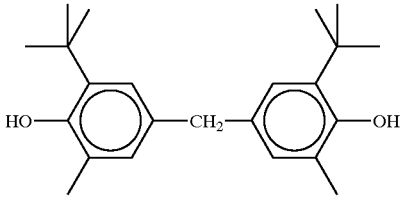

-continued (I-33)

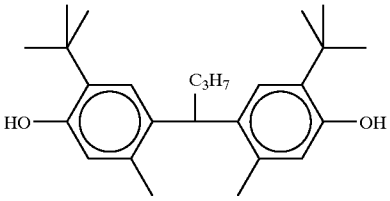

(I-34)

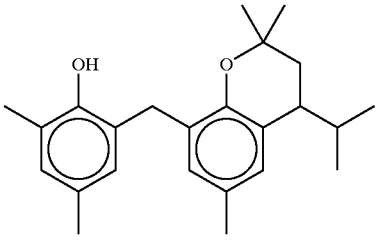

The reducing agent is preferably used in an amount of 0.1 to 3.0 g/m$^2$, particularly 0.2 to 1.5 g/m$^2$, especially 0.3 to 1.0 g/m$^2$. This amount corresponds to 5 to 50 mol %, particularly 8 to 30 mol %, especially 10 to 20 mol %, based on the silver on the image-forming layer side. The reducing agent is preferably incorporated into the image-forming layer.

The reducing agent is added to a coating composition by any method, for example, in the form of a solution (a solution method) or a dispersion (an emulsion method or a suspension method).

The emulsion method which is well known in the art includes a method comprising mechanically dispersing a reducing agent using an oil, such as dibutyl phthalate, tricresyl phosphate, glycerol triacetate or diethyl phthalate, and an auxiliary solvent, such as ethyl acetate or cyclohexanone.

The suspension method includes a method in which a particulate reducing agent is dispersed in an appropriate solvent such as water by means of a ball mill, a colloid mill, a vibration mill, a vibration ball mill, a sand mill, a jet mill or a roller mill or by ultrasonication to prepare a solid dispersion. In dispersing, a protective colloid (e.g., polyvinyl alcohol) or a surface active agent (such as an anionic surface active agent, e.g., sodium triisopropylnaphthalenesulfonate (a mixture of compounds having three isopropyl groups at different positions)) can be used. Where beads of zirconia, etc. are used as a grinding medium as is usual with the above-mentioned mills, zirconium, etc. dissolved from the beads may be incorporated into the dispersion usually in a concentration of 1 to 1000 ppm while varying according to dispersing conditions. Incorporation of up to 0.5 mg of zirconium per gram of silver into the light-sensitive material will be allowable in the practice.

Addition of an antiseptic, such as sodium benzoisothiazolinone, to the aqueous dispersion is advisable.

The heat-developable light-sensitive material preferably contains a development accelerator. Useful development accelerators include sulfonamidophenol compounds represented by formula (A) described in JP-A-12-267222 and JP-A-12-330234, hindered phenol compounds represented by formula (II) described in JP-A-13-92075, hydrazine compounds represented by formula (I) described in JP-A-10-62895 and JP-A-11-15116 and formula (1) described in JP-A-13-74278, and phenol or naphthol compounds represented by formula (2) described in JP-A-12-76240.

The development accelerator is used in an amount of 0.1 to 20 mol %, preferably 0.5 to 10 mol %, based on the reducing agent. The development accelerator can be incorporated into the light-sensitive material in the same manner as for the reducing agent. It is preferably incorporated in the form of a suspension or an emulsion. Where incorporated in emulsion form, it is preferably added as dispersed in a mixed medium of a high-boiling solvent that is solid at ambient temperature and a low-boiling auxiliary solvent or in the form of a so-called oilless emulsion prepared by using no high-boiling solvent.

Where a reducing agent having an aromatic hydroxyl group(s) (—OH), particularly the above-described bisphenol compound is used, it is preferable to use a non-reducing compound having a group capable of forming a hydrogen bond with the hydroxyl group(s) (hereinafter referred to as a hydrogen-bonding compound. The group capable of forming a hydrogen bond with a hydroxyl group or an amino group includes a phosphoryl group, a sulfoxide group, a sulfonyl group, a carbonyl group, an amide group, an ester group, a urethane group, a ureido group, tertiary amino groups, and nitrogen-containing aromatic groups. Preferred hydrogen-bonding compounds are those having a phosphoryl group, a sulfoxide group, an N-terminally blocked amido group (having no >N—H and blocked like >N—Ra), an N-terminally blocked urethane group (having no >N—H and blocked like >N—Ra), or an N-terminally blocked ureido group (having no >N—H and blocked like >N—Ra), wherein Ra is a substituent (≠H).

Particularly preferred hydrogen-bonding compounds are represented by formula (D):

(D)

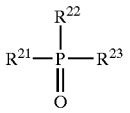

wherein $R^{21}$, $R^{22}$, and $R^{23}$ each represent an alkyl group, an aryl group, an alkoxy group, an aryloxy group, an amino group or a heterocyclic group, each of which may be substituted or unsubstituted.

Substituents of the substituted groups as $R^{21}$, $R^{22}$, and $R^{23}$ include a halogen atom, an alkyl group, an aryl group, an alkoxy group, an amino group, an acyl group, an acylamino group, an alkylthio group, an arylthio group, a sulfonamide group, an acyloxy group, a hydroxycarbonyl group, a carbamoyl group, a sulfamoyl group, a sulfonyl group, and a phosphoryl group. Preferred of them are an alkyl group and an aryl group, including methyl, ethyl, isopropyl, t-butyl, t-octyl, phenyl, 4-alkoxyphenyl, and 4-acyloxyphenyl groups.

The alkyl group as $R^{21}$, $R^{22}$, and $R^{23}$ includes methyl, ethyl, butyl, octyl, dodecyl, isopropyl, t-butyl, t-amyl, t-octyl, cyclohexyl, 1-methylcyclohexyl, benzyl, phenethyl, and 2-phenoxypropyl groups. The aryl group includes phenyl, cresyl, xylyl, naphthyl, 4-t-butylphenyl, 4-t-octylphenyl, 4-anisidyl, and 3,5-dichlorophenyl groups. The alkoxy group includes methoxy, ethoxy, butoxy, octyloxy, 2-ethylhexyloxy, 3,5,5-trimethylhexyloxy, dodecyloxy, cyclohexyloxy, 4-methylcyclohexyloxy, and benzyloxy groups. The aryloxy group includes phenoxy, cresyloxy, isopropylphenoxy, 4-t-butylphenoxy, naphthoxy, and biphenyloxy groups. The amino group includes dimethylamino, diethylamino, dibutylamino dioctylamino, N-methyl-N-hexylamino, dicyclohexylamino, diphenylamino, and N-methyl-N-phenylamino groups.

$R^{21}$, $R^{22}$, and $R^{23}$ each preferably represent an alkyl group, an aryl group, an alkoxy group or an aryloxy group. From the standpoint of effects of the present invention, it is preferred that at least one, particularly two or all, of $R^{21}$, $R^{22}$, and $R^{23}$ represent an alkyl group or an aryl group. From the standpoint of availability at low cost, compounds of formula (D) in which all of $R^{21}$, $R^{22}$, and $R^{23}$ are the same are preferred.

Specific but non-limiting examples of the hydrogen-bonding compounds which can be used in the invention including the compounds of formula (D) are listed below.

(II-1)

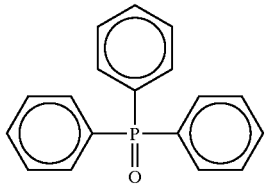

(II-2)

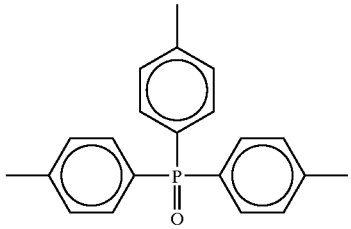

(II-3)

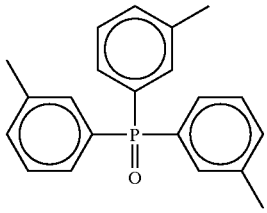

(II-4)

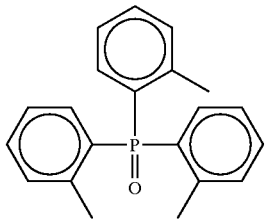

(II-5)

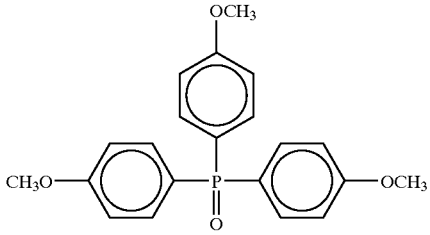

(II-6)

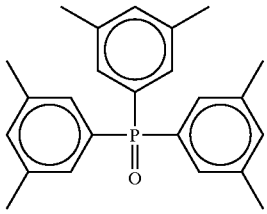

-continued (II-7)

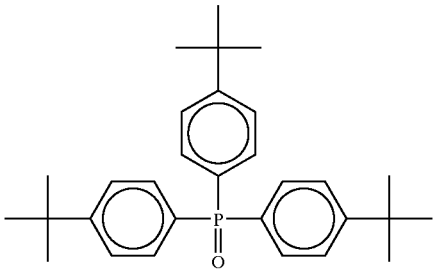

(II-8)

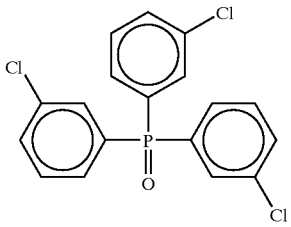

(II-9)

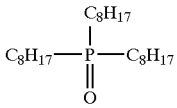

(II-10)

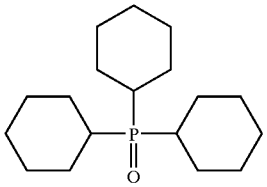

(II-11)

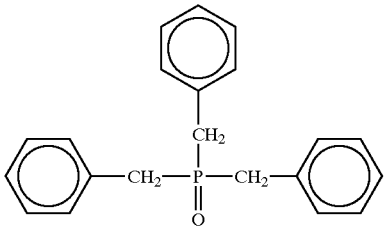

(II-12)

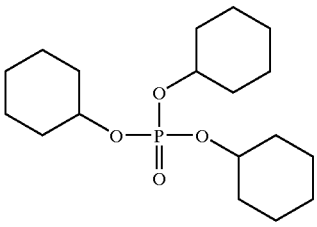

(II-13)

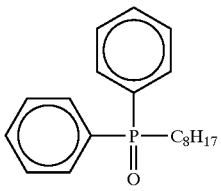

-continued (II-14)

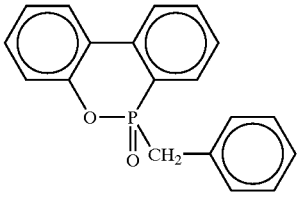

(II-15)

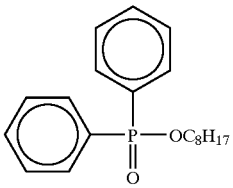

(II-16)

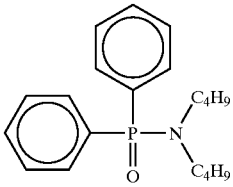

(II-17)

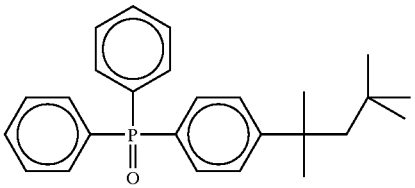

(II-18)

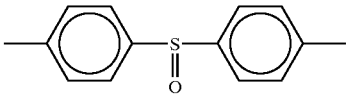

(II-19)

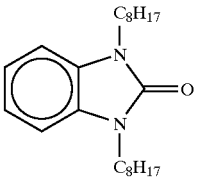

(II-20)

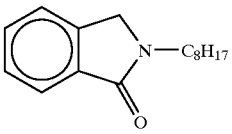

(II-21)

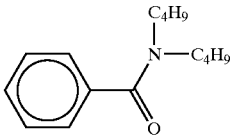

Additional examples of the hydrogen-bonding compounds are given in European Patent 1096310 and Japanese Patent Application Nos. 2000-270498 and 2001-124796.

The compound of formula (D) can be incorporated into the coating composition in the form of a solution, an emulsion or a suspension similarly to the reducing agent. The hydrogen-bonding compound used in the present invention forms a complex with a compound having a phenolic hydroxyl group or an amino group through hydrogen bonding in a solution. Some combinations of a reducing agent and a compound of formula (D) can provide a complex that can be isolated as crystals. Use of such isolated crystal grains in the form of a suspension is particularly favorable for obtaining stable performance. It is also favorable that a reducing agent and a compound of formula (D) are dry mixed and dispersed in a sand grinder mill, etc. with an appropriate dispersant to form a complex.

The compound of formula (D) is preferably used in an amount of 1 to 200 mol %, particularly 10 to 150 mol %, especially 20 to 100 mol %, based on the reducing agent.

Any polymeric binder can be used in the organic silver salt-containing layer. Suitable binders are transparent or semitransparent and generally colorless and include natural resins, synthetic polymers or copolymers, and other film-forming high-molecular weight compounds. Examples are gelatins, rubbers, polyvinyl alcohols, hydroxyethyl celluloses, cellulose acetates, cellulose acetate butyrates, polyvinylpyrrolidones, casein, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal and polyvinyl butyral), polyesters, polyurethanes, phenoxy resins, polyvinylidene chlorides, polyepoxides, polycarbonates, polyvinyl acetates, polyolefins, cellulose esters, and polyamides. The binder may be formed in film from a solution or an emulsion in water or an organic solvent.

It is preferred for the binder used in the organic silver salt-containing layer to have a glass transition temperature (Tg) of 10 to 80° C., particularly 15 to 70° C., especially 20 to 65° C. The Tg of a polymeric binder comprising one to n monomer(s) was calculated according to equation: $1/Tg=\Sigma(X_i/Tg_i)$, wherein $X_i$ is a weight fraction of the i'th monomer ($\Sigma X_i=1$); and $Tg_i$ is the glass transition temperature (absolute temperature) of a homopolymer of the i'th monomer; provided that Σ is the sum of from i=1 to i=n. With respect to the Tg of a homopolymer of each monomer ($Tg_i$), data given in J. Brandrup and E. H. Immergut, Polymer Handbook (3rd ed.), Wiley-Interscience (1989) were adopted.

Two or more binders may be used if necessary. A binder having a Tg of 20° C. or higher and a binder having a Tg lower than 20° C. may be used in combination. In using two or more binders having different Tg's, it is preferred that the weight average Tg be in the above-specified range.

The organic silver salt-containing layer is preferably formed by applying a coating composition containing water in a proportion of at least 30% by weight based on the total solvent and drying the coating film. In this preferred case, it, is desirable for obtaining improved performance to use an aqueous solvent (water)-soluble or dispersible binder, particularly a binder comprising a latex of a polymer having an equilibrium moisture content of 2% by weight or less at 25° C. and 60% RH. In the most desirable embodiment, the polymer latex be prepared so as to have an ion conductivity of 2.5 mS/cm or less. Such a polymer latex can be prepared by, for example, purifying a synthesized polymer by a separation membrane.

The aqueous solvent in which the polymer is soluble or dispersible includes water and a mixed solvent of water and not more than 70% by weight of a water-miscible organic solvent. The water-miscible organic solvent includes alcohols, such as methyl alcohol, ethyl alcohol, and propyl alcohol; cellosolve solvents, such as methyl cellosolve, ethyl cellosolve, and butyl cellosolve; ethyl acetate, and dimethylformamide. Here, the term "aqueous solvent" applies even to a system in which the polymer is not dissolved thermodynamically but held in a dispersed state.

The term "equilibrium moisture content at 25° C. and 60% RH" as used herein is defined by formula: $[(W_1-W_0)/W_0]\times100$ (wt %), wherein $W_1$ is the weight of a polymer equilibrated in an atmosphere of 25° C. and 60% RH, and $W_0$ is the weight of that polymer in an absolutely dried condition at 25° C. With regard to the definition of moisture content and method of measurement, reference can be made to it, e.g., in *Kobunshi Kogaku Koza* 14, *Hobunshi Zairyo Shikenho*, edited by The Society of Polymer Science Japan, Chizin Shokan.

The binder polymers which can be used in the present invention preferably have an equilibrium moisture content (25° C., 60% RH) of 2% by weight or less, particularly 0.01 to 1.5% by weight, especially 0.02 to 1% by weight.

It is particularly preferred to use an aqueous solvent-dispersible polymer as a binder. Conceivable disperse systems include a latex comprising fine particles of a water-insoluble and hydrophobic polymer and a system having polymer molecules dispersed in a molecular state or in the form of micelle. A latex is preferred.

The average particle size of the dispersed particles ranges 1 to 50,000 nm, preferably 5 to 1000 nm, still preferably 10 to 500 nm, particularly preferably 50 to 200 nm. The polymer particles may be monodispersed or polydispersed. It is a preferred manipulation to use two or more dispersions having different monodisperse particle size distributions to obtain controlled physical properties of the coating composition.

Preferred aqueous solvent-dispersible polymers include hydrophobic polymers, such as acrylic polymers, polyesters, rubbers (e.g., SBR resins), polyurethanes, polyvinyl chlorides, polyvinyl acetates, polyvinylidene chlorides, and polyolefins, which may be straight-chain or branched polymers or crosslinked polymers and may be homopolymers or copolymers including random copolymers and block copolymers. These polymers usually have a number average molecular weight of 5,000 to 1,000,000, preferably 10,000 to 200,000. Those having too small a molecular weight result in insufficient mechanical strength of the emulsion layer. Those with too large a molecular weight have poor film-forming properties. Crosslinkable polymer latices are particularly suitable.

Specific but non-limiting examples of preferred polymer latices for use in the invention are listed below. In the following list, the polymer latices are represented by their constituent monomers. The values in the parentheses immediately following monomers (abbreviated) are weight percents. The molecular weights are number average ones (Mn). Because polymers comprising a polyfunctional monomer form a crosslinked structure to which the concept of molecular weight is unapplicable, they are described only as being "crosslinking" instead of the molecular weight. "Tg" is a glass transition temperature. Abbreviations have the following meanings.

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene VC: vinyl chloride
AN: acrylonitrile
VDC: vinylidene chloride
Et: ethylene
IA: itaconic acid
P-1: MMA(70)/EA(27)/MAA(3) (Mn: 37,000; Tg: 61° C.)
P-2: MMA(70)/2EHA(20)/St(5)-AA(5) (Mn: 40,000; Tg: 59° C.)
P-3: St(50)/Bu(47)/MAA(3) (crosslinking; Tg: 17° C.)
P-4: St(68)/Bu(29)/AA(3) (crosslinking; Tg: 17° C.)
P-5: St(71)/Bu(26)/AA(3) (crosslinking; Tg: 24° C.)
P-6: St(70)/Bu(27)/IA(3) (crosslinking)
P-7: St(75)/Bu(24)/AA(1) (crosslinking; Tg: 29°)
P-8: St(60)/Bu(35)/DVB(3)/MAA(2) (crosslinking)
P-9: St(70)/Bu(25)/DVB(2)/AA(3) (crosslinking)
P-10: VC(50)/MAA(20)/EA(20)/AN(5)/AA(5) (Mn: 80,000)
P-11: VDC(85)/MMA(5)/EA(5)/MAA(5) (mn: 67,000)
P-12: Et(90)/MAA(10) (Mn: 12,000)
P-13: St(70)/2EHA(27)/AA(3) (Mn: 130,000; Tg: 43° C.)
P-14: MMA(63)/EA(35)/AA(2) (Mn: 33,000; Tg: 47° C.)
P-15: St(70.5)/Bu(26.5)/AA(3) (crosslinking; Tg: 23° C.)
P-16: St(69.5)/Bu(27.5)/AA(3) (crosslinking: Tg: 20.5° C.)

The above-listed polymer latices are commercially available. Commercially available polymer latices include those of acrylic polymers such as Cevian A series (4635, 4718, and 4601) from Daicel Polymer, Ltd. and Nipol Lx series (811, 814, 821, 820, and 857) from Zeon Corp.; those of polyesters such as Finetex ES series (650, 611, 675, and 850) from Dainippon Ink & Chemicals; Inc. and WD-size and WMS from Eastman Chemical Co.; those of polyurethanes such as Hydran AP series (10, 20, 30, and 40) from Dainippon Ink & Chemicals, Inc.; those of rubbers such as Lacstar series (7310K, 3307B, 4700H, and 7132C) from Dainippon Ink & Chemicals, Inc. and Nipol Lx series (416, 410, 438C, and 2507) from Zeon Corp.; those of polyvinyl chlorides such as G351 and G576 from Zeon Corp.; those of polyvinylidene chloride such as L502 and L513 from Asahi Chemical Industry Co., Ltd.; and those of polyolefins such as Chemipearl series (S120 and SA100) from Mitsui Chemicals, Inc.

The above-described polymer latices can be used either individually or as a mixture of two or more thereof.

Particularly preferred polymer latices are styrene-butadiene copolymer latices. A preferred styrene to butadiene weight ratio is 40:60 to 95:5. The styrene monomer units and the butadiene monomer units preferably form a total weight proportion of 60 to 99% in the copolymer. The styrene-butadiene copolymer latices preferably contain 1 to 6% by weight, particularly 2 to 5% by weight, of acrylic acid or methacrylic acid monomer units, particularly acrylic acid units, based on the total of styrene and butadiene monomer units.

The styrene-butadiene copolymer latices that are fit for use in the invention include P-3 to P-8 and P-15 in the above list and commercially available ones such as Lacstar 3307B and 7132C and Nipol Lx 416. The styrene-butadiene copolymer latices preferably have a Tg of 10 to 30° C., particularly 17 to 25° C.

If necessary, the organic silver salt-containing layer may contain hydrophilic polymers, such as gelatin, polyvinyl alcohol, methyl cellulose, hydroxypropyl cellulose, and carboxymethyl cellulose, in a proportion of not more than 30% by weight, preferably not more than 20% by weight, based on the total binder of the layer.

The organic silver salt-containing layer (i.e., the image-forming layer) is preferably formed by using the polymer latex as a binder. The weight ratio of the total binder of the layer to the organic silver salt is preferably 1/10 to 10/1, still preferably 1/3 to 5/1, particularly preferably 1/1 to 3/1.

Usually the organic silver salt-containing layer (image-forming layer) is also a light-sensitive layer (Em layer) containing the light-sensitive silver halide. In this case, the weight ratio of the total binder of the layer to the silver halide is preferably 5 to 400, still preferably 10 to 200.

The image-forming layer preferably has a total binder content of 0.2 to 30 g/m$^2$, particularly 1 to 15 g/m$^2$, especially 2 to 10 g/m$^2$. The image-forming layer can contain a crosslinking agent for polymer crosslinking, a surface active agent for improving coating properties, and so forth.

As previously stated, the solvent (inclusive of a dispersing medium) of the coating composition containing the organic silver salt is preferably an aqueous solvent containing water in a proportion of at least 30% by weight, particularly 50% by weight or more, especially 70% by weight or more, based on the total solvent. Solvents other than water are selected arbitrarily from water-miscible organic solvents such as methyl alcohol, ethyl alcohol, isopropyl alcohol, methyl cellosolve, ethyl cellosolve, dimethylformamide, and ethyl acetate. Preferred solvent compositions (the ratios are given by weight) include water, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5.

Antifoggants, stabilizers or stabilizer precursors which can be used in the present invention include those described in JP-A-10-62899 (para. No. 0070), EP 0803764A1 (page 20, line 57 to page 21, line 7), JP-A-9-281637, JP-A-9-329864, U.S. Pat. No. 6,083,681, and European Patent 1048975.

Organic halogen compounds are preferred antifoggants in the invention. Those described in JP-A-11-65021, para. Nos. 0111 to 0112 are useful. The organic halogen compounds represented by formula (P) described in JP-A-12-284399, the organic polyhalogen compounds represented by formula (II) described in JP-A-10-339934, and the organic polyhalogen compounds described in JP-A-13-31644 and JP-A-13-33911 are particularly preferred.

The polyhalogen compounds which are preferably used in the invention are represented by formula (H):

$$Q—(Y)_n—C(Z_1)(Z_2)X \quad (H)$$

wherein Q represents an alkyl group, an aryl group or a heterocyclic group; Y represents a divalent linking group; n represents 0 or 1; $Z_1$ and $Z_2$ each represent a halogen atom; and X represents a hydrogen atom or an electron-attracting group.

In formula (H) Q preferably represents a phenyl group substituted with an electron-attracting group having a positive Hammet's substituent constant σp. *Journal of Medicinal Chemistry*, vol. 16, No. 11, pp. 1207–1216 (1973) can be referred to as for Hammet's substituent constants. Examples of such electron-attracting groups are halogen atoms (e.g., fluorine (σp: 0.06), chlorine (σp: 0.23), and iodine (σp: 0.18)), trihalomethyl groups (e.g., tribromomethyl (σp: 0.29), trichloromethyl (σp: 0.33), and trifluoromethyl (σp: 0.54)), a cyano group (σp: 0.66), a nitro group (σp: 0.78), aliphatic aryl or heterocyclic sulfonyl groups (e.g., methanesulfonyl (σp: 0.72)), aliphatic aryl or heterocyclic acyl groups (e.g., acetyl (σp: 0.50) and benzoyl (σp: 0.43)), alkynyl groups (e.g., ethynyl (σp: 0.23)), aliphatic aryl or heterocyclic oxycarbonyl groups (e.g., methoxycarbonyl (σp: 0.45) and phenoxycarbonyl (σp: 0.44)), a carbamoyl group (σp: 0.36), a sulfamoyl group (σp: 0.57), a sulfoxide group, heterocyclic groups, and phosphoryl groups. Groups (and atoms) having a σp in a range of from 0.2 to 2.0, particularly from 0.4 to 1.0, are preferred. Particularly preferred electron-attracting groups are a carbamoyl group, an alkoxycarbonyl group, an alkylsulfonyl group, and an alkylphosphoryl group, with a carbamoyl group being especially preferred.

X preferably represents an electron-attracting group, particularly a halogen atom, an aliphatic aryl or heterocyclic sulfonyl group, an aliphatic aryl or heterocyclic acyl group, an aliphatic or heterocyclic oxycarbonyl group, a carbamoyl group or a sulfamoyl group, with a halogen atom being especially preferred. Of halogen atoms preferred are chlorine, bromine, and iodine. Chlorine and bromine are still preferred. Bromine is particularly preferred.

Y is preferably —C(=O)—, —SO— or —$SO_2$—, still preferably —C(=O)— or —$SO_2$—, particularly preferably —$SO_2$—.

n is preferably 1.

Specific examples of the compounds represented by formula (H) are shown below.

(III-1)

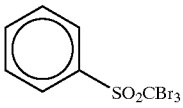

(III-2)

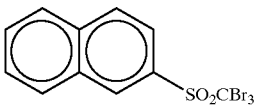

(III-3)

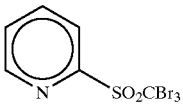

(III-4)

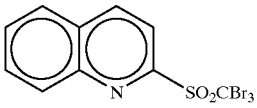

(III-5)

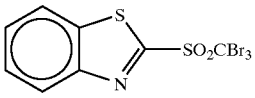

(III-6)

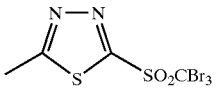

-continued (III-7)

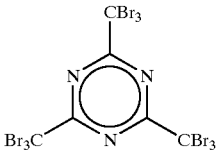

(III-8)

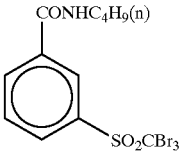

(III-9)

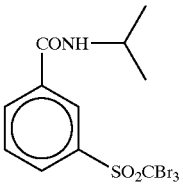

(III-10)

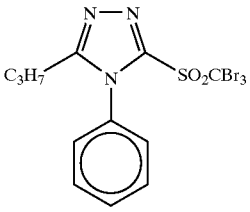

(III-11)

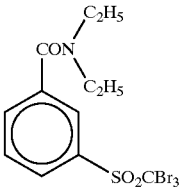

(III-12)

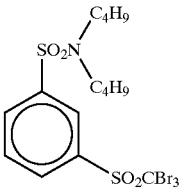

(III-13)

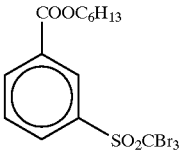

(III-14)

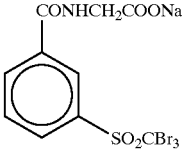

(III-15)

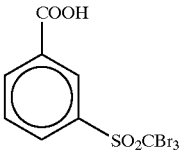

-continued (III-16)

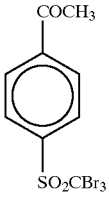

(III-17)

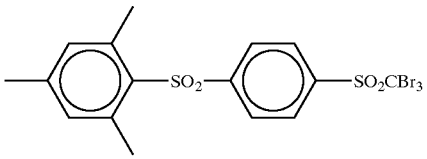

(III-18)

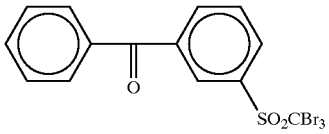

(III-19)

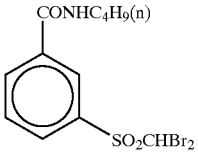

(III-20)

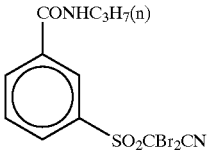

(III-21)

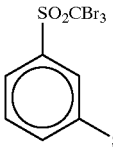

(III-22)

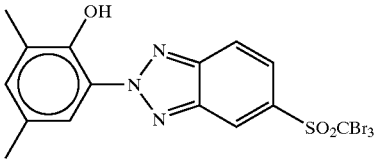

(III-23)

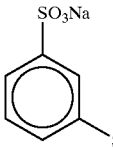

(III-24)

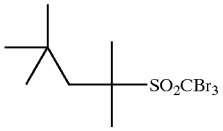

The organic polyhalogen compound of formula (H) is preferably used in an amount of $1\times10^{-4}$ to 0.5 mol, particularly $1\times10^{-3}$ to 0.1 mol, especially $5\times10^{-3}$ to 0.05 mol, per mol of light-insensitive silver salt of the image-forming layer. The antifoggant can be incorporated into the light-sensitive material in the same manner as described with respect to the reducing agent. The suspension method is the preference to adopt.

Other useful antifoggants include the silver (II) salts and the benzoic acid derivatives described in JP-A-11-65021 (para. No. 0113 and 0114, respectively), the salicylic acid derivatives of JP-A-12-206642, the formalin scavenger compounds represented by formula (S) described in JP-A-12-221634, the triazine compounds claimed in claim 9 of JP-A-11-352624, the compounds represented by formula (III) described in JP-A-6-11791, and 4-hydroxy-6-methyl-1,3,3a,7-tetraazaindene.

The light-sensitive material of the invention can contain an azolium salt for fog restraint. Useful azolium salts include the compounds represented by formula (XI) described in JP-A-59-193447, the compounds of JP-B-55-12581, and the compounds represented by formula (II) described in JP-A-60-153039. The azolium salt can be added to any part of the light-sensitive material but is preferably added to a layer on the light-sensitive layer side, particularly the organic silver salt-containing layer.

The azolium salt can be added at any stage of preparing a coating composition. Where added to the organic silver salt-containing layer, it may be added at any stage of from the preparation of the organic silver salt to the preparation of the coating composition but is preferably added after the organic silver salt preparation and by the time of application. The azolium can be added in any form, such as powder, solution or fine dispersion. It may be added in the form of a solution mixed with other additives such as a sensitizing dye, a reducing agent, and a toning agent.

The azolium salt can be added in any amount. A recommended amount is $1\times10^{-6}$ to 2 mol, particularly $1\times10^{-3}$ to 0.5 mol, per mole of silver.

The light-sensitive material can contain a mercapto compound, a disulfide compound or a thione compound for the purpose of suppressing or accelerating development, increasing spectral sensitization efficiency or improving preservability before and after development. Compounds fit for these purposes include those described in JP-A-10-62899, para. Nos. 0067–0069, the compounds represented by formula (I) described in JP-A-10-186572 (examples are given in para. Nos. 0033 to 0052), and EP 0803764A1 (p. 20, ll. 36–56). In particular, mercapto-substituted aromatic heterocyclic compounds described in JP-A-9-297367, JP-A-9-304875, and JP-A-13-100358 are preferred.

Toning agents are preferably used in the heat-developing light-sensitive material of the invention. Useful toning agents are described in JP-A-10-62899 (para. 0054–0055), EP 0803764A1 (p. 21, ll. 23–48), JP-A-12-356317, and Japanese Patent Application No. 2000-187298. Preferred toning agents include phthalazinones, i.e., phthalazinone and its derivatives or metal salts, such as 4-(1-naphthyl) phthalazinone, 6-chlorophthalazinone, 5,7-dimethoxyphthalazinone, and 2,3-dihydro-1,4-phthalazinone; combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines, i.e., phthalazine and its derivatives or metal salts, such as 4-(1-naphthyl)phthalazine, 6-isopropylphthalazine, 6-t-butylphthalazine, 6-chlorophthalazine, 5,7-dimethoxyphthalazine, and 2,3-dihydrophthalazine; and combinations of phthalazines and phthalic acids. Combinations of phthalazines and phthalic acids are still preferred. A combination of 6-isopropylphthalazine and phthalic acid or 4-methylphthalic acid is particularly preferred.

Plasticizers and lubricants that can be used in the light-sensitive layer are described in JP-A-11-65921, para. No. 0117. Superhigh contrast agents for forming superhigh contrast image and methods of adding the agents are described in JP-A-11-65921 (para. No. 0118), JP-A-11-223898 (para. Nos. 0136–0193), JP-A-12-284399 (compounds represented by formulae (H), (1), (2), (3), (A), and (B)), and Japanese Patent Application No. H11-91652 (compounds represented by formulae (III) through (V), typified by formula Nos. 21 to 24). Useful contrast accelerators are described in JP-A-11-65021 (para. No. 0102) and JP-A-11-223898 (para. Nos. 0194–0195).

Where forming acid or a formic acid salt is used as a powerful fogging agent, it is preferably added to the side of the light-sensitive silver halide-containing image-forming layer in an amount not more than 5 mmol, particularly not more than 1 mmol, per mol of silver.

Where a superhigh contrast agent is used, it is preferably used in combination with an acid formed as a result of hydration of diphosphorus pentoxide or a salt of the acid. Acids formed by hydration of diphosphorus pentoxide (and salts thereof) include metaphosphoric acid (salts), pyrophosphoric acid (salts), orthophosphoric acid (salts), triphosphoric acid (salts), tetraphosphoric acid (salts), and hexametaphosphoric acid (salts), with orthophosphoric acid (salts) and hexametaphosphoric acid (salts) being preferred. Salts of orthophosphoric acid or hexametaphosphoric acid include sodium orthophosphate, sodium dihydrogenorthophosphate, sodium hexametaphosphate, and ammonium hexametaphosphate. The amount of the phosphoric acid (or salt) to be added is selected as desired according to such performance as sensitivity and fog, preferably ranging from 0.1 to 500 mg, particularly 0.5 to 100 mg, per $m^2$ of the light-sensitive material.

The heat-developable light-sensitive material can have a surface protective layer, either single- or multi-layered, to protect the image-forming layer against adhesion. For the details, JP-A-11-65021 (para. No. 0119–0120) and Japanese Patent Application No. 2000-171936 can be referred to.

Gelatin is preferably used as a binder of the surface protective layer. It is also preferred to use polyvinyl alcohols (PVAs) in place of, or in addition to, gelatin. Useful gelatins include inert gelatin (e.g., Nitta Gelatin 750 available from Nitta Gelatin, Inc.) and phthalated gelatin (e.g., Nitta Gelatin 801 from Nitta Gelatin, Inc.).

Useful PVAs are described in JP-A-12-171936 (para. No. 0009–0020) and include fully saponified PVAs (e.g., PVA-105), partially saponified PVAs (e.g., PVA-335), and modified PVAs (e.g., MP-203), the products in the parentheses all supplied by Kuraray Co., Ltd. PVA is preferably applied in an amount of 0.3 to 4.0 $g/m^2$, particularly 0.3 to 2.0 $g/m^2$.

In printing applications where dimensional stability is of great concern, it is preferred for the heat-developable light-sensitive material of the invention to contain a polymer latex in the surface protective layer or a back layer. Polymer latex technology for this use is taught in T. Okuda, et al. (ed.), *GOSEJ JUSHI EMULSION*, Kobunshikankokai (1978), T. Sugimura, et al. (ed.), *GOSEI LATEX NO OHYO*, Kobunshikankokai (1993), and S. Muroi, *GOSEI LATEX NO KAGAKU* Kobunshikankokai (1970). Useful polymer latices include a methyl methacrylate/ethyl acrylate/methacrylic acid (33.5/50/16.5; the ratio given by weight, hereinafter the same) copolymer latex, a methyl methacrylate/butadiene/itaconic acid (47.5/47.5/5) copolymer latex, an ethyl acrylate/methacrylic acid copolymer latex, a methyl methacrlate/2-ethylhexyl acrylate/styrene/2-hydroxyethyl methacrylate/acrylic acid (58.9/25.4/8.6/5.1/2.0) copolymer latex, and a methyl methacrylate/styrene/butyl acrylate/2-hydroxyethyl methacrylate/acrylic acid (64.0/9.0/20.0/5.0/2.0) copolymer latex.

The polymer latex combinations described in Japanese Patent Application No. H11-6872 and the techniques described in Japanese Patent Application Nos. H11-143058 (paras. 0021–0025), H11-6872 (paras. 0027–0028), and H10-199626 (paras. 0023–0041) are also applicable to the binder of the surface protective layer.

The surface protective layer preferably contains the polymer latex in a proportion of 10 to 90% by weight, particularly 20 to 80% by weight, based on the total binder of the layer. A suitable coating weight of the total binder (inclusive of water-soluble polymers and latex polymers) in the surface protective layer is 0.3 to 5.0 $g/m^2$, particularly 0.3 to 2.0 $g/m^2$.

The temperature of the system for preparing the image-forming layer coating composition is preferably kept at 30 to 65° C., still preferably 35° C. or higher and lower than 60° C., particularly preferably 35 to 55° C. After the polymer latex is added, the image-forming layer coating composition is preferably maintained at 30 to 65° C.

The image-forming layer provided on a support has a single- or multi-layer structure. A single-layered image-forming layer comprises the above-described organic silver salt, light-sensitive silver halide, reducing agent, and binder and possibly additional additives such as a toning agent, a coating aid, and other assistants. Where the image-forming layer has a multi-layered structure, a first image-forming layer, usually the layer adjacent to the support, contains the organic silver salt and the light-sensitive silver halide. Some other components are incorporated into a second layer or both the first and the second layers.

Where the heat-developable light-sensitive material has multicolor sensitivity, the image-forming layer may have the above-described multi-layer structure for each color, or a single image-forming layer can contain all the components as taught in U.S. Pat. No. 4,708,928. In the case of multi-dye multi-color sensitive heat-developable materials, light-sensitive layers are separated by a functional or non-functional barrier layer as taught in U.S. Pat. No. 4,460,681.

The light-sensitive layer can contain various dyes and pigments (e.g., C.I. Pigment Blue 60, C.I. Pigment Blue 64, and C.I. Pigment Blue 15:6) for tone improvement and prevention of interference fringe and irradiation phenomena on laser exposure. For the details, refer to WO98/36322, JP-A-10-268465, and JP-A-11-338098.

The heat-developable light-sensitive material of the invention preferably has an anti-halation layer farther from a light source than the light-sensitive layer.

The heat-developable light-sensitive material generally has a light-insensitive layer in addition to the light-sensitive layer. The light-insensitive layer includes (1) a protective layer which is provided farther from the support than the light-sensitive layer, (2) an intermediate layer provided between adjacent light-sensitive layers (when there are two or more light-sensitive layers) or between the light-sensitive layer and the protective layer, (3) a subbing layer provided between the light-sensitive layer and the support, and (4) a back layer provided on the back side of the support (opposite to the light-sensitive layer). A filter layer is provided as the layer (1) or (2), and an antihalation layer is provided as the layer (3) or (4).

With regard to the antihalation layer, reference can be made to it in JP-A-11-65021 (para. Nos. 0123–0124), JP-A-11-223898, JP-A-9-230531, JP-A-10-36695, JP-A-10-104779, JP-A-11-231457, JP-A-11-352625, and JP-A-11-

352626. The antihalation layer comprises an antihalation dye having an absorption in the exposure wavelength region. Seeing that the laser used in the present invention has a peak wavelength between 350 nm and 440 nm, dyes showing an absorption in this range are used preferably.

Where an antihalation dye having an absorption in the visible region is used, it is desirable for the dye to leave substantially no color after image formation. To this end, some means for thermal decoloration by the heat of heat development is preferably taken. It is an effective manipulation to add a thermally decolorable dye and a base precursor to a light-insensitive layer to make the layer function as an antihalation layer. Details of this technique are described in JP-A-11-231457.

The amount of the thermally decolorable dye depends on the use of the dye. In general, the decolorable dye is used in such an amount as to give an optical density (absorbance) higher than 0.1, preferably 0.15 to 2, still preferably 0.2 to 1, as measured at a wavelength used for exposure. This amount would correspond to about 0.001 to 1 g/m$^2$. Upon being heat treated, the thermally decolorable dye reduces its optical density to 0.1 or lower. Two or more decolorable dyes may be used in combination, in which cases two or more base precursors may be used in combination, too.

In such a thermal decoloration system using the decolorable dye and the base precursor, thermal decoloration will be ensured by using a substance which, when mixed with a base precursor, drops the melting point of the base precursor by 3° C. or more, such as diphenylsulfone, 4-chlorophenyl (phenyl)sulfone or 2-naphthyl benzoate, as suggested by JP-A-11-352626.

The heat-developable light-sensitive material of the invention can contain a colorant having an absorption maximum in a wavelength between 300 nm and 450 nm for the purpose of improving a silver color tone and suppressing image quality deterioration with time. Colorants usable for these purposes are described in JP-A-62-210458, JP-A-63-104046, JP-A-63-103235, JP-A-63-208846, JP-A-63-306436, JP-A-63-314535, JP-A-1-61745, and JP-A-13-100363. Such a colorant is added in an amount usually of 0.1 to 1 g/m$^2$. It is preferably incorporated into the back layer that is provided on the support opposite to the light-sensitive layer.

The heat-developable light-sensitive material used in the invention is preferably a single-sided, as it is called, light-sensitive material which has at least one light-sensitive layer containing light-sensitive silver halide emulsion on one side of the support and a back layer on the other side.

The light-sensitive material preferably contains a matting agent for good transportability in an image-forming apparatus. Matting agents fit for use in the present invention are described in JP-A-11-65021, para. Nos. 0126–0127. An advisable amount of the matting agent is 1 to 400 mg/m$^2$, particularly 5 to 300 mg/m$^2$.

The matting agent particles can have regular or irregular shapes, preferably regular shapes. Spherical shapes are preferred. The average particle size preferably ranges from 0.5 to 10 $\mu$m, particularly 1.0 to 8.0 $\mu$m, especially 2.0 to 6.0 $\mu$m. The coefficient of variation of particle size distribution is preferably 50% or less, still preferably 40% or less, particularly preferably 30% or less, the "coefficient of variation" being defined to be a standard deviation of particle size divided by a mean particle size and multiplied by 100. A combined use of two matting agents having small coefficients of variation and an average particle size ratio of 3 or greater is a preferred embodiment.

The degree of matting on the emulsion layer side is not particularly limited as far as a star dust defect does not occur. A preferred Bekk smoothness of the emulsion layer side is 30 to 2,000 seconds, particularly 40 to 1500 seconds, and that of the back layer is 10 to 1200 seconds, particularly 20 to 800 seconds, especially 40 to 500 seconds. A Bekk smoothness is easily determined according to JIS P-8119 (paper and board—determination of smoothness by Bekk method) or TAPPI T479.

The matting agent is preferably added to the outermost surface layer or a layer functioning as an outermost surface layer or a layer near the outer surface of the light-sensitive material. It is preferably added to a layer functioning as a protective layer.

With regard to the back layer which can be used in the invention, reference can be made to it in JP-A-11-65021, para. Nos. 0128–0130.

The heat-developable light-sensitive material preferably has a film surface pH of 7.0 or less, particularly 6.6 or less, before heat development. While not limiting, the lower limit of the film surface pH is about 3. An especially preferred film surface pH is in a range 4 to 6.2. For lowering the film surface pH, film surface pH adjustment is preferably effected with nonvolatile acids including organic acids (e.g., phthalic acid derivatives) and sulfuric acid or volatile bases such as ammonia. Ammonia is particularly preferred for achieving a low film surface pH because it is easily removable by volatilization before application of coating compositions or heat development. A combined use of a nonvolatile base, such as sodium hydroxide, potassium hydroxide or lithium hydroxide, and ammonia is also preferred. A film surface pH is determined by the method described in JP-A-12-284399, para. No. 0123.

The light-sensitive layer, the protective layer, the back layer, etc. can each contain a hardening agent. Hardening techniques are described in T. H. James, *The Theory of the Photographic Process* (4th ed.), p. 77–87, Macmillan Publishing Co., Inc. (1977). Suitable hardening agents include chrome alum, sodium 2,4-dichloro-6-hydroxy-s-triazine, N,N-ethylenebis(vinylsulfonacetamide), N,N-propylenebis (vinylsulfonacetamide), polyvalent metal ions described in ibid, p. 78, polyisocyanates described in U.S. Pat. No. 4,281,060 and JP-A-6-208193, epoxy compounds described in U.S. Pat. No. 4,791,042, and vinylsulfone compounds described in JP-A-62-89048.

The hardening agent is added in the form of a solution. A hardening agent solution is added to a coating composition from 3 hours to immediately before application, preferably from 2 hours to 10 seconds before application. Mixing methods and conditions are not limited as are consistent with the effects of the present invention. For example, the methods previously described with respect to mixing the light-sensitive silver halide emulsion into a coating composition are useful.

With regard to other additives and techniques applicable to the present invention, reference can be made in JP-A-11-65021, para. No. 0132 as for surface active agents, para. No. 0133 as for solvents, para. No. 0134 as for supports, para. No. 0135 as for static prevention or a conductive layer, and para. No. 0136 as for method of obtaining a color image. JP-A-11-84573, para. Nos. 0061 to 0064 and Japanese Patent Application No. 11-106881, para. Nos. 0049 to 0062 can be referred to as for slip agents.

The heat-developable light-sensitive material preferably has a conductive layer containing a metal oxide as a conducting material. A metal oxide having an oxygen defect or a hetero metal atom introduced therein to have enhanced conductivity is preferably used. Suitable metal oxides include ZnO, $TiO_2$, and $SnO_2$. ZnO is preferably doped with Al or In. $SnO_2$ is preferably doped with Sb, Nb, P, a halogen element, etc. $TiO_2$ is preferably doped with Nb, Ta, etc. $SnO_2$ doped with Sb is particularly preferred.

The dopant hetero atom is preferably added in an amount of 0.01 to 30 mol %, particularly 0.1 to 10 mol %. The metal oxide particles can be of any shape including spheres, needles, and plates. From the standpoint of imparting conductivity, needle-like particles with an aspect ratio of 2.0 or more, particularly 3.0 to 50, are preferred.

The metal oxide is preferably used in an amount of 1 to 1000 mg/m$^2$, particularly 10 to 500 mg/m$^2$, especially 20 to 200 mg/m$^2$. The conductive layer can be provided on either side of the light-sensitive material, preferably between the support and the back layer. Specific examples of the conductive layer are recited in JP-A-7-295146 and JP-A-11-223901.

A fluorine-containing surface active agent (hereinafter referred to as "fluorosurfactant") is preferably used in the invention. Examples of suitable fluorosurfactants are described in JP-A-10-197985, JP-A-12-19680, and JP-A-12-214554. The polymeric fluorosurfactants described in JP-A-9-281636 are also preferred. The fluorosurfactants described in Japanese Patent Application No. 2000-206560 are particularly preferred.

Transparent supports which are preferably used in the present invention include polyesters, particularly polyethylene terephthalate, having been subjected to heat treatment at 130 to 185° C. so as to relax residual internal strain after biaxial stretching and to prevent thermal shrinkage strain from occurring in heat development. For diagnostic applications, the transparent support may be either colorless or tinged with a blue dye (e.g., dye-1 used in Example of JP-A-8-240877).

A subbing layer is preferably provided on the support. The subbing layer can be of a water-soluble polyester of JP-A-11-84574, a styrene-butadiene copolymer of JP-A-10-186565, or a vinylidene chloride copolymer of JP-A-12-39684 and Japanese Patent Application No. 11-106881 (para. No. 0063–0080). With respect to an antistatic layer or the subbing layer, reference can be made in JP-A-56-143430, JP-A-56-143431, JP-A-58-62646, JP-A-56-120519, JP-A-11-84573 (para. Nos. 0040–0051), U.S. Pat. No. 5,575,957, and JP-A-11-223898 (para. Nos. 0078–0084).

The heat-developable light-sensitive material is preferably of monosheet type, which forms an image on itself without using another sheet such as an image-receiving sheet.

The heat-developable light-sensitive material can contain antioxidants, stabilizers, plasticizers, ultraviolet absorbers, or coating aids. Such additives are added to either the light-sensitive layer or the light-insensitive layer. Reference can be made to it in WO98/36322, EP 803764A1, JP-A-10-186567, and JP-A-10-186568.

The heat-developable light-sensitive material is produced by any coating techniques including extrusion coating, slide coating, curtain coating, dip coating, knife coating, flow coating, and extrusion coating using a hopper of the type disclosed in U.S. Pat. No. 2,681,294. Extrusion coating and slide coating techniques described in Stephen F. Kistler and Petert M. Schweizer, *Liquid Film Coating*, pp. 399–536, Chapman & Hall (1997) are preferred. A slide coating technique is particularly preferred. An example of slide coater configurations used in slide coating is illustrated in ibid, p. 427, FIG. 11b.1. If desired, two or more layers can be formed by simultaneous coating according to the methods taught in ibid, pp.399–536, U.S. Pat. No. 2,761,791, and British Patent 837,095.

The organic silver salt-containing coating composition is preferably a thixotropic fluid. As to this technique JP-A-11-52509 can be referred to. The organic silver salt-containing coating composition preferably has a viscosity of 400 to 100,000 mPa·s, particularly 500 to 20,000 mPa·s, at a shear rate of 0.1 s$^{-1}$ and 1 to 200 mPa·s, particularly 5 to 80 mPa·s, at a shear rate of 100 s$^{-1}$.

In addition, techniques disclosed in the following publications can be applied to the heat-developable light-sensitive material for use in the present invention: EP803764A1, EP883022A1, WO98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to 186572, JP-A-10-197974, JP-A-10-197982, JP-A-10-197983, JP-A-10-197985 to 197987, JP-A-10-207001, JP-A-10-207004, JP-A-10-221807, JP-A-10-282601, JP-A-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-125880, JP-A-129629, JP-A-11-133536 to 133539, JP-A-11-133542, JP-A-11-133543, JP-A-11-223898, JP-A-11-352627, JP-A-11-305377, JP-A-JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, and Japanese Patent Application Nos. 2000-187298, 2000-10229, 2000-47345, 2000-206642, 2000-98530, 2000-98531, 2000-112059, 2000-112060, 2000-112104, 2000-112064, and 2000-171936.

The light-sensitive material (raw stock) is preferably packaged in a packaging material having low oxygen and/or moisture permeability to suppress variation of photographic performance or curling during storage before exposure. A preferred oxygen permeability is 50 ml/atm·m$^2$·day or less, particularly 10 ml/atm·m$^2$·day or less, especially 1.0 ml/atm·m$^2$·day or less, at 25° C. A preferred moisture permeability is 10 g/atm·m$^2$·day or less, particularly 5 g/atm·m$^2$·day or less, especially 1 g/atm·m$^2$·day. The packaging materials described in JP-A-8-254793 and JP-A-12-206653 are examples of those with low oxygen and/or moisture permeability.

The light-sensitive material of the present invention exerts its characteristic performance in short-time exposure at an illuminance as high as 1 mW/mm$^2$ or higher. Under such exposure conditions, sufficient sensitivity is secured notwithstanding the high iodide content of the silver halide emulsion. That is, high sensitivity is obtained by the high-illuminance exposure as compared with low-illuminance exposure. A preferred illuminance is 2 mW/mm$^2$ to 50 W/mm$^2$, particularly 10 mW/mm$^2$ to 50 W/mm$^2$.

The heat-developable light-sensitive material of the invention provides a black-and-white image of developed silver and is suitable for diagnostic application, industrial photography, printing, and computer output microfilm (COM).

The present invention will now be illustrated in greater detail with reference to Examples, but it should be understood that the invention is not deemed to be limited thereto. Unless otherwise noted, all the percents and ratios are given by weight.

EXAMPLE 1

1) Preparation of PETP Support

Polyethylene terephthalate (PETP) having an intrinsic viscosity IV of 0.66 (measured in phenol/tetrachloroethane=

6/4 at 25° C.) was prepared from terephthalic acid and ethylene glycol in a conventional manner. PETP was pelletized, dried at 130° C. for 4 hours, melted at 300° C., and mixed with 0.04% of dye BB shown below. The molten mixture was extruded through a T-die and quenched to obtain an unstretched film which would have a thickness of 175 μm after biaxial stretch and heat set.

Dye BB

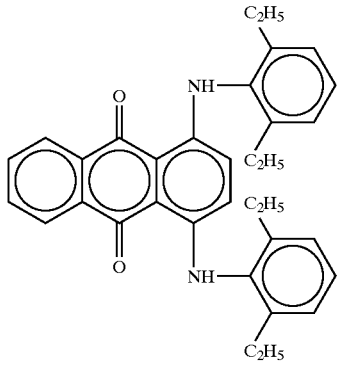

The film was stretched 3.3 times in the machine direction by means of rolls having different peripheral speeds and then 4.5 times in the transverse direction with a tenter at 110° C. and 130° C., respectively. The biaxially stretched film was heat set at 240° C. for 20 seconds, followed by relaxation at the same temperature in the transverse direction. Both lateral edges were trimmed and knurled, and the film was wound under tension of 4 kg/cm$^2$ into a roll.

2) Corona Treatment

Both sides of the PETP film was treated in a solid-state corona surface treatment system (6KVA Model, supplied by Pillar Technologies) at a rate of 20 m/min at room temperature. Current and voltage readings showed that the film was given a corona treatment of 0.375 kV·A·min/m$^2$. The treating frequency was 9.6 kHz, and the air gap between electrodes and the dielectric roll was 1.6 mm.

3) Preparation of Support with Subbing Layers

Formulation (a) shown below was applied to one side (on which a light-sensitive emulsion was to be applied) of the biaxially stretched and corona treated PETP support (thickness: 175 μm) with a wire bar coater at a wet spread of 6.6 ml/m$^2$ and dried at 180° C. for 5 minutes. Formulation (b) shown below was applied to the opposite side (back side) of the support with a wire bar coater at a wet spread of 5.7 ml/m$^2$ and dried at 180° C. for 5 minutes. Formulation (c) shown below was applied on the formulation (b) subbing layer with a wire bar at a wet spread of 7.7 ml/m$^2$ and dried at 180° C. for 6 minutes to prepare a support with subbing layers.

| Formulation (a) (for light-sensitive layer side subbing layer): | |
|---|---|
| Pesresin A-520 (30% solution), available from Takamatsu Oil & Fat Co., Ltd. | 59 g |
| Polyethylene glycol monononylphenyl ether (average mole number of ethylene oxide units: 8.5; 10% solution) | 5.4 g |
| MP-1000 (fine polymer particles; average particle size: 0.4 μm), available from Soken Chemical & Engineering Co., Ltd. | 0.91 g |
| Distilled water | 935 ml |
| Formulation (b) (for 1st subbing layer on back side): | |
| Styrene-butadiene copolymer latex (solid content: 40%; styrene/butadiene = 69/32) | 158 g |
| 2,4-Dichloro-6-hydroxy-s-triazine sodium (8% aqueous solution) | 20 g |

-continued

| | |
|---|---|
| Sodium laurylbenzenesulfonate (1% aqueous solution) | 10 ml |
| Distilled water | 854 ml |
| Formulation (c) (for 2nd subbing layer on back side): | |
| $SnO_2$/SbO (=9/1; average particle size: 0.038 μm; 17% dispersion) | 84 g |
| Gelatin (10% aqueous solution) | 89.2 g |
| Metholose TC-5 (2% aqueous solution), available from Shin-Etsu Chemical Co., Ltd. | 8.6 g |
| MP-1000, from Soken Chemical & Engineering Co., Ltd. | 0.01 g |
| Sodium dodecylbenzenesulfonate (1% aqueous solution) | 10 ml |
| NaOH (1% aqueous solution) | 6 ml |
| Proxel, available from ICI | 1 ml |
| Distilled water | 805 ml |

4) Preparation of Back Side Coating Compositions 4-1) Preparation of Antihalation Layer Coating Composition An antihalation layer coating composition was prepared by mixing 17 g of gelatin, 9.6 g of polyacrylamide, 1.5 g of monodispersed polymethyl methacrylate particles (average particle size: 8 μm; particle size standard deviation: 0.4), 0.03 g of benzoisothiazolinone, 2.2 g of sodium polyethylenesulfonate, 0.1 g of blue dye compound-1, 0.1 g of yellow dye compound-1, and 844 ml of water.

4-2) Preparation of Protective Layer (Back Side) Coating Composition

A coating composition for back side protective layer was prepared by mixing 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of benzoisothiazolinone, 37 mg of fluorosurfactant-1 (potassium N-perfluorooctylsulfonyl-N-propylalanine), 150 mg of fluorosurfactant-2(polyethylene glycol mono(N-perfluorooctylsulfonyl-N-propyl-2-aminoethyl)ether; average degree of ethylene oxide polymerization: 15), 64 mg of fluorosurfactant-3, 32 mg of fluorosurfactant-4, 10 mg of fluorosurfactant-7, 5 mg of fluorosurfactant-8, 8.8 g of an acrylic acid/ethyl acrylate copolymer (=5/95), 0.6 g of aerosol OT (available from American Cyanamid Co.), 1.8 g of liquid paraffin (emulsion), and 950 ml of water in a container kept at 40° C.

5) Preparation of Light-sensitive Layer (Em Layer) Coating Composition 5-1) Preparation of Silver Halide Emulsion-1

To 1420 ml of distilled water was added 4.3 ml of a 1% potassium iodide solution, and 3.5 ml of 0.5 mol/l sulfuric acid and 36.7 g of phthalated gelatin were added thereto. While stirring the mixture in a stainless steel reaction vessel at a liquid temperature kept at 42° C., solution A prepared by diluting 22.22 g of silver nitrate with distilled water to make 195.6 ml and solution B prepared by diluting 21.8 g of potassium iodide with distilled water to make 218 ml were added to the mixture at a constant rate over a 9 minute period. To the mixture were added 10 ml of a 3.5% aqueous solution of hydrogen peroxide and then 10.8 ml of a 10% aqueous solution of benzimidazole.

Solution C prepared by diluting 51.86 g of silver nitrate with distilled water to make 317.5 ml and solution D prepared by diluting 60 g of potassium iodide with distilled water to make 600 ml were added to the mixture at a constant rate over a 120 minute period. Solution D was added according to a controlled double jet method while maintaining the pAg at 8.1. Ten minutes from the start of the addition of solutions C and D, potassium hexachloroiridate (III) was added to the system to give a final concentration of $1\times10^{-4}$ mol per mol of silver. Five seconds after the completion of addition of solution C, an aqueous solution of $3\times10^{31}$ 4 mol, per mol of silver, of potassium hexacyanoferrate (II) was added to the system. The pH of the system was adjusted to 3.8 with 0.5 mol/l sulfuric acid, and the stirring was stopped. The mixture was subjected to flocculation, desalting, and washing with water. The pH was adjusted to 5.9 with 1 mol/l sodium hydroxide to obtain a silver halide dispersion having a pAg of 8.0.

While maintaining the silver halide dispersion at 38° C. with stirring, 5 ml of a 0.34% methanolic solution of 1,2-benzoisothiazolin-3-one was added thereto, and the system was heated to 47° C. Twenty minutes after the temperature reached 47° C., a methanol solution of $7.6\times10^{-5}$ mol, per mole of silver, of sodium benzenethiosulfonate was added. Five minutes later, a methanol solution of $2.9\times10^{-4}$ mol, per mole of silver, of tellurium sensitizer B was added, followed by aging for 91 minutes.

To the system was added 1.3 ml of a 0.8% methanol solution of N,N'-dihydroxy-N"-diethylmelamine. Four minutes later, a methanol solution of $4.8\times10^{-3}$ mol, per mole of silver, of 5-methyl-2-mercaptobenzimidazole and a methanol solution of $5.4\times10^{-3}$ mol, per mole of silver, of 1-phenyl-2-heptyl-5-mercapto-1,3,4-triazole were added to prepare silver halide emulsion-1.

Silver halide emulsion-1 comprised silver iodide grains having an average sphere-equivalent diameter of 0.040 μm with a variation coefficient of 18%. The particle size and its distribution were calculated from the data of 1000 grains under electron microscopic observation.

5-2) Preparation of Silver Halide Emulsion A (To Be Compounded into Emulsion Layer Coating Composition)

Silver halide emulsion-1 was dissolved, and a 1% aqueous solution of $7\times10^{-3}$ mol, per mole of silver, of benzothiazolium iodide was added thereto. Water was added to give a final silver halide content of 38.2 g in terms of silver per kilogram of the resulting silver halide emulsion A.

5-3) Preparation of Fatty Acid Silver Salt Dispersion

A mixture of 87.6 kg of behenic acid (Edenor C22-85R, available from Henkel Chemical), 423 l of distilled water, 49.2 l of a 5 mol/l sodium hydroxide aqueous solution, and 120 l of t-butyl alcohol was allowed to react at 75° C. for 1 hour while stirring to prepare a sodium behenate solution. Separately, 206.2 l of an aqueous solution of 40.4 kg of silver nitrate (pH 4.0) was prepared and kept at 10° C. A reaction vessel containing 635 l of distilled water and 30 l of t-butyl alcohol was maintained at 30° C., and the whole amount of the sodium behenate solution and the whole amount of the silver nitrate aqueous solution were fed thereto while thoroughly stirring at the respective constant rates over a period of 93 minutes and 15 seconds and a period of 90 minutes, respectively.

It was only the silver nitrate aqueous solution that was fed for the first 11 minutes from the start of addition. Adding the sodium behenate solution was started thereafter. It was only the sodium behenate solution that was fed for the last 14 minutes and 15 seconds. During the addition, the inner temperature of the reaction vessel was maintained at 30° C., and the outside temperature was controlled so as to maintain the liquid temperature constant.

The sodium behenate solution was fed through a double-pipe, and warm water was circulated in the outer pipe for heat insulation so that the liquid temperature at the tip of the feed nozzle might be 75° C. On the other hand, the silver nitrate aqueous solution was fed through a double-pipe with cooling water circulating in the outer pipe for heat insulation. The feeding positions for the sodium behenate solution and the silver nitrate aqueous solution were symmetric about the axis of stirring and at such heights where the nozzles might not touch the reaction mixture.

After completion of addition of the sodium behenate solution, the reaction system was kept stirred for an additional 20 minute period, then heated to 35° C. over a period of 30 minutes, followed by aging for 210 minutes. Immediately after the end of aging, solid matter was collected by centrifugal filtration and washed with water until the washing had a conductivity of 30 μS/cm. The solid (silver behenate) as filtered was stored as a wet cake.

The morphology of the resulting silver behenate particles was evaluated by electron microscopic imaging. As a result, they were found to be flaky crystals having average a, b, and c values (previously defined) of 0.14 μm, 0.4 μm, and 0.6 μm, respectively; an average aspect ratio of 5.2; and an average sphere-equivalent diameter of 0.52 μm with a variation coefficient of 15%.

To 260 kg (on dry basis) of the wet cake were added 19.3 kg of polyvinyl alcohol (PVA-217, available from Kuraray Co., Ltd.) and water to make 1000 kg, and the mixture was slurried by means of a dissolver blade and preliminarily dispersed in a pipe line mixer (Model PM-10, supplied by Mizuho Industrial Co., Ltd.).

The preliminarily dispersed stock liquid was treated three times in a dispersing machine (Microfluidizer M-61 with interaction chamber Z, supplied by Microfluidics International Corp.) under an operating pressure of 1260 kg/cm$^2$ to obtain a silver behenate dispersion. The dispersing temperature was kept at 18° C. by controlling the coolant temperature of a serpentine tube heat exchanger attached to the front and the rear of the interaction chamber.

5-4) Preparation of Reducing Agent-2 Dispersion

Ten kilograms of water was added to 10 kg of 6,6'-di-t-butyl-4,4'-dimethyl-2,2'-butylidenediphenol (reducing agent-2) and 16 kg of a 10% aqueous solution of modified polyvinyl alcohol (Poval MP203, available from Kuraray Co., Ltd.), and the mixture was stirred well into a slurry. The slurry was delivered by a diaphragm pump to a transverse sand mill (UVM-2, supplied by Aimex Co., Ltd.) containing zirconia beads having an average diameter of 0.5 mm and dispersed for 3.5 hours. To the dispersion were added 0.2 g of sodium benzoisothiazolinone and an adequate amount of water to adjust the reducing agent concentration to 25%.

The dispersed particles of reducing agent-2 had a median diameter of 0.40 μm and a maximum diameter of 1.5 μm. The resulting dispersion was filtered through a polypropylene filter having a pore size of 3.0 μm to remove foreign matter, such as dust, and stored.

5-5) Preparation of Hydrogen-bonding Compound-1 Dispersion

Ten kilograms of water was added to 10 kg of tri(4-t-butylphenyl)phosphine oxide (hydrogen-bonding compound-1) and 16 kg of a 10% aqueous solution of modified polyvinyl alcohol (Poval MP203), and the mixture was stirred well into a slurry. The slurry was delivered by a diaphragm pump to a transverse sand mill (UVM-2) containing zirconia beads having an average diameter of 0.5 mm and dispersed for 3.5 hours. To the dispersion were added 0.2 g of sodium benzoisothiazolinone and an adequate amount of water to adjust the hydrogen-bonding compound-1 concentration to 25%.

The dispersed particles of hydrogen-bonding compound-1 had a median diameter of 0.35 μm and a maximum particle diameter of 1.5 μm. The resulting dispersion was filtered through a polypropylene filter having a pore size of 3.0 μm to remove foreign matter, such as dust, and stored.

5-6) Preparation of Development Accelerator-1 Dispersion

Ten kilograms of water was added to 10 kg of development accelerator-1 and 20 kg of a 10% aqueous solution of modified polyvinyl alcohol (Poval MP203), and the mixture was stirred well into a slurry. The slurry was delivered by a diaphragm pump to a transverse sand mill (UVM-2) containing zirconia beads having an average diameter of 0.5 mm and dispersed for 3.5 hours. To the dispersion were added 0.2 g of sodium benzoisothiazolinone and an adequate amount of water to adjust the development accelerator-1 concentration to 20%.

The dispersed particles of development accelerator-1 had a median diameter of 0.48 μm and a maximum particle diameter of 1.4 μm. The resulting dispersion was filtered through a polypropylene filter having a pore size of 3.0 μm to remove foreign matter, such as dust, and stored.

Dispersions containing 20% development accelerator-2, development accelerator-3 or toning agent-1 were prepared in the same manner as for the development accelerator-1 dispersion.

5-7) Preparation of Polyhalogen Compound-1 Dispersion

A mixture of 10 kg of tribromomethanesulfonylbenzene (polyhalogen compound-1), 10 kg of a 20% aqueous solution of modified polyvinyl alcohol (Poval MP203), 0.4 kg of a 20% aqueous solution of sodium triisopropylnaphthalenesulfonate, and 14 kg of water was stirred well to prepare a slurry. The slurry was delivered by a diaphragm pump to a transverse sand mill (UVM-2) containing zirconia beads having an average diameter of 0.5 mm and dispersed for 5 hours. To the dispersion were added 0.2 g of sodium benzoisothiazolinone and an adequate amount of water to adjust the polyhalogen compound-1 concentration to 26%.

The dispersed particles of polyhalogen compound-1 had a median diameter of 0.41 μm and a maximum particle diameter of 2.0 μm. The resulting dispersion was filtered through a polypropylene filter having a pore size of 10.0 μm to remove foreign matter, such as dust, and stored.

5-8) Preparation of Polyhalogen Compound-2 Dispersion

A mixture of 10 kg of N-butyl-3-tribromomethanesulfonylbenzamide (polyhalogen compound-2), 20 kg of a 10% aqueous solution of modified polyvinyl alcohol (Poval MP203), and 0.4 kg of a 20% aqueous solution of sodium triisopropylnaphthalenesulfonate was stirred well to prepare a slurry. The slurry was delivered by a diaphragm pump to a transverse sand mill (UVM-2) containing zirconia beads having an average diameter of 0.5 mm and dispersed for 5 hours. To the dispersion were added 0.2 g of sodium benzoisothiazolinone and an adequate amount of water to adjust the polyhalogen compound-2 concentration to 30%. The dispersion was heated at 40° C. for 5 hours to prepare a polyhalogen compound-2 dispersion.

The dispersed particles of polyhalogen compound-2 had a median diameter of 0.40 μm and a maximum particle diameter of 1.3 μm. The resulting dispersion was filtered through a polypropylene filter having a pore size of 3.0 μm to remove foreign matter, such as dust, and stored.

5-9) Preparation of Phthalazine Compound-1 Solution

Eight kilograms of modified polyvinyl alcohol MP203 was dissolved in 174.57 kg of water, and 3.15 kg of a 20% aqueous solution of sodium triisopropylnaphthalenesulfonate and 14.28 kg of a 70% aqueous solution of 6-isopropylphthalazine (phthalazine compound-1) were added thereto to prepare a 5% phthalazine compound-1 solution.

5-9) Preparation of Mercapto Compound-2 Aqueous Solution

Twenty grams of sodium 1-(3-methylureido)-5-mercaptotetrazole (mercapto compound-2) was dissolved in 980 g of water to prepare a 2.0% aqueous solution.

5-10) Preparation of SBR Latex

Styrene, butadiene, and acrylic acid were emulsion polymerized at a ratio of 70.0/27.0/3.0 by using ammonium persulfate as an initiator and an anionic surface active agent as an emulsifying agent. After aging at 80° C. for 8 hours, the emulsion was cooled to 40° C. and adjusted to pH 7.0 with aqueous ammonia. Sandet BL (available from Sanyo Chemical Industries, Ltd.) was added thereto in a concentration of 0.22%, and the emulsion was adjusted to pH 8.3 with a 5% sodium hydroxide aqueous solution and then to pH 8.4 with aqueous ammonia. The molar ratio of $Na^+$ ions to $NH_4^+$ ions was 1:2.3. To 1 kg of the emulsion was added 0.15 ml of a 7% sodium benzoisothiazolinone aqueous solution to prepare an SBR latex.

The resulting SBR latex had the following properties. Tg: 22° C.; average particle size: 0.1 μm; concentration: 43%; equilibrium moisture content (25° C.; 60% RH): 0.6%; ionic conductivity: 4.2 mS/cm (measured on the latex stock (43%) at 25° C. with an ionic conductivity meter CM-30S supplied by Toa Electronics Ltd.); pH: 8.4.

SBR latices having different Tgs were prepared in the same manner as described above, except for changing the copolymerization ratio of butadiene.

5-11) Preparation of Emulsion Layer (Light-sensitive Layer) Coating Composition

A thousand grams of the fatty acid silver salt dispersion, 276 ml of water, 3.2 g of the polyhalogen compound-1 dispersion, 8.7 g of the polyhalogen compound-2 dispersion, 173 g of the phthalazine compound-1 solution, 1082 g of the SBR latex (Tg: 20° C.); 155 g of the reducing agent-2 dispersion, 55 g of the hydrogen-bonding compound-1 dispersion, 1 g of the development accelerator-1 dispersion, 2 g of the development accelerator-2 dispersion, 3 g of the development accelerator-3 dispersion, 2 g of the toning agent-1 dispersion, and 6 ml of the mercapto compound-2 aqueous solution were mixed up successively. Immediately before application, 117 g of silver halide emulsion A was added thereto, followed by mixing well. The emulsion layer coating composition thus prepared was delivered to a coating die and applied.

The emulsion layer coating composition had a viscosity of 40 mPa·s measured at 40° C. with a Brookfield viscometer (No. 1 rotor, 60 rpm) and a viscosity of 530, 144, 96, 51, and 28 mPa·s at a shear rate of 0.1, 1, 10, 100, and 1000 $s^{-1}$, respectively, measured at 25° C. with Rheometrics Fluid Spectrometer (RFS) supplied by Rheometrics Far East. The coating composition has a zirconium content of 0.25 mg per gram of silver.

6) Preparation of Light-insensitive Layer (Em Layer Side) Coating Compositions b 6-1) Preparation of Intermediate Layer Coating Composition A thousand grams of polyvinyl alcohol (PVA-205, from Kuraray Co., Ltd.), 272 g of a 5% pigment dispersion, and 4200 ml of a 19% latex solution of a methyl methacrylate/styrene/butyl acrylate/hydroxyethyl methacrylate/acrylic acid (64/9/20/5/2) copolymer were mixed, and 27 ml of a 5% aqueous solution of aerosol OT (available from American Cyanamid Co.), 135 ml of a 20% aqueous solution of diammonium phthalate, and a requisite amount of water were added thereto to make 10 kg in total. The pH was adjusted to 7.5 with an aqueous sodium hydroxide solution to prepare an intermediate coating composition, which was delivered to a coating die at a rate of 9.1 ml/$m^2$. The coating composition had a viscosity of 58 mPa·s measured at 40° C. with a Brookfield viscometer (No. 1 rotor, 60 rpm).

6-2) Preparation of 1st Protective Layer Coating Composition

To an aqueous solution of 64 g of inert gelatin were added 80 g of a 27.5% latex solution of a methyl methacrylate/styrene/butyl acrylate/hydroxyethyl methacrylate/acrylic acid (64/9/20/5/2) copolymer, 23 ml of a 10% methanol solution of phthalic acid, 23 ml of a 10% aqueous solution of 4-methylphthalic acid, 28 ml of 0.5 mol/l sulfuric acid, 5 ml of a 5% aqueous solution of aerosol OT, 0.5 g of phenoxyethanol, and 0.1 g of benzoisothiazolinone. Water was added to the mixture to make a coating composition weighing 750 g. Immediately before application, 26 ml of 4% chrome alum was mixed into the coating composition by means of a static mixer, and the coating composition was fed to a coating die at a rate of 18.6 ml/m$^2$.

The coating composition had a viscosity of 20 mPa·s measured at 40° C. with a Brookfield viscometer (No. 1 rotor, 60 rpm).

6-3) Preparation of 2nd Protective Layer Coating Composition

To an aqueous solution of 80 g of inert gelatin were added 102 g of a 27.5% latex solution of a methyl methacrylate/styrene/butyl acrylate/hydroxyethyl methacrylate/acrylic acid (64/9/20/5/2) copolymer, 3.2 ml of a 5% solution of fluorosurfactant-1, 32 ml of a 2% aqueous solution of fluorosurfactant-2, 3 ml of a 5% solution of fluorosurfactant-5, 10 ml of a 2% solution of fluorosurfactant-6, 23 ml of a 5% solution of aerosol OT, 4 g of polymethyl methacrylate particles (average particle size: 0.7 μm), 21 g of polymethyl methacrylate particles (average particle size: 4.5 μm), 1.6 g of 4-methylphthalic acid, 4.8 g of phthalic acid, 44 ml of 0.5 mol/l sulfuric acid, 10 mg of benzoisothiazolinone. Water was added to the mixture to make 650 g in total. Immediately before application, an aqueous solution containing 4% chrome alum and 0.67% phthalic acid was mixed into the coating composition by means of a static mixer, and the coating composition was fed to a coating die at a rate of 8.3 ml/m$^2$.

The coating composition had a viscosity of 19 mPa·s measured at 40° C. with a Brookfield viscometer (No. 1 rotor, 60 rpm).

7) Preparation of Heat-developable Light-sensitive Material

The antihalation layer coating composition and the back side protective layer coating composition were applied simultaneously to the back side of the support with subbing layers and dried to form a back layer. The antihalation layer had an absorption of 0.3 at 405 nm, and the protective layer had a gelatin content of 1.7 g/m$^2$.

The emulsion layer coating composition, the intermediate layer coating composition, the 1st protective layer coating composition, and the 2nd protective layer coating composition were simultaneously applied to the subbing layer opposite to the back layer side in this layer order from bottom to top by slide bead coating under the following conditions to form a heat-developable light-sensitive material (designated sample 1). The temperatures of the emulsion layer coating composition, the intermediate layer coating composition, the 1st protective layer coating composition, and the 2nd protective layer coating composition were controlled at 31° C., 31° C., 36° C., and 37° C., respectively. The coating weights of the components making up the emulsion layer were as follows.

| | |
|---|---|
| Silver behenate | 5.55 g/m$^2$ |
| Polyhalogen compound-1 | 0.02 g/m$^2$ |
| Polyhalogen compound-2 | 0.06 g/m$^2$ |
| Phthalazine compound-1 | 0.19 g/m$^2$ |
| SBR latex | 9.67 g/m$^2$ |
| Reducing agent-2 | 0.81 g/m$^2$ |
| Hydrogen-bonding compound-1 | 0.30 g/m$^2$ |
| Development accelerator-1 | 0.004 g/m$^2$ |
| Development accelerator-2 | 0.010 g/m$^2$ |
| Development accelerator-3 | 0.015 g/m$^2$ |
| Toning agent-1 | 0.010 g/m$^2$ |
| Mercapto compound-2 | 0.002 g/m$^2$ |
| Silver halide (as Ag) | 0.091 g-Ag/m$^2$ |

The coating speed was 160 m/min. The gap between the end of the slide and the moving support was 0.10 to 0.30 mm. The vacuum chamber had a pressure 196 to 828 Pa lower than the atmospheric pressure. The support had been destaticized by antistatic cleaning with ionized air before being coated.

The applied coating was air cooled at a dry-bulb temperature of 10 to 20° C. in the subsequent chilling zone, sent by non-contact delivery to a non-contact type helical drier, where it was dried with dry air at a dry-bulb temperature 23 to 45° C. and a wet-bulb temperature 15 to 21° C. After conditioning at 25° C. and 40 to 60% RH, the film surface was heated to 70 to 90° C. and cooled to 25° C.

Sample 1 had a Bekk smoothness, indicative of degree of matting, of 550 seconds on the light-sensitive layer side and 130 seconds on the back side. The light-sensitive layer side surface pH was 6.0.

The compounds used in the preparation of sample 1 are shown below.

Tellurium sensitizer B:

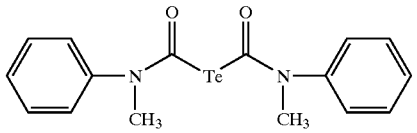

Blue dye compound-1:

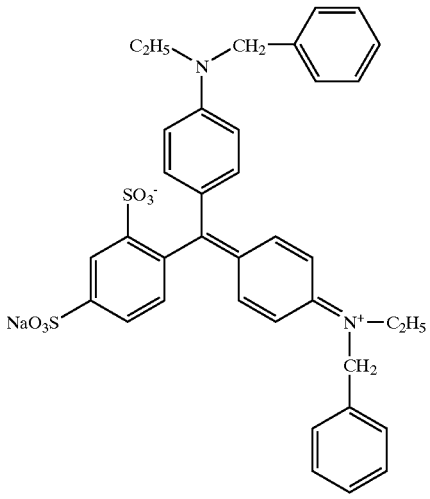

-continued
Yellow dye compound-1:
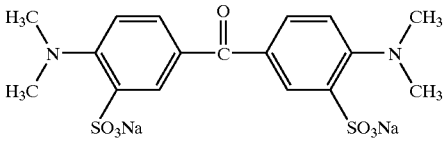
Reducing agent-1
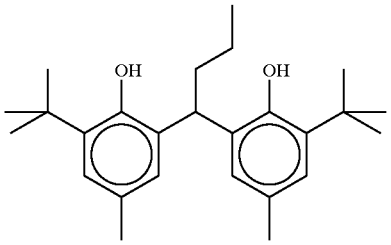
Hydrogen-bonding compound-1
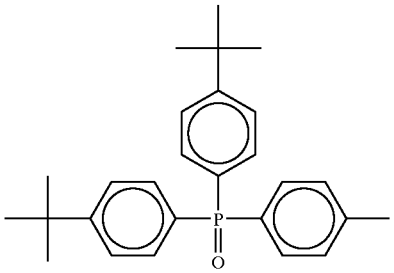
Polyhalogen compound-1:
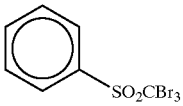
Polyhalogen compound-2:
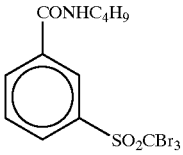
Mercapto compound-1:
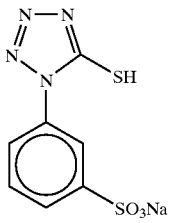
-continued
Mercapto compound-2:
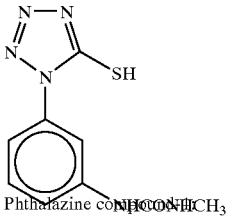
Phthalazine compound-1:
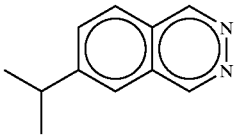
Development accelerator-1:
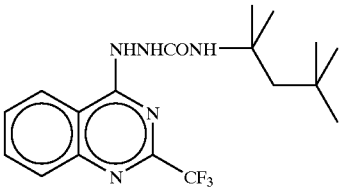
Development accelerator-2:
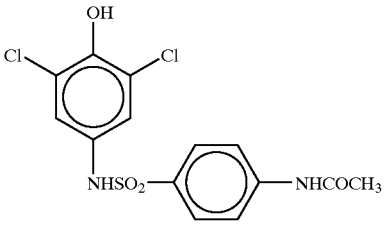
Development accelerator-3:
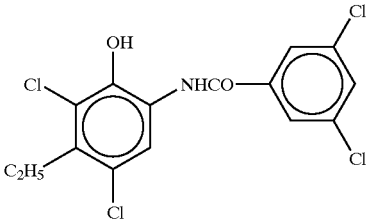
Toning agent-1:
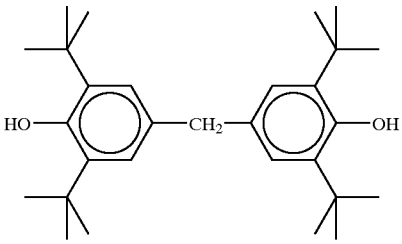

-continued

Fluorosurfactant-1:

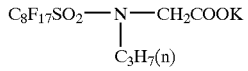

Fluorosurfactant-2:

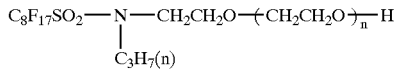

(average n = 15)

Fluorosurfactant-3:

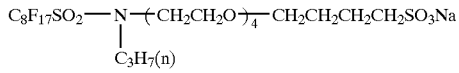

Fluorosurfactant-4:

$C_8F_{17}SO_3K$

Fluorosurfactant-5:

$CF_3(CF_2)_nCH_2CH_2SCH_2CH_2COOLi$ (mixture of n = 5 to 11)

Fluorosurfactant-6:

$CF_3(CF_2)_nCH_2CH_2O(CH_2CH_2O)_mH$ (mixture of n = 5 to 11 and m = 5 to 15)

Fluorosurfactant-7:

$CF_3(CF_2)_nCH_2CH_2SO_3Na$ (mixture of n = 5 to 11)

Fluorosurfactant-8:

$C_6F_{13}CH_2CH_2SO_3Li$

8) Preparation for Evaluation of Photographic Performance

The light-sensitive material prepared (sample 1) was cut to double legal size (356 mm by 432 mm), packaged in the following packaging material in the atmosphere of 25° C. and 50% RH, and stored at room temperature for 2 weeks.

Packaging material: A composite laminate having a structure of PETP 10 μm/polyethylene 12 μm/aluminum foil 9 μm/nylon 15 μm/3% carbon-containing polyethylene 50 μm, an oxygen permeability of 0 ml/atm·m$^2$·25° C.·day, and a moisture permeability of 0 g/atm·m$^2$·25° C.·day.

EXAMPLE 2

Silver halide emulsions-2, -3, and -6 having the uniform halogen composition shown in Table 1 were prepared in the same manner as for emulsion-1 of Example 1 except for changing the halogen composition. Light-sensitive materials were prepared by using these emulsions in the same manner as in Example 1 (designated samples 2, 3, and 6). The temperature condition in silver halide grain formation was controlled so that the resulting silver halide emulsion grains might have an average sphere-equivalent diameter of 40 nm.

EXAMPLE 3

1) Preparation of Silver Halide Emulsion-4 and Sample 4

To 1421 ml of distilled water was added 3.1 ml of a 1% potassium bromide solution, and 3.5 ml of 0.5 mol/l sulfuric acid and 31.7 g of phthalated gelatin were added to the solution. While stirring the mixture in a stainless steel reaction vessel at a liquid temperature of 32° C., solution A prepared by diluting 22.22 g of silver nitrate with distilled water to make 95.4 ml and solution B prepared by diluting 15.6 g of potassium bromide with distilled water to make 97.4 ml were added to the mixture at a constant rate over 45 seconds.

To the mixture were added 10 ml of a 3.5% hydrogen peroxide aqueous solution and then 10.8 ml of a 10% benzimidazole aqueous solution. Solution C prepared by diluting 30.64 g of silver nitrate with distilled water to make 187.6 ml was added to the mixture at a constant rate over 12 minutes. Simultaneously with this addition, solution D prepared by diluting 21.5 g of potassium bromide with distilled water to make 400 ml was added according to a controlled double jet method while maintaining the pAg at 8.1.

Thereafter, solution E of 22.2 g of silver nitrate in 130 ml of distilled water and solution F prepared by diluting 21.7 g of potassium iodide with distilled water to make 217 ml were added by a controlled double jet method while maintaining the pAg at 6.3. Ten minutes from the start of the addition of solutions C and D, a potassium hexachloroiridate (III) solution was added to the system to give a final concentration of $1\times10^{-4}$ mol per mole of silver. Five seconds after the completion of addition of solution C, an aqueous solution of $3\times10^{-4}$ mol, per mole of silver, of potassium hexacyanoferrate (II) was added to the system. The pH of the system was adjusted to 3.8 with 0.5 mol/l sulfuric acid, and the stirring was stopped. The mixture was subjected to flocculation, desalting, and washing with water. The pH was adjusted to 5.9 with 1 mol/l sodium hydroxide to obtain a silver halide dispersion having a pAg of 8.0.

While maintaining the silver halide dispersion at 38° C. with stirring, 5 ml of a 0.34% methanol solution of 1,2-benzoisothiazolin-3-one was added thereto. One minute later, the system was heated to 47° C. Twenty minutes after the temperature reached 47° C., a methanol solution of $7.6\times10^{-5}$ mol, per mole of silver, of sodium benzenethiosulfonate was added. Five minutes later, a methanol solution of $2.9\times10^{-4}$ mol, per mole of silver, of tellurium sensitizer B was added, followed by aging for 91 minutes.

To the system was added 1.3 ml of a 0.8% methanol solution of N,N'-dihydroxy-N"-diethylmelamine. Four minutes later, a methanol solution of $4.8\times10^{-3}$ mol, per mole of silver, of 5-methyl-2-mercaptobenzimidazole and a methanol solution of $5.4\times10^{-3}$ mol, per mole of silver, of 1-phenyl-2-heptyl-5-mercapto-1,3,4-triazole were added to prepare silver halide emulsion-4.

The silver halide grains of silver halide emulsion-4 comprised 70 mol % of a silver bromide layer to which 30 mol % of a silver iodide layer was joined and had an average sphere-equivalent diameter of 40 nm with a variation coefficient of 20%. The portion having the silver iodide crystal structure exhibited a light absorption due to direct transition.

Sample 4 was prepared in the same manner as in Example 1, except for using silver halide emulsion-4.

2) Preparation of Silver Halide Emulsion-5 and Sample 5

To 1421 ml of distilled water was added 3.1 ml of a 1% potassium bromide solution, and 3.5 ml of 0.5 mol/l sulfuric acid and 31.7 g of phthalated gelatin were added to the solution. While stirring the mixture in a stainless steel reaction vessel at a liquid temperature of 34° C., solution A prepared by diluting 22.22 g of silver nitrate with distilled water to make 95.4 ml and solution B prepared by diluting 15.7 g of potassium bromide with distilled water to make 97.4 ml were added to the mixture at a constant rate over 45 seconds. To the mixture were added 10 ml of a 3.5% hydrogen peroxide aqueous solution and then 10.8 ml of a 10% benzimidazole aqueous solution.

Solution C prepared by diluting 51.86 g of silver nitrate with distilled water to make 317.5 ml was added to the mixture at a constant rate over 120 minutes. Simultaneously with this addition, solution D prepared by diluting 60 g of potassium iodide with distilled water to make 600 ml was added according to a controlled double jet method while maintaining the pAg at 6.3.

Ten minutes from the start of the addition of solutions C and D, potassium hexachloroiridate (III) was added to the system to give a final concentration of $1\times10^{-4}$ mol per mole of silver. Five seconds after the completion of addition of solution C, an aqueous solution of $3\times10^{-4}$ mol, per mole of silver, of potassium hexacyanoferrate (II) was added to the system. The pH of the system was adjusted to 3.8 with 0.5 mol/l sulfuric acid, and the stirring was stopped. The mixture was subjected to flocculation, desalting, and washing with water. The pH was adjusted to 5.9 with a 1 mol/l sodium hydroxide aqueous solution to obtain a silver halide dispersion having a pAg of 8.0.

Silver halide emulsion-5 was prepared from the resulting silver halide dispersion in the same manner as in Example 3. The silver halide grains of silver halide emulsion-5 comprised 30 mol % of a silver bromide layer to which 70 mol % of a silver iodide layer was joined and had an average sphere-equivalent diameter of 40 nm with a variation coefficient of 10%. The portion having the silver iodide crystal structure exhibited a light absorption due to intense direct transition. Sample 5 was prepared in the same manner as in Example 1, except for using silver halide emulsion-5.

EXAMPLE 4

The light-sensitive materials prepared in Examples 1 to 3 (samples 1 to 6) were evaluated as follows.

1) Exposure

A semiconductor laser HLHV3000E supplied by Nichia Corp. was fitted into the exposure section of Fuji Medical Dry Laser Imager FM-DPL, and the beam diameter was converged to about 100 $\mu$m. The sample was exposed to the laser beam for 10-6 second at a zero illuminance or an illuminance varied from 1 to 1000 mW/mm$^2$. The oscillation wavelength of the laser light was 405 nm.

2) Development

The four panel heaters arranged in Fuji Medical Dry Laser Imager FM-DPL were set at 112° C.-115° C.-115° C.-115° C. The film running speed was increased so that the total heat development time might be 14 seconds.

3) Evaluation of Sensitivity, Fog, and Contrast

A D-logE curve of each sample was prepared. The density of the unexposed area was taken as a fog. The reciprocal of the exposure giving a density of 3.0 was taken as a sensitivity, which was expressed relatively taking the sensitivity of sample 1 as a standard (100). An average contrast between D 1.5 and D 3.0 was calculated. The results obtained are shown in Table 1 below.

4) Evaluation of Sharpness

The sample was exposed and developed in the same manner as described above, except that the exposure was in a square wave pattern. The density difference of a square wave pattern having a spatial frequency of 1 line/mm was standardized on the basis of that of a pattern having a spatial frequency of 0.01 line/mm to obtain the sharpness. The sharpness was relatively expressed taking the result of sample 1 as a standard (100). The results obtained are shown in Table 1.

5) Evaluation of Resistance Against Post-development Fog Growth (Printout)

The thermally-processed film was allowed to stand at 25° C. and 60% RH for 30 days under fluorescent lamp light of 100 lux. An increase of fog density due to the exposure was taken as a printout. It is desirable for the films to undergo little increase of fog even when allowed to left under such conditions. The results obtained are shown in Table 1.

TABLE 1

| Run No. | Sample No. | Exposure Wavelength (nm) | Iodide Content (mol %) | Bromide Content (mol %) | Silver Halide Grain Size (nm) | Direct Transition Absorption | Sensitivity | Fog | Average Contrast | Sharpness | Printout | Remark |
|---|---|---|---|---|---|---|---|---|---|---|---|---|
| 1 | 1 | 405 | 100 | 0 | 40 | yes | 100 | 0.15 | 3.5 | 100 | 0.00 | invention |
| 2 | 2 | 405 | 3.5 | 96.5 | 40 | no | 30 | 0.32 | 2.8 | 90 | 0.10 | comparison |
| 3 | 3 | 405 | 30 | 70 | 40 | no | 45 | 0.2 | 3 | 92 | 0.06 | invention |
| 4 | 4 | 405 | 30 | 70 | 40 | yes | 70 | 0.2 | 3.2 | 97 | 0.03 | " |
| 5 | 5 | 405 | 70 | 30 | 40 | yes | 85 | 0.18 | 3.2 | 98 | 0.03 | " |
| 6 | 6 | 405 | 95 | 5 | 40 | yes | 105 | 0.18 | 3.5 | 100 | 0.01 | " |

The results in Table 1 prove that the light-sensitive materials of the present invention have high sensitivity, low fog, and excellent resistance to a printout phenomenon. Surprisingly, they achieve high image sharpness, which is considered attributable to reduction of fluorescence blur because absorption by silver halide grains dramatically reduces at 440 nm or longer wavelengths.

EXAMPLE 5

The light-sensitive material of the present invention exhibits satisfactory characteristics with high sensitivity particularly in high-illuminance short-time exposure as testified hereunder.

Samples 1 to 6 were each exposed and developed in the same manner as in Example 4, except that exposure was carried out by using light of a 1 kW tungsten lamp through an interference filter to pass $\lambda$=405 nm. The illuminance, being varied through an optical step wedge, was 0 or in a range of from 0.001 up to 0.1 mW/m$^2$, which was so lower than that used in Example 4 that the exposure time was adjusted so as to result in a necessary optical density. The sensitivity was expressed relatively taking that of sample 2 as 100. The results are shown in Table 2.

TABLE 2

| Run No. | Sample No. | Exposure Wavelength (nm) | Iodide Content (mol %) | Bromide Content (mol %) | Silver Halide Grain Size (nm) | Direct Transition Absorption | Sensitivity | Fog | Average Contrast |
|---|---|---|---|---|---|---|---|---|---|
| 1 | 1 | 405 | 100 | 0 | 40 | yes | 15 | 0.18 | 2.2 |
| 2 | 2 | 405 | 3.5 | 96.5 | 40 | no | 100 | 0.32 | 3.2 |
| 3 | 3 | 405 | 30 | 70 | 40 | no | 35 | 0.2 | 2.8 |
| 4 | 4 | 405 | 30 | 70 | 40 | yes | 30 | 0.2 | 3.2 |
| 5 | 5 | 405 | 70 | 30 | 40 | yes | 20 | 0.18 | 2.5 |
| 6 | 6 | 405 | 95 | 5 | 40 | yes | 20 | 0.18 | 2.5 |

It is seen from comparison between Tables 1 and 2 that the light-sensitive materials of the invention exhibit favorable characteristics over the conventional one (sample 2) when exposed at a high illuminance.

EXAMPLE 6

Silver iodide emulsion-7 was prepared in the same manner as for silver iodide emulsion-1 of Example 1, except that the temperature during grain formation was changed to make grains having an average size of 100 nm. Light-sensitive materials (designated samples 7, 8, and 9) were prepared by using silver iodide emulsion-7 in the same manner as in Example 1, except for changing the coating weight of the silver halide emulsion.

The samples were tested for photographic performance in the same manner as in Example 4. Additionally, the maximum density of the processed samples, $D_{max}$, was measured. The results are shown in Table 3.

TABLE 3

| Run No. | Sample No. | Exposure Wave-length (nm) | Iodide Content (mol %) | Bromide Content (mol %) | Silver Halide Grain Size (nm) | Silver Halide Coating Weight (mg-Ag/m$^2$) | Direct Transition Absorption | Fog | Sensitivity | $D_{max}$ |
|---|---|---|---|---|---|---|---|---|---|---|
| 13 | 1 | 405 | 100 | 0 | 40 | 0.091 | yes | 0.18 | 100 | 4.2 |
| 14 | 7 | 405 | 100 | 0 | 100 | 0.091 | yes | 0.18 | unmeasurable* | 2 |
| 15 | 8 | 405 | 100 | 0 | 100 | 0.18 | yes | 0.18 | 120 | 3.2 |
| 16 | 9 | 405 | 100 | 0 | 100 | 0.36 | yes | 0.17 | 75 | 3.5 |

*No density was developed.

As is understood from Table 3, the silver iodide emulsion used in the invention fails to have sufficient sensitivity with the grain size being as large as 100 nm. Since the absorption by silver halide grains is generally proportional to the cube of the average grain size, higher sensitivity is ought to be expected of greater silver halide grains. Nevertheless, this does not always apply to the high-iodide silver halide emulsion used in the invention. It is seen that reduction in average grain size results in not only higher sensitivity for its size but an increase of $D_{max}$.

EXAMPLE 7

Silver iodide emulsion-8 having an average grain size of 70 nm with a coefficient of grain size variation of 8% was prepared in the same manner as for silver halide emulsion-1 in Example 1, except for raising the grain formation temperature. Similarly, silver halide emulsion-9 having an average grain size of 28 nm with a coefficient of variation of 12% was prepared by changing the temperature of grain formation.

A light-sensitive material (sample 8) was prepared in the same manner as for sample 1, except for replacing silver halide emulsion-1 with a mixture of silver halide emulsions-1, -7, and -8 in a ratio of 60:15:25. When evaluated in the same manner as in Example 4, sample 8 gave favorable results. The average contrast was 2.7.

Similarly, sample 9 was prepared by using a mixture of silver halide emulsions-5 and -8 in a ratio of 85:15. When evaluated in the same manner as in Example 4, sample 9 gave favorable results. Like this, the silver halide emulsions according to the present invention can be used as a mixture in an arbitrary mixing ratio.

EXAMPLE 8

Samples 1, 4, 5, 6, 8, and 9 were exposed, thermally processed, and evaluated in the same manner as in Example 4, except that the four panel heaters were all set at 112° C. The results obtained were as satisfactory as in Example 4.

EXAMPLE 9

Samples 10 to 16 were prepared in the same manner as for samples 1 and 3 to 6 of Example 1 and samples 8 and 9 of Example 6, respectively, except that dye BB was not incorporated into PETP. When evaluated in the same manner as in Example 4, these samples gave satisfactory results.

EXAMPLE 10

Samples 1 to 6 were evaluated in the same manner as in Example 4, except that the samples were exposed to a laser beam having an oscillation wavelength of 395 nm. As a result, the samples were as satisfactory as in Example 4.

As has been fully described, the present invention achieves high-density high-precision imaging or considerable size reduction of an image forming apparatus compared with conventional apparatus by exposing a heat-developable light-sensitive material comprising a support having thereon at least one light-sensitive silver halide layer having a silver iodide content of 5 to 100 mol %, a light-insensitive organic silver salt, a heat developing agent, and a binder by means of a scanning optical system having a light source emitting a laser beam having an emission peak between 350 nm and 450 nm, heat developing the exposed material to about 80 to 250° C. in a heat development section, and cooling the material to or below a development stopping temperature while the material is transported in a cooling section.

What is claimed is:

1. An image forming method comprising exposing a heat-developable light-sensitive material comprising a support having thereon at least a light-sensitive silver halide having a silver iodide content of 5 to 100 mol %, a light-insensitive organic silver salt, a heat developing agent, and a binder by means of a scanning optical system having light source emitting a laser beam having an emission peak between 350 nm and 450 nm to form a latent image on said heat-developable light-sensitive material, heating said heat-developable light-sensitive material to about 80 to 250 ° C. in a heat development section, and cooling said heat-developable light-sensitive material having been heat treated in said heat development section to or below a development stopping temperature while said heat-developable light-sensitive material is transported in a cooling section.

2. An image forming method according to claim 1, wherein said silver halide of said heat-developable light-sensitive material exhibits a direct transition absorption ascribed to the silver iodide crystal structure.

* * * * *